United States Patent [19]

Silvoza

[11] Patent Number: 4,738,235

[45] Date of Patent: Apr. 19, 1988

[54] ROTARY ENGINE HAVING CONTROLLER AND TRANSFER GEARS

[75] Inventor: Eleuterio P. Silvoza, Quezon City, Philippines

[73] Assignee: Raincor, Inc., Jersey City, N.J.

[21] Appl. No.: 795,659

[22] Filed: Nov. 6, 1985

[51] Int. Cl.[4] ..... F02B 53/00

[52] U.S. Cl. ..... 123/245; 418/36; 418/38; 418/143

[58] Field of Search ..... 123/245; 418/35, 36, 418/38, 143

[56] References Cited

U.S. PATENT DOCUMENTS

| | | | |
|---|---|---|---|
| 329,354 | 10/1885 | Asher et al. | 123/24 |
| 1,482,629 | 2/1924 | Bullington . | |
| 1,904,892 | 4/1933 | Trube . | |
| 2,050,603 | 8/1936 | Gardner | 418/38 |
| 2,147,290 | 2/1939 | Gardner . | |
| 2,271,068 | 1/1942 | Gardner . | |
| 2,367,676 | 1/1945 | Griffith | 418/36 X |
| 2,736,328 | 2/1956 | Mallinckrodt . | |
| 3,227,090 | 1/1966 | Bartolozzi . | |
| 3,256,866 | 6/1966 | Bauer . | |
| 3,288,122 | 11/1966 | Atsalos et al. . | |
| 3,292,602 | 12/1966 | Stewart . | |
| 3,327,692 | 6/1967 | Keagle . | |
| 3,397,680 | 8/1968 | Guin . | |
| 3,439,549 | 4/1969 | Sabet . | |
| 3,500,798 | 3/1970 | Arnal . | |
| 3,798,897 | 3/1974 | Nutku | 418/36 X |
| 3,820,516 | 6/1974 | Paleologos | 418/36 |
| 3,824,963 | 7/1974 | Eda | 418/38 X |
| 3,854,457 | 12/1974 | Taurozzi | 418/38 X |
| 3,909,162 | 9/1975 | Nutku | 418/34 |
| 3,922,118 | 11/1975 | Bancroft | 418/37 |
| 3,990,405 | 11/1976 | Kecik | 418/38 X |
| 4,035,111 | 7/1977 | Cronen | 418/38 |
| 4,057,374 | 11/1977 | Seybold | 418/36 |
| 4,086,879 | 5/1978 | Turnbull | 418/34 X |
| 4,334,841 | 6/1982 | Barlow | 418/38 |

FOREIGN PATENT DOCUMENTS

| | | | |
|---|---|---|---|
| 987932 | 4/1951 | France | 418/36 |

*Primary Examiner*—Michael Koozo

*Attorney, Agent, or Firm*—Ralph W. Selitto, Jr.

[57] ABSTRACT

A rotary engine has a first ring-shaped floor portion connected to an inner shaft for rotation therewith and a second ring-shaped floor portion connected to an outer shaft for rotation therewith. The annular floor portions cooperate with an engine casing to define an annular chamber. A first pair of diametrically aligned pistons are positioned within the annular chamber and are connected to the first ring-shaped floor portion while a second pair of diametrically aligned pistons are positioned within the angular chamber and connected to the second ring-shaped floor portion. The pistons cooperate to define a plurality of combustion chambers. Means are provided for causing combustion in the combustion chambers for imparting rotary motion to the inner and outer shafts. A first power transfer gear connected to the inner shaft transfers power to a drive shaft when the inner shaft is driven and a second power transfer gear connected to the outer shaft transfers power to the drive shaft when the outer shaft is driven. Unique piston seals, a controller for regulating the position of the pistons, and a novel lubrication system are also disclosed.

26 Claims, 32 Drawing Sheets

237
148
101
103
25
214
105
225
14
24
224
A
A
241
117
122
121
123
232
233
234
236
240
124
125
239
230
229
29
30
231
242
243
244
41
127
126
129
128
32
33
34
35
42
44
43
119
37
39
40
152

Fig. 14.
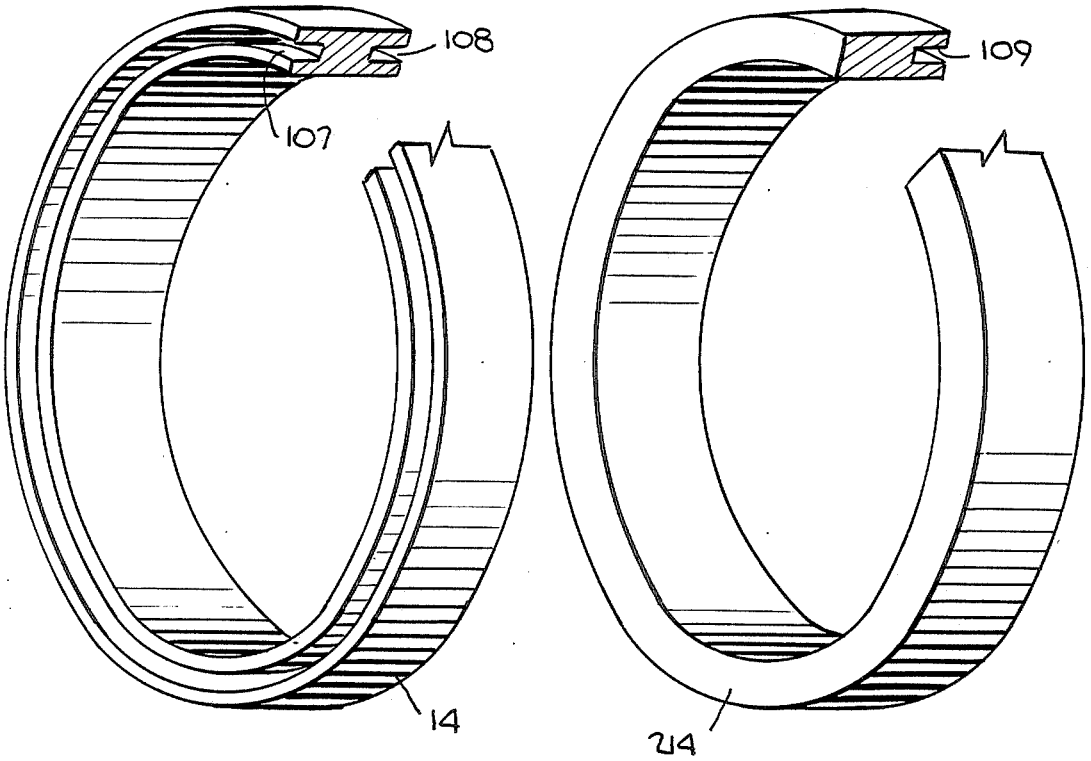
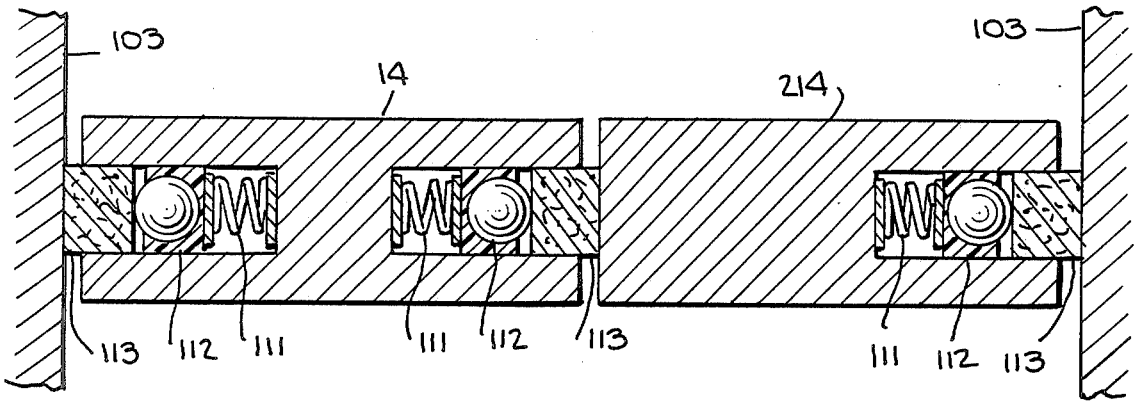
Fig. 14A.

111

112

113

113
112
111

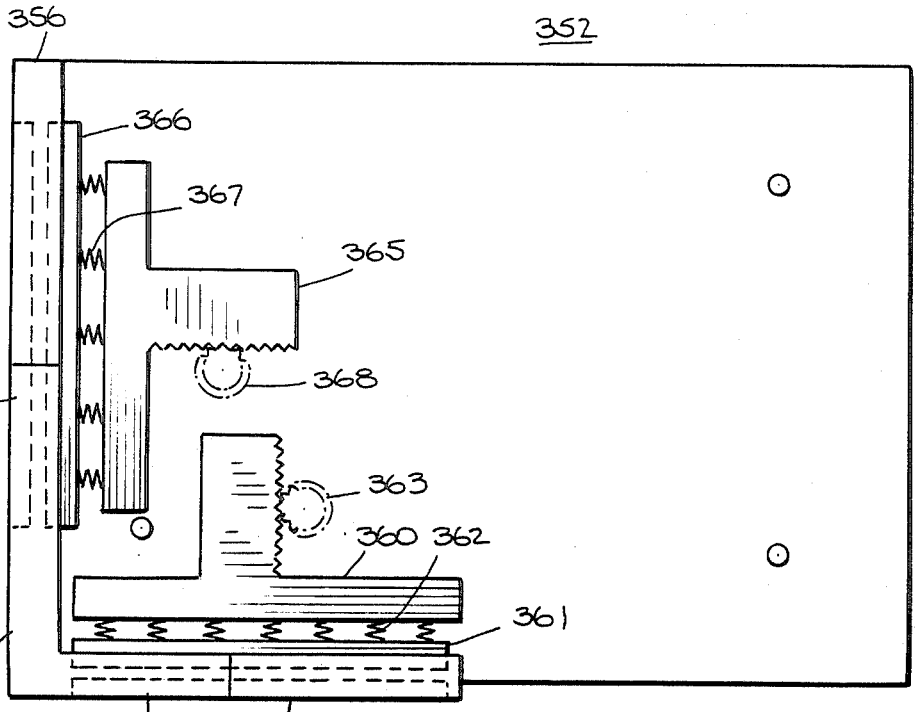
Fig. 23.
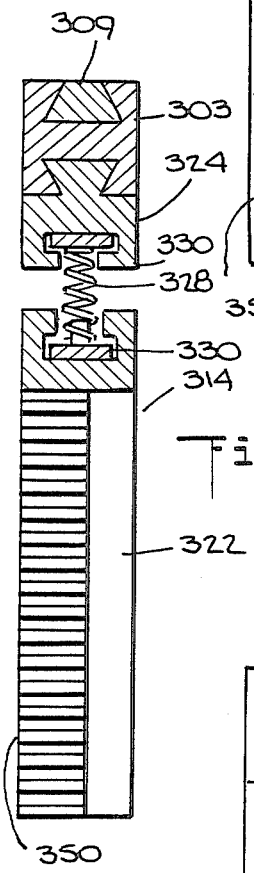
Fig. 26.
Fig. 22.
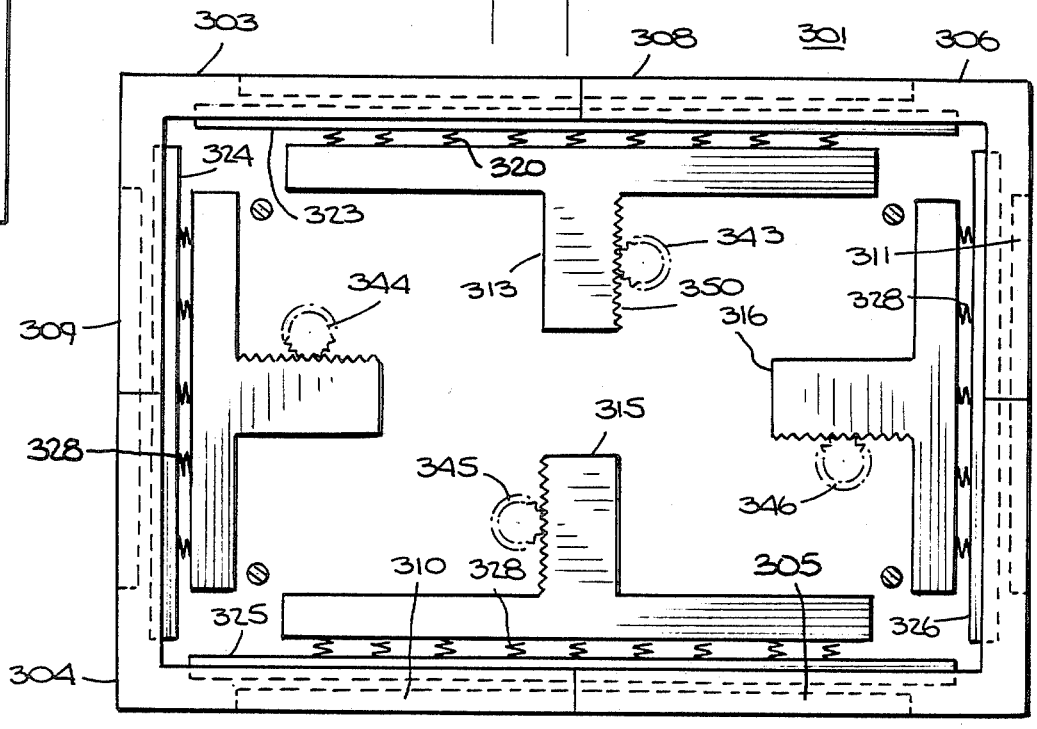

ROTARY ENGINE HAVING CONTROLLER AND TRANSFER GEARS

BACKGROUND OF THE INVENTION

The present invention is related generally to internal combustion engines and, more specifically, to rotary internal combustion engines.

Various types of internal combustion engines exist today. The most commonly used internal combustion engine for powering automobiles is the familiar internal combustion gasoline engine having a cylinder head in which pistons, carried on a crankshaft, are reciprocated by explosion of a gas-air mixture ignited by spark plugs. This type of internal combustion engine uses cam operated poppet valves, push rods, and a flywheel, all governed by means of a relatively complicated timing device. Lately, while such engines have enjoyed great commercial success, their limitations are becomming more apparent in the face of stricter air pollution laws and higher fuel economy demanded by the purchasing public. Oftentimes, air pollution emission standards and fuel economy are competing design criteria. In an effort to satisfy both requirements, this type of engine has become more complicated thus increasing production and maintenance costs.

Another type of internal combustion engine which has received widespread commercial acceptance is the diesel engine. This engine is generally used for driving heavier equipment such as railway engines, heavy trucks, and the like, but has lately gained some acceptance as an automobile engine because of its fuel economy. The diesel engine operates on diesel fuel and generates power in a crankshaft by means of reciprocating pistons. Poppet valves, cams, push rods, etc., are governed by means of timing devices. Unfortunately, the diesel engine suffers from many of the same limitations as the gasoline engine in addition to being difficult to start in cold weather.

Another type of internal combustion engine, known as a rotator type rotary engine, employs multiple rotors having simple rotary motion with an equal number of pistons attached to each rotor. Each rotor is attached to a mechanism which permits free-wheeling rotary motion and allows each set of pistons to travel in a common toroidal cylinder. Fuel intake, compression, combustion, and exhaust occur simultaneously at different angular positions of the toroidal chamber. The sequence of events between the pistons attached to the first rotor is repeated between the pistons attached to the second rotor. However, the control of the rotary motion of the rotors, and hence the pistons, has not been perfected with the result of inconsistent combustion ratios, the inability to control the rpms of the engine, and the overall inability to deliver power at a constant rate.

Another type of rotary engine which has enjoyed some commercial success is the Wankel rotary engine. This engine uses a three-cornered rotary element which is eccentrically mounted to a drive shaft for travelling in a toroidal chamber. The chamber has periphreal intake and exhaust ports and is divided by the rotary element into three smaller chambers, each of which being analogous to a cylinder in the standard gasoline engine. To increase the volume of each small chamber, segments of the rotor rim are recessed. During the combustion expansion phase, unburned gas tends to flow at high velocity away from the combustion zone with the result that part of the charge is unburned. This limits performance and increases air pollution. In addition, poor fuel consumption, together with a tendency of the seals between the rotary element and the toroidal chamber to prematurely wear, have detracted from the mass production of this engine on scales anywhere near those of the common internal combustion gasoline engine.

Yet another type of rotary engine, known as the Tschudi rotary engine, utilizes pistons which travel in a circular or an orbital path. Intake, compression, combustion and exhaust occur simultaneously at different angular positions of the toroidal chamber. Two rotors are employed with a set of two pistons affixed 180° apart on each rotor. One rotor travels at a constant angular velocity while the movement of the other rotor is controlled by a complex crank and gear arrangement which enables the second set of pistons to accelerate and decelerate so that the volume of the combustion chamber between the pistons can be varied. However, shock loads associated with starting and stopping the rotors at high speed can create problems in everyday use. Also, there is no way to increase power output except by increasing the diameter of the toroidal chamber or adding a second toroidal chamber. Either of these two options increases the weight to power output ratio beyond acceptable limits and increases production costs.

Despite the problems associated with the various types of internal combustion rotary engines discussed above, research and development continues in an effort to further improve this type of invention. For example, in U.S. Pat. No. 3,227,090 to Bartolozzi, a rotary engine has a toroidal chamber, the floor of which is comprised of two rings as best seen in FIG. 3 of the Bartolozzi patent. The rings are capable of rotating in one direction. Each annular ring carries radially opposed pistons which are ultimately driven by the combustion of an air-fuel mixture. By alternately driving the pisons, the rings are also alternately driven. A mechanism is provided for transmitting the rotary motion of the rings to a central shaft.

In U.S. Pat. No. 4,344,841 to Barlow, a rotary engine having a pair of coaxial and independently rotatable shafts is shown. Each shaft carries a pair of pistons. Correct control of the shafts, and hence control of the pistons, is effected by connecting the inner and outer shafts to a causal mechanism unit, in part consisting of a cam and rhomboid mechanism. The rhomboid mechanism consists of four rollers connected by links to form a four-sided geometric figure. Two of the links are connected to the inner shaft while two of the links are connected to the outer shaft. The rhomboid mechanism is located within a cam, the surface of which is precisely described. By requiring the rhomboid mechanism to travel along the cam surface, the movement of the pistons can be controlled. This mechanism is also used to couple power generated by the engine to an output shaft.

U.S. Pat. No. 1,904,892 to Trube discloses a rotary engine having two pairs of diametrically opposed pistons, each carried by a disc. The discs, and hence the pistons, are connected to rollers which are constrained to move along a camming surface provided by a cam member. In this manner, the movement of the pistons can be controlled.

U.S. Pat. No. 2,736,328 to Mallenckrodt discloses a rotary engine utilizing a combustion chamber, the floor of which is comprised of two relatively rotatable annular ring members, as in the Bartolozzi patent, and a causal control mechanism having a cam surface for controlling the relative movement of the pistons as in the Barlow and Trube patents.

Another example of a rotary engine is U.S. Pat. No. 2,147,290 to Gardner. This patent discloses a rotary engine wherein a first set of pistons is secured to a hub which is substantially one-half the length of the pistons. A second set of pistons is secured to a second hub, which is again substantially one-half the length of the pistons. One-half of the first set of pistons overhangs the second hub, while one-half of the second set of piston overhangs the first hub. A control means, shown generally in FIG. 3 of the Gardner patent, is eliptically-shaped with the opposite end walls thereof being substantially semi-circular, while the side walls are parellel for a major portion of their length. This is another example of a control means used to control the motion of the pistons. A rectangular piston seal, which is comprised of overlapping elements, two of which are L-shaped, lies in a continuous groove in each of the pistons are best seen in FIG. 2 of the Gardner patent. Suitable springs are provided for urging the sealing blade elements into yielding engagement with the cylinder walls. In addition to the rectangular compression seals carried by the pistons, rings are preferably fitted into the circular grooves in the end plates to prevent the escape of combustion gases between the adjacent hub and the end plate.

Despite substantial work by numerous individuals, rotary engines still suffer from substantial problems which have prevented their mass production and widespread use. For example, although numerous mechanisms have been devised for transferring the power developed by the rotary engine to an output shaft, such power transfer mechanisms have typically been complex and unreliable. Additionally, the movement of the pistons within the chamber must be precisely controlled in power is to be continuously and smoothly generated. The replacement of worn piston seals is a major task in a rotary engine because the piston seals lie at the very heart of the engine. Replacement of these seals is thus a very complicated and expensive procedure which has contributed to the cool reception in the marketplace of various types of rotary engines. Additionally, lubrication of the pistons is complicated by the fact that the pistons are travelling in a circular orbit. Although lubrication must be provided in order to enable the pistons to move smoothly and eliminate unnecessary wear, the lubricant must be removed from the inside of that portion of the chamber in which combustion takes place. Otherwise unacceptable emissions occur. Such lubrication systems have tended to be complex, expensive and unreliable. Rotary engines have also, in general, required numerous moving parts which leads to higher production and maintenance costs.

SUMMARY OF THE PRESENT INVENTION

It is an object of the present invention to provide a rotary engine capable of efficiently developing high torque from a minimum number of combustions.

It is another object of the present invention to provide a simple arrangement of transfer gears for smoothly coupling power generated by the internal combustion engine to an output shaft, and for enabling simple regulation of the number of combustions required to maintain a predetermined number of revolutions per minute (rpm).

It is a further object of the present invention to provide two pairs of pistons capable of independent rotation and a control mechanism for precisely controlling the position of the pistons, which control mechanism is not subject to high torque or shocks which might damage the mechanism.

It is a further object of the present invention to provide piston seals capable of expanding in the direction of wear to thereby contain combustion gases.

It is a further object of the present invention to provide a simple lubrication system for providing oil to and withdrawing oil from the pistons in a simple and effective manner.

It is a further object of the present invention to provide a rotary engine having a dual cooling system for maintaining proper engine temperature.

It is a still further object of the present invention to provide a rotary engine having fewer moving parts.

It is a still further object of the present invention to provide a rotary engine having a fuel injection pump and a distributor responsive to the rotation of an inner and outer shaft.

In one embodiment of the present invention, a rotary engine having an improved power transfer mechanism includes a first member carrying a first pair of diametrically aligned pistons. A second member carries a second pair of diametrically aligned pistons with the first and second pairs of pistons cooperating to define a plurality of combustion chambers. Means are provided for causing combustion in the combustion chambers such that the first and second members are alternately driven. A first power transfer member is connected to the first member for transferring power to a drive shaft when the first member is driven. A second power transfer member is connected to the second member for transferring power to the drive shaft when the second member is driven.

In another embodiment of the present invention. A rotary engine having improved piston seals includes a first member carrying a first pair of diametrically aligned pistons. A second member carries a second pair of diametrically aligned pistons with the first and second pairs of pistons cooperating to define a plurality of combustion chambers. Means are provided for causing combustion in the combustion chambers for imparting rotary motion to the first and second members. A plurality of expandable seals carried by the pistons is provided with each seal having at least two independent sealing members with one of the sealing members being mortised. A biasing member is provided for biasing one of the independent sealing members. A bridge member is carried in the mortise for connecting the two independent sealing members such that the biased sealing member is capable of moving independently of the other sealing member while maintaining the seal.

In another embodiment of the present invention, a rotary engine having an improved oil system is provided. A first shaft carries a first pair of diametrically aligned pistons. A second shaft carries a second pair of diametrically aligned pistons with the first and second pairs of pistons cooperating to define a plurality of combustion chambers. Means are provided for causing combustion in the combustion chambers for imparting rotary motion to the first and second shafts. A first oiling means is connected to one of the first or second shafts for supplying oil to at least one of the first or second pairs of pistons in response to the rotary motion of the shaft. A first oil withdrawal means is connected to one of the first or second shafts for withdrawing oil from the at least one of the first and second pairs of pistons in response to the rotary motion of the shaft.

In yet another embodiment of the present invention, a rotary engine having timing cam blocks is provided. A first shaft carries a first pair of diametrically aligned pistons. A second shaft carries a second pair of diametrically aligned pistons. The first and second pairs of pistons cooperate to define a plurality of combustion chambers. A plurality of valves for controlling the input of air and fuel to the combustion chambers and for controlling the removal of exhaust gases from the combustion chambers is provided. Means are provided for causing combustion in the combustion chambers for imparting rotary motion to the first and second shafts. A first plurality of cams is connected to the first shaft and has a first plurality of camming surfaces. A second plurality of cams is connected to the second shaft and has a second plurality of camming surfaces. A plurality of cam followers and rocker arms responsive to the first and second pluralities of cam surfaces are provided for opening and closing the plurality of valves in a timed relationship determined by the first and second pluralities of camming surfaces.

The rotary engine of the present invention, which may be referred to in this specification as the Silvoza rotary engine, provides a rotary engine of high torque and high kinetic energy derived from a minimum number of combustions. The combustions alternately driven inner and outer shafts with each shaft carrying a pair of diametrically aligned pistons. Unique power transfer gears are provided which enable the simple and smooth coupling of power produced by the engine to an output shaft. The simplicity of the transfer gears enables the number of combustions required to maintain a predetermined number of rpms to be reduced without requiring substantial construction changes in the engine. The movement of the pistons is precisely controlled by a uniquely configured controller. The controller is not subjected to stress because it is not used for transferring power. Unique piston seals are provided which enable the containment of combustion gases within a combustion chamber despite wear. A simple lubrication system is provided for providing oil to and withdrawing oil from the pistons. The lubrication system works in conjunction with the inner and outer shafts such that it requires few moving parts yet operates effectively. The lubrication system can also be used as part of a cooling system in conjunction with normal water cooling passages provided in the engine casing. Numerous parts rotate in conjunction with either the inner or the outer shaft such that the overall number of independently moving parts is reduced. The Silvoza rotary engine employs a novel fuel pump and distributor which are responsive to the rotation of both the inner and outer shafts. These and numerous other advantages and benefits of the present invention will become apparent from the description of a preferred embodiment hereinbelow.

BRIEF DESCRIPTION OF THE FIGURES

In order that the present invention may be clearly understood and readily practiced, a preferred embodiment will now be described, by way of example only, with reference to the accompanying figures wherein:

FIG. 14 illustrates the two annular rings which define the floor of the annular chamber;

FIG. 14*a* is a cross-sectional view of the annular rings of FIG. 14 assembled together with seals;

FIG. 22 illustrates a plan view of an assembled rectangular piston seal carried by a base plate;

FIG. 23 is a plan view of an assembled auxiliary seal carried by a trailing face plate;

FIG. 26 is a cross-sectional view of one of the bias members illustrated in FIG. 25;

DESCRIPTION OF A PREFERRED EMBODIMENT

System Description

Figure 1:
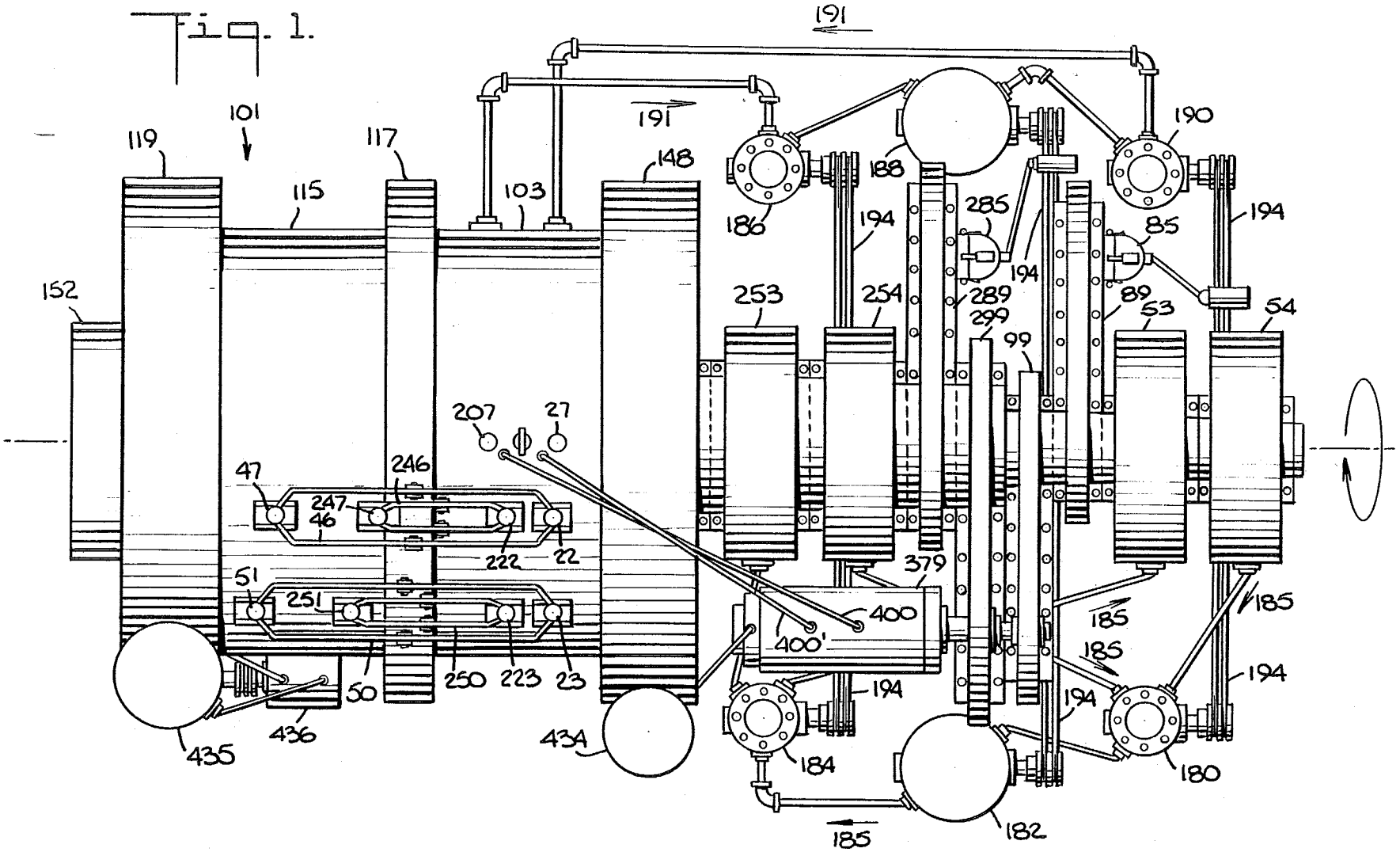
FIG. 1 is a top view looking down on a rotary engine constructed according to the teachings of the present invention.

I. Inner and Outer Shafts, Annular Floor Portions, and Combustion Chambers

A rotary engine 1 constructed according to the teachings of the present invention is illustrated generally in FIGS. 1, 2, 5, and 6. At the center of the rotary engine 1 lies an inner shaft 3 illustrated in FIG. 3*a* and an outer shaft 203 illustrated in FIG. 3. The inner shaft 3 has a plurality of splined portions 5, 6, 7, 8, 9, and 10 provided at one end thereof which will be labeled, for purposes of description only, the front end of the inner shaft 3. The inner shaft 3 also carries, at what will be described as the rear end of the shaft, two splined portions 11 and 12. The purpose of these splined portions is described hereinbelow.

Figure 3:
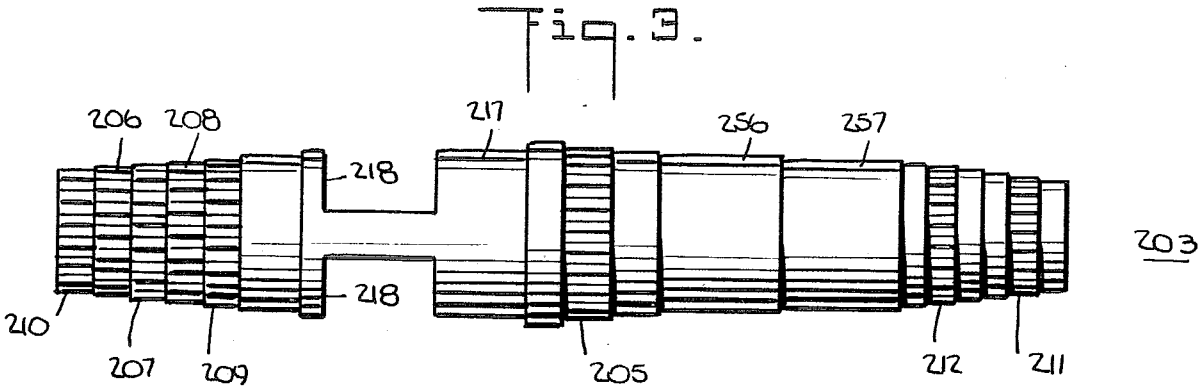
FIG. 3 illustrates the inner shaft.

The outer shaft 203 illustrated in FIG. 3 also carries a plurality of splined portions 205, 206, 207, 208, 209, 210, 211, and 212. The reference numerals assigned to the splined portions of the outer shaft 203 have been assigned in such a manner that the splined portion 205 performs the same function for the outer shaft 203 as the splined portion 5 performs for the inner shaft 3, the splined portion 206 performs the same function for the outer shaft 203 as the splined portion 6 performs for the inenr shaft 3, etc. Again, the purpose of these splined portions will be discussed in detail hereinbelow.

Figure 2:
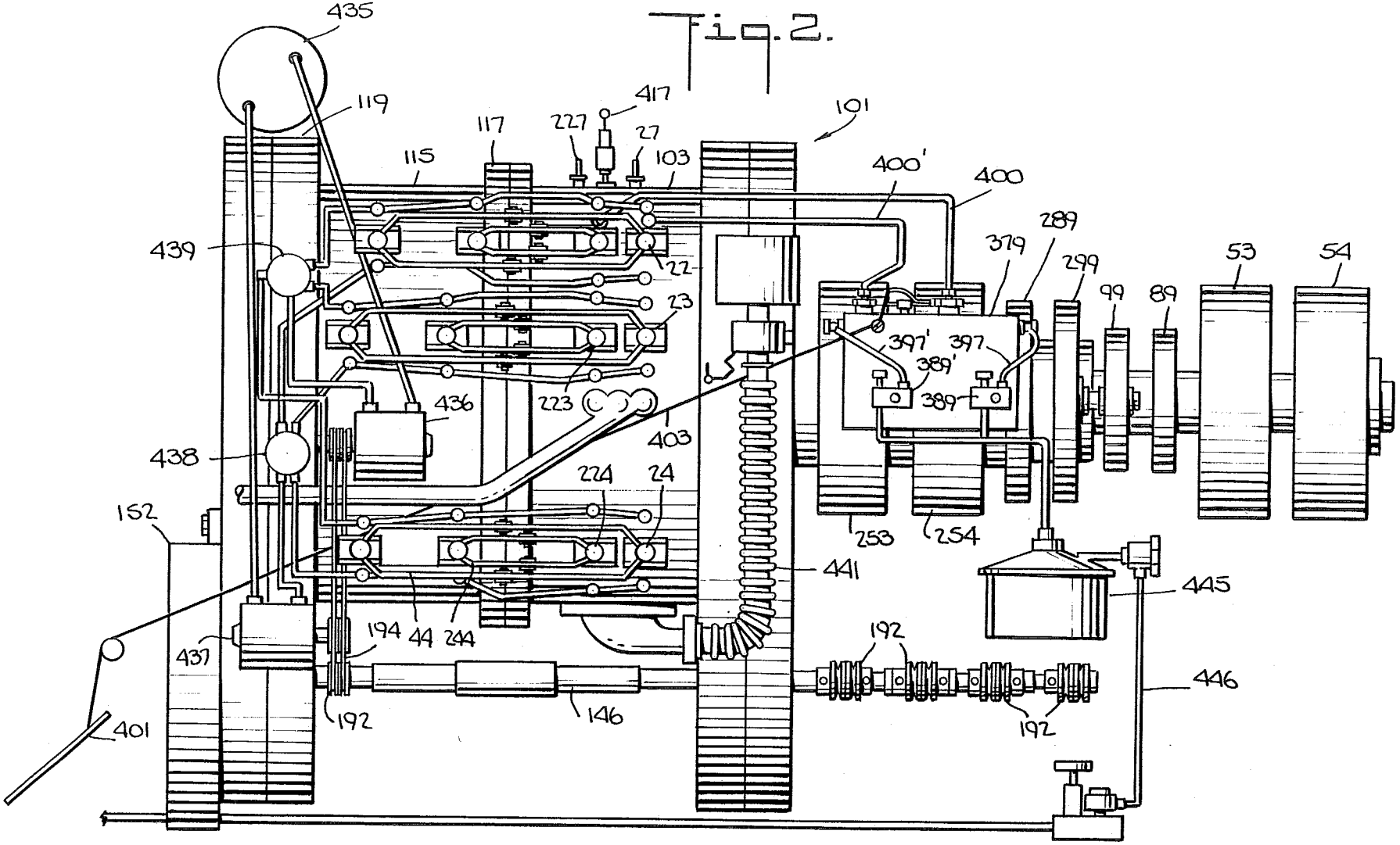
FIG. 2 is a right side view of a rotary engine constructed according to the teachings of the present invention.
Figure 3A:
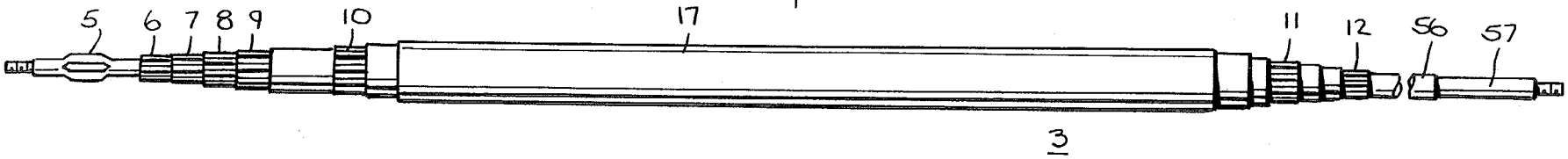
FIG. 3*a* illustrates the outer shaft.
Figure 4:
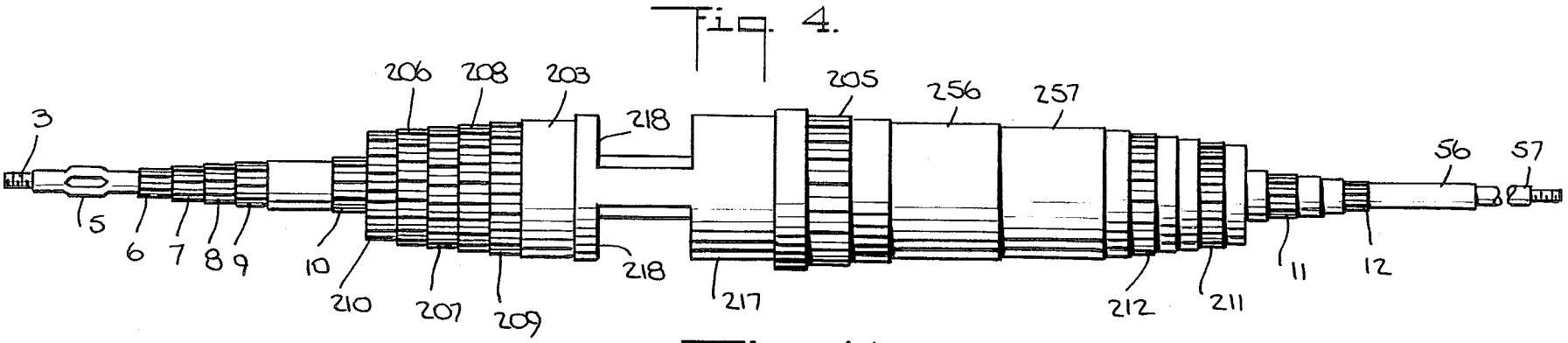
FIG. 4 illustrates the inner and outer shafts together.

The inner shaft 3 illustrated in FIG. 3*a* includes a middle portion adapted to carry the outer shaft 203. When the inner shaft 3 and outer shaft 203 are connected together they form one continuous shaft as shown in FIG. 4. The combined shaft shown in FIG. 4 runs horizontally, from left to right, in the rotary engine 1 illustrated in FIGS. 1, 2, 5, and 6.

Figure 5:
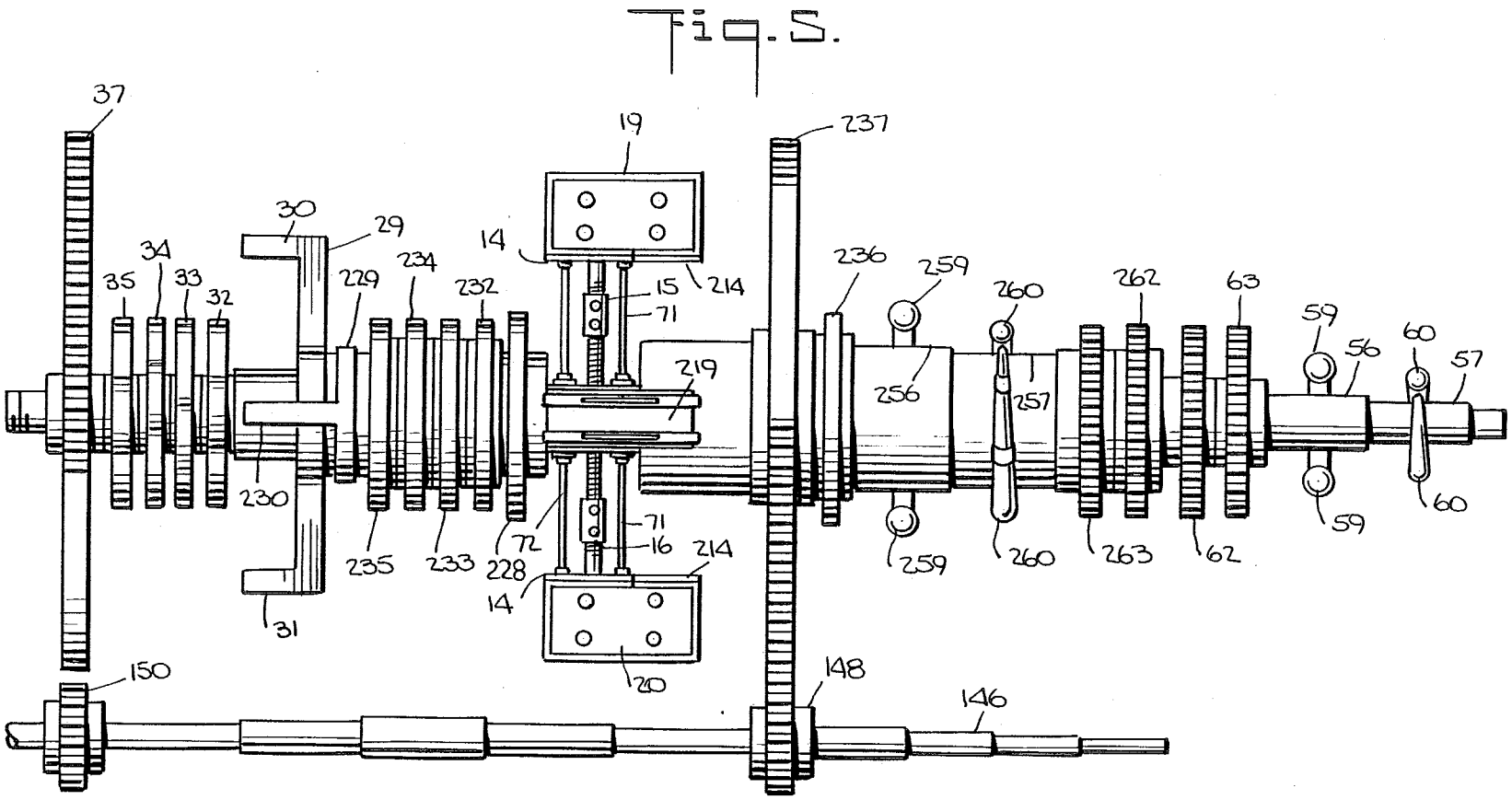
FIG. 5 illustrates a right side view, without the engine casing, of the interior of a rotary engine constructed according to the teachings of the present invention.
Figure 6:
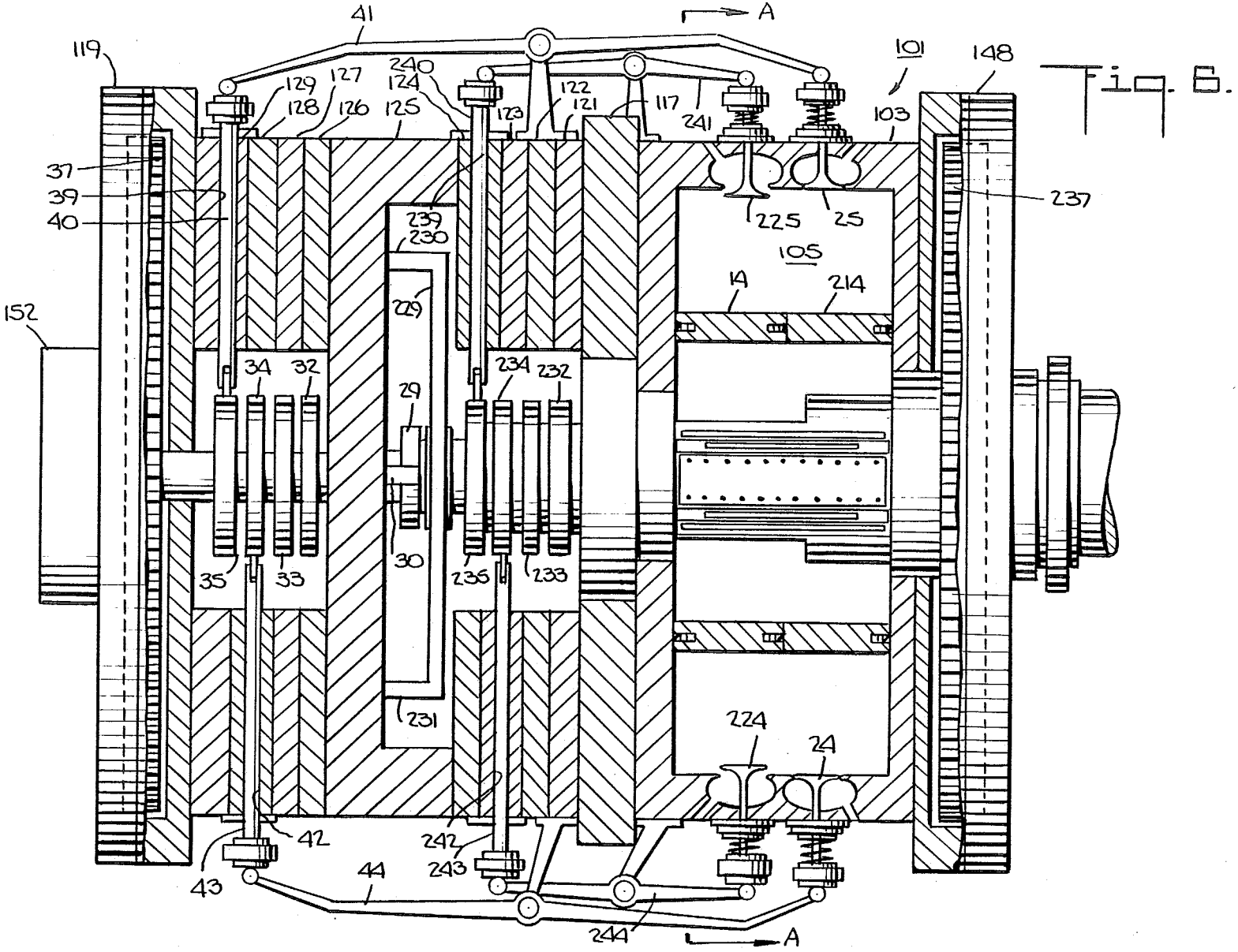
FIG. 6 illustrates a right side view, in cross-section, of a rotary engine constructed according to the teachings of the present invention.

The rotary engine 1 of the present invention includes an outer engine casing 101 shown in FIGS. 1, 2, and 6 which substantially encloses the rotary engine 1. The engine casing 101 has a portion 103 which defines a cylindrical chamber. The cylindrical chamber 103 is divided into a toroidal chamber 105, best seen in FIGS. 6 and 16, by a first annular floor portion 14 and a second annular floor portion 214 best seen in FIG. 6. The first annular floor portion 14 is connected to the inner shaft 3 for rotation therewith by a pair of supports 15 and 16, best seen in FIG. 5. Supports 15 and 16 are connected to the inner shaft 3 in that area generally designated 17 in FIG. 3*a*.

Similarly, the second floor portion 214 is connected to the outer shaft 203 for rotation therewith by a pair of supports (not shown) to that area of the outer shaft 203 generally designated 217 in FIG. 3. The outer shaft 203 has a notched portion 218 which is provided so that the outer shaft 203 does not interfere with the supports 15 and 16 connecting the inner shaft 3 to the first annular floor portion 14. In this manner, the inner shaft 3 and first annular floor portion 14 are capable of rotating independently of, and at different speed than, the outer shaft 203 and the second annular floor portion 214.

Figure 16:
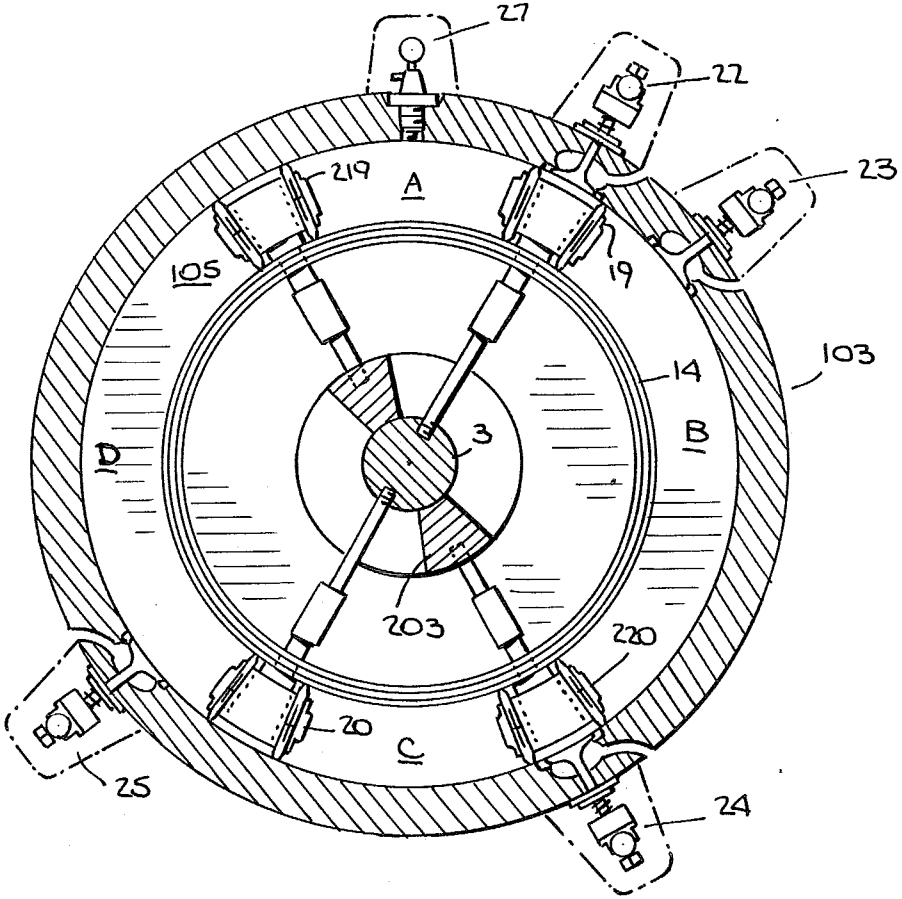
FIG. 16 is a view taken along the lines A—A of the rotary combustion engine illustrated in FIG. 6.
Figure 19:
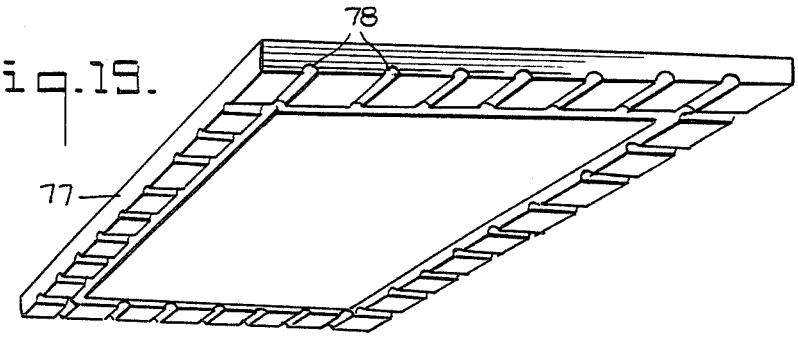
FIGS. 19 and 19*a* illustrate a trailing face plate having oil channels on one side and mortised seal supports on the other side, respectively.

The first annular floor portion 14 carries a first pair of diametrically aligned pistons 19 and 20 as shown in FIGS. 5 and 16. The pistons are configured to overlay the second annular floor portion 214 to divide the toroidal chamber 105 into various sections. The pistons 19 and 20 therefore rotate with the first annular floor portion 14, while the second annular floor portion 214 simply slides underneath the pistons 19 and 20.

The second annular floor portion 214 carries a similar pair of diametrically aligned pistons 219 and 220 shown in FIG. 16. Only one of the pistons 219 can be seen in FIG. 5. The pistons carried by the second annular floor portion 214 are configured to overlie the first annular floor portion 14 to divide the toroidal chamber 105 into various sections. The pistons 219 and 220 therefore rotate with the second annular floor portion 214, while the first annular floor portion 14 simply slides underneath the pistons 219 and 220.

Because the inner shaft 3 and the outer shaft 203 are capable of rotating independently of each other, the pistons 19 and 20 carried by the first annular floor portion 14 and the pistons 219 and 220 carried by the second annular floor portion 214 are capable of speeding up or slowing down relative to each other. Thus, between any one piston carried by the first annular floor portion 14 and any one piston carried by the second annular floor portion 214, a combustion chamber is formed. As seen in FIG. 16, a first combustion chamber A is formed between pistons 219 and 19 a second combustion chamber B is formed between pistons 19 and 220, a third combustion chamber C is formed between pistons 220 and 20, and a fourth combustion chamber is formed between pistons 20 and 219.

Because the pistons 19 and 20 of the first annular floor portion 14 can move independently of the of the pistons 219 and 220 of the second annular floor portion 214, the four phases of combustion, i.e. combustion, exhaust, air input, and fuel input and compression, are free to take place in each of the combustion chamber. However, in each of the combustion chambers, a different phase is taking place. In combustion chamber A, the gases contained therein will undergo combustion and rapid expansion driving piston 219 and piston 220 in a countercockwise direction. In combustion chamber D, the gases contained therein have already undergone expansion and are, at this point, being exhausted from the engine. Combustion chamber C is about to undergo intake of fresh air in preparation for the compression phase of the cycle. In combustion chamber B, the gases are undergoing compression in anticipation of fuel injection and then combustion. In this manner, within each of the combustion chambers A, D, C, and B, one of the phases of combustion, exhaust, air input, and compression is occuring. Each of the combustion chambers A, B, C, and D sequentially undergoes each of these phases as the combustion chambers move within the annular chamber 105 defined by the casing 103 and the annular floor portions 14 and 214.

The rotary engine of the present invention is constructed such that when combustion occurs, either a piston 19 or 20 carried by the first annular floor portion 14 or a piston 219 or 220 carried by the second annular floor portion 214 is driven. Although the operation of the present invention will be described in greater detail hereinbelow, it is sufficient at this time to understand that the pistons, annular floor portions 14 and 214, and inner and outer shafts 3 and 203, respectively, are alternately driven at fast and slow speeds as each piston takes a turn being driven by the combustion occuring within the engine.

Those of ordinary skill in the art will recognize that the inner and outer shafts defined above are not the only embodiment which can be used to carry two pairs of diametrically aligned pistons. Such pistons could also be carried by first and second coaxial shafts each extending through a portion of the cylindrical chamber. Alternately, rotating discs or the like could carry such pistons. Such alternative embodiments fall within the scope of this specification and the appended claims.

II. Annular Floor Portion Seals

Because the annular floor portions 14 and 214 are capable of independent movement while forming the floor of each of the combustion chambers, seals must be provided. In FIG. 14, the first annular floor portion 14 and the second annular floor—portion 214 are illustrated in detail. The annular floor portions 14 and 214 are not shown as being complete rings in order that the detail of their construction may be seen. However, the reader should note that the annular rings 14 and 214 do not contain openings as shown in FIG. 14.

The first annular ring 14 has a first circular recess 107 and a second circular recess 108 on opposite sides thereof. The second annular floor portion 214 has a first circular recess 109. The circular recess 108, although shown as being carried by the first annular floor portion 114, could alternatively be carried by the second annular floor portion 214.

The circular recesses 107, 108, and 109 are for carrying sealing members which are illustrated in detail in FIGS. 15, 15*a*, 15*b*, and 15*c*. Each of the annular recesses carries a seal made up of a spring member 111, a bearing member 112, and a sealing member 113. The sealing members 113 carried by the first annular floor portion 14 provide a seal between the first annular floor portion 14 and a portion of the engine casing 103 forming a wall of the chamber 105 and a seal with the second annular floor portion 214. The sealing member 113 carried by the second annular floor portio 214 provides a seal between the second annular floor portion 214 and that portion of the casing 103 forming a wall of the chamber 105. Because the first annular floor portion 14 moves relative move relative to the walls of the casing 103 forming the chamber 105, ball bearing members 112 have been provided to facilitate any motion required by the sealing members 113. As the sealing members 113 wear, spring members 111 will continually urge the sealing members 113 into engagement with the surfaces with which they are to provide seals. In this manner, an effective seal is provided between the first annular floor portion 14, the second annular floor portion 214, and the walls of the portion of the casing 103 forming the chamber 105.

III. Valves, Cams, Push Rods, and Rocker Arms

In order to effect internal combustion, the chamber 105 illustrated in FIGS. 6 and 16 must be provided with air and fuel, a spark to initiate combustion, and means for venting exhaust gases. Engine casing 103 is therefore provided with a plurality of openings at various angular positions with each opening controlled by a poppet valve or the like. In FIG. 2, a fuel input valve 22 for the inner shaft 3 is illustrated at the same angular position as a fuel input valve 222 for the outer shaft 203. Similarly, an air exhaust valve 23 for the inner shaft 3 is located at the same angular position as an air exhaust valve 223 for the outer shaft 203. An air intake valve 24 for the inner shaft 3 is located at the same angular position as an air intake valve 224 for the outer shaft 203. Exhaust air after combustion valves are also provided, one for the inner shaft 3, valve 25 shown in FIG. 16, and one (not shown) for the outer shaft 203. It should be noted that each of the valves 22, 23, 24, and 25 illustrated in FIG. 16 has a corresponding valve for the outer shaft 203 directly behind it which is why the valves for the outer shaft 203 are not visible in FIG. 16.

In order to effect ignition of the air/fuel mixture a spark plug 27 keyed to fire according to the angular position of the inner shaft 3 is provided. Similarly, a spark plug 227 keyed to fire according to the angular position of the outer shaft 203 is provided.

In order that the fuel input valve 22, air exhaust valve 23, air intake valve 24, and exhaust air after combustion valve 25 of the inner shaft 3 operate in a properly timed relationship, cams carried by the front end of the inner shaft 3 are provided. The cams are shown in detail in FIGS. 8, 8*a*, 8*b*, 8*c*, and 8*d*.

Returning now to FIG. 8, the front end of the inner shaft 3 having the various splined portions is illustrated. The splined portion 10 carries a controller connecting mechanism 29 having a first arm 30 and a second arm 31, the function of which will be described later. The splined portion 9 carries a fuel input cam 32. The splined portion 8 carries an exhaust air cam 33. The splined portion 7 carries an exhaust air after combustion splined portion 6 carries an air intake cam 34. The cam 35. The splined portion 5 carries a power transfer gear 37. The profiles of the cams 32–35, as well as the profile of the power transfer gear 37, are illustrated in FIGS. 8*a*–8*e*, respectively. The general relationship between the cams 32–35 and the power transfer gear 37 and the remainder of the engine 1 may be seen in FIGS. 5 and 6.

The surface of each of the cams 32–35 is responsible for opening and closing, in a precisely timed relationship, the correspondingly named valve. Thus, the fuel input cam 32 controls the fuel input valve 22, the air exhaust cam 33 controls the air exhaust valve 23, the air intake cam 34 controls the air intake valve 24, and the air exhaust after combustion cam 35 controls the air exhaust after combustion valve 25.

Figure 9:
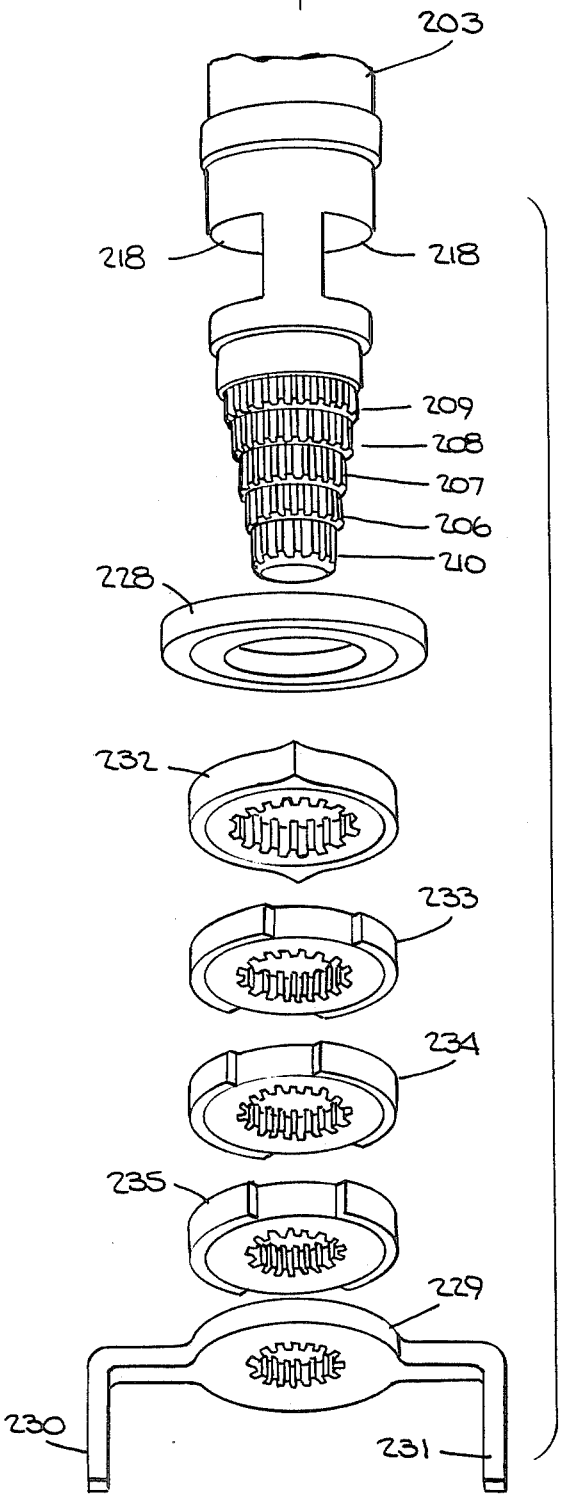
FIG. 9 is an exploded perspective view of the front end of the outer shaft illustrating the cams and the other controller connecting mecahnism.
Figure 9A:
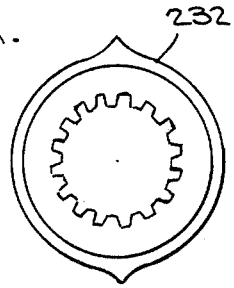
FIGS. 9*a*–9*d* are plan views of the gas intake cam, exhaust air cam, air intake cam, and exhaust air after combustion cam, respectively.
Figure 9B:
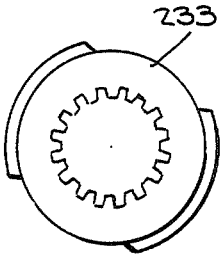
Figure 9C:
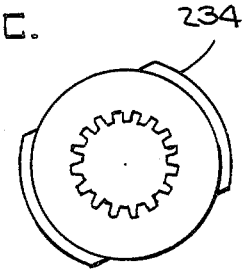
Figure 9D:
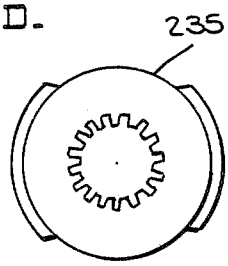

In a like fashion the front end of the outer shaft 203 also carries a plurality of cams. As shown in FIG. 9, a first main bearing is carried by the outer shaft 203. The splined portion 209 carries fuel intake cam 232, splined portion 208 carries air exhaust cam 233, splined portion 207 carries air intake cam 234, splined portion 206 carries air exhaust after combustion cam 235, and splined portion 210 carries a controller connecting mechanism 229 having a first arm 230 and a second arm 231. The profiles of the cams 232–235 are illustrated in FIGS. 9*a*–9*d*. Each of the cams 232–235 has a surface responsible for opening and closing a correspondingly named valve in a precisely timed relationship. Thus, fuel input cam 232 controls fuel input valve 222, air exhaust cam 233 controls air exhaust valve 223, air intake cam 234 controls air intake valve 224, and air exhaust after combustion cam 235 controls the air exhaust after combustion valve. The position of the cams 232–235 relative to the other portions of the rotary engine 1 can be clearly seen in FIGS. 5 and 6.

Figure 7:
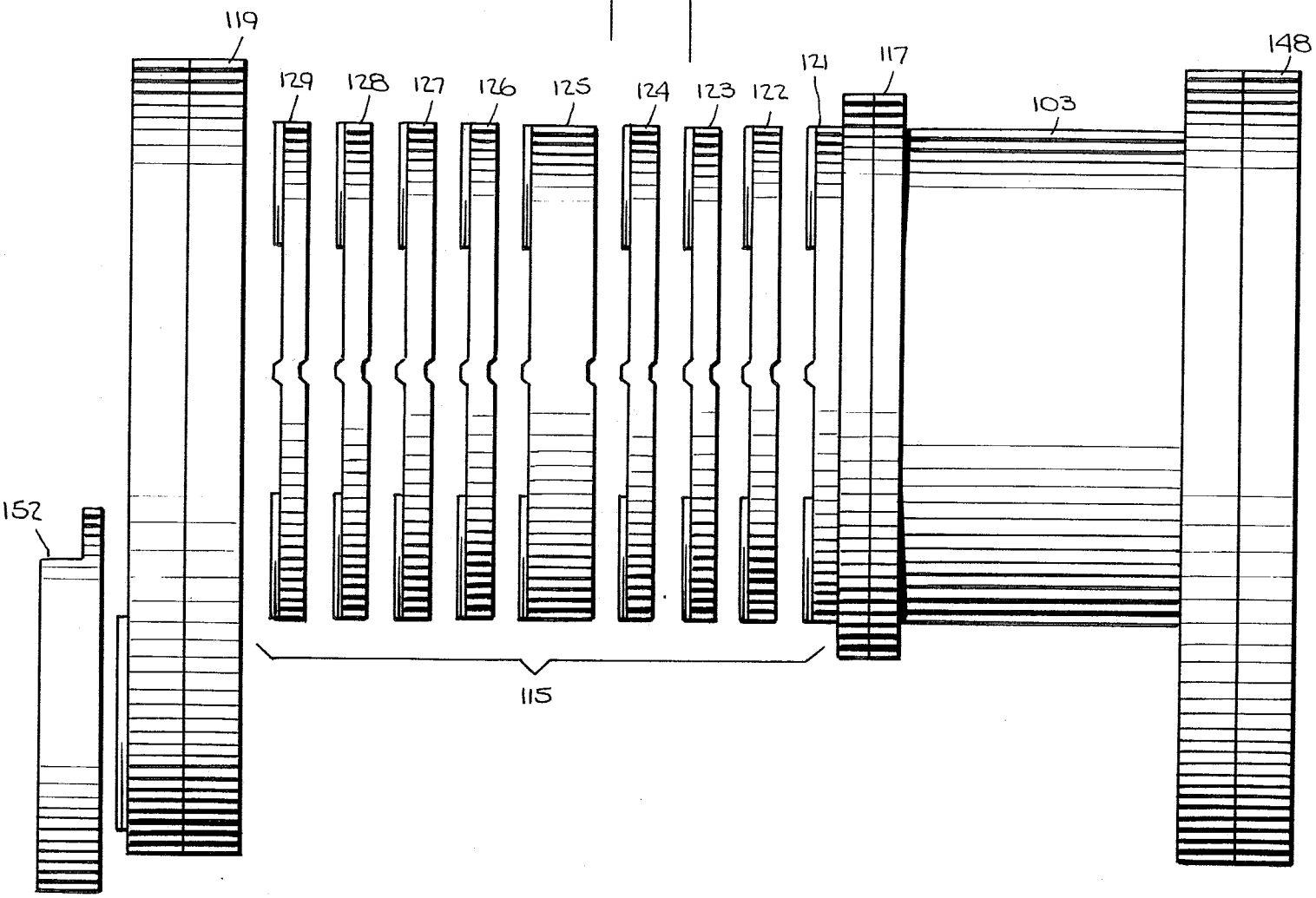
FIG. 7 illustrates the engine casing surrounding the cam blocks.

Those portions of the inner shaft 3 and outer shaft 203 extending between cam 35 and cam 232 lie within a portion of the engine casing generally designated 115 in FIGS. 1 and 2. That portion of the engine casing 115 may be, in fact, comprised of a plurality of sections keyed and bolted together as illustrated in FIGS. 6 and 7.

The portion of the casing 115 enclosing the cams is located between a first casing member 117, which separates the cam casing 115 from the casing 103 defining the cylindrical chamber, and a second casing member 119 which encloses the first power transfer gear 37. The casing 115 may be comprised of nine individual annular members, 121–129, each keyed such that when they are bolted together they form a rigid unit. The members 121–124 house the cams 232–235 of the outer shaft 203, respectively. The member 125 houses a controller, to be disclosed in detail below, while the members 126–129 house the cams 32–35, respectively, carried by the inner shaft 3.

The members 121–124 and 126–129 are each provided with an opening therethrough to enable a push rod to come into contact with each of the cams 32–35 and 232–235. In FIG. 6, four such openings are illustrated, an opening 39 in member 129, an opening 42 in member 128, an opening 239 in member 124, and an opening 242 in member 123. Athough not shown, the members 121, 122, 126, and 127 also have openings in which a push rod is positioned.

A push rod 40 cooperates with a rocker arms 41 for opening and closing the valve 25. A push rod 43 cooperates with a rocker arm 44 for opening and closing the valve 24. In a similar manner, a push rod 240 cooperates with a rocker arm 241 for opening and closing the valve 225, while a push rod 243 cooperates with a rocker arm 244 for opening and closing the valve 224. In this manner, each of the push rods acts as a cam follower closely following the surface of its respective cam. Because the cams 32–35 rotate with the inner shaft 3 and the cams 232–235 rotate with the outer shaft 203, the angular position of the inner and outer shafts precisely controls the opening and closing of the various valves.

The cam and valve arrangement of the present invention represents a substantial advantage over the prior art. Because the cams must rotate together with their respective shaft, the angular position of the cams and hence the opening and closing of the valves is simply and precisely timed with the movement of the pistons. Thus, air and fuel are added to the combustion chamber and exhaust gases are vented in a precise manner using a simple design and a minimum of moving parts. Further, because each of the casing sections 121–124 and 126–129 carries only one opening for one push rod, the opening, and hence the push rod, can be recisely located. By precisely locating the push rods, stress as well as wear are reduced thereby enabling the present invention to achieve the desired goals of low maintenance and reliability.

The remainder of the valves illustrated in FIGS. 1 and 2 are similarly connected to appropriate push rods by rocker arms. The fuel input valve 22 is connected via a rocker arm 46 to a push rod 47. The fuel input valve 222 is connected via a rocker arm 246 to a push rod 247. The air exhaust valve 23 is connected by a rocker arm 50 to a push rod 51. The air exhaust valve 223 is connected via rocker arm 250 to a push rod 251.

Figure 35A:
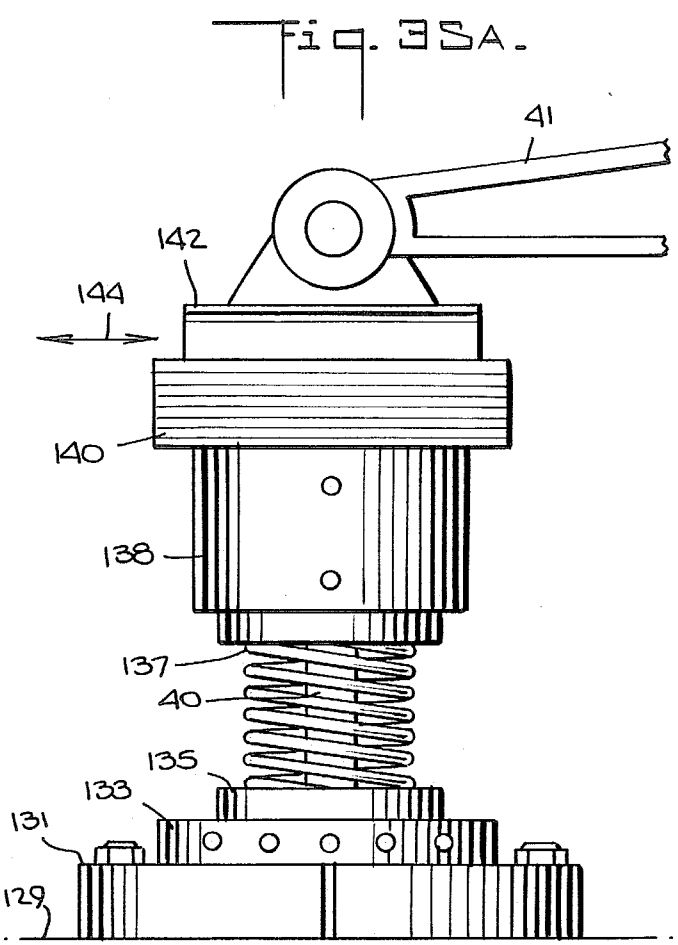
FIGS. 35 and 35*a* illustrate the connection of the cam push rod to the engine casing and the rocker arm.
Figure 35:
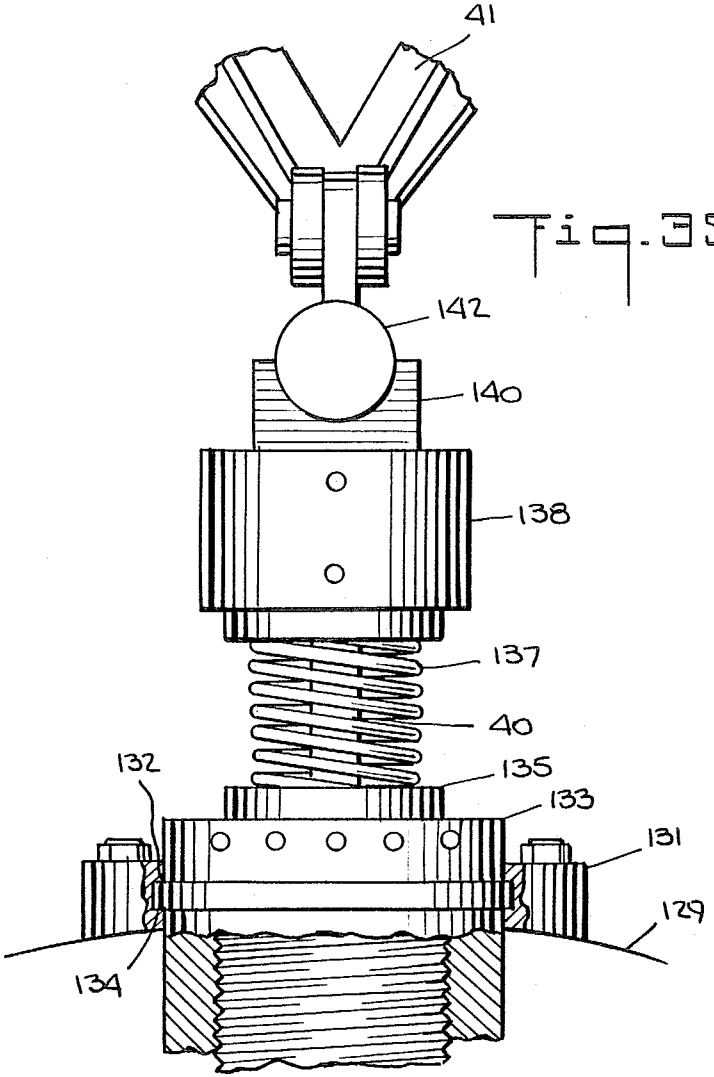

The connection of the cam push rod 40 to the engine casing 129 and to the rocker arm 41 is illustrated in FIGS. 35 and 35*a*. It should be recognized that the connection of each of the cam push rods to the casing as well as its respective rocker arm are similar.

In FIG. 35, a mounting member 131 has a circular recess 132 on the inside portion for mating with a circular protrusion 134 extending from a rotatable member 133. the member 131 is comprised of two c-sections rigidly attached to the casing section 129, while the rotatable member 133 is free to rotate within the mounting member 131. The rotatable member 133 carries internal threads which mate with external threads carried by a movable member 135. When the rotatable member 133 is rotated, the internal threads mate with the external threads on the movable member 135 thereby causing the movable member 135 to move up or down, depending upon the direction of the rotation of the rotatable member 133. When the movable member 135 moves up or down, it compresses or releases a spring member 137 which in turn exerts a greater or lesser force on a block member 138. Block member 138 carries the push rod 40. Thus, if the block member 138 is urged upward, the push rod 40 also moves upward. The opposite end of push rod 40 carries a roller according to a known configuration which follows the surface of cam 35. Thus, the tension between the push rod 40 and the surface of the cam 35 can be simply and effectively adjusted by rotation of the rotatable member 133.

The block member 138 carries a grooved member 140 having a groove on its upper surface. The groove of the member 140 is adapted to receive a cylindrical member 142 carried by the rocker arm 41. In this manner, the grooved member 140 and cylindrical member 142 provide a sliding joint whereby when the push rod 40 moves up and down, the rocker arm 41 is permitted lateral movement in the direction indicated by the arrow 144 such that no stress is applied to either the rocker arm 41 or the push rod 40.

IV. Drive Shaft and Power Transfer Gears

Figure 11:
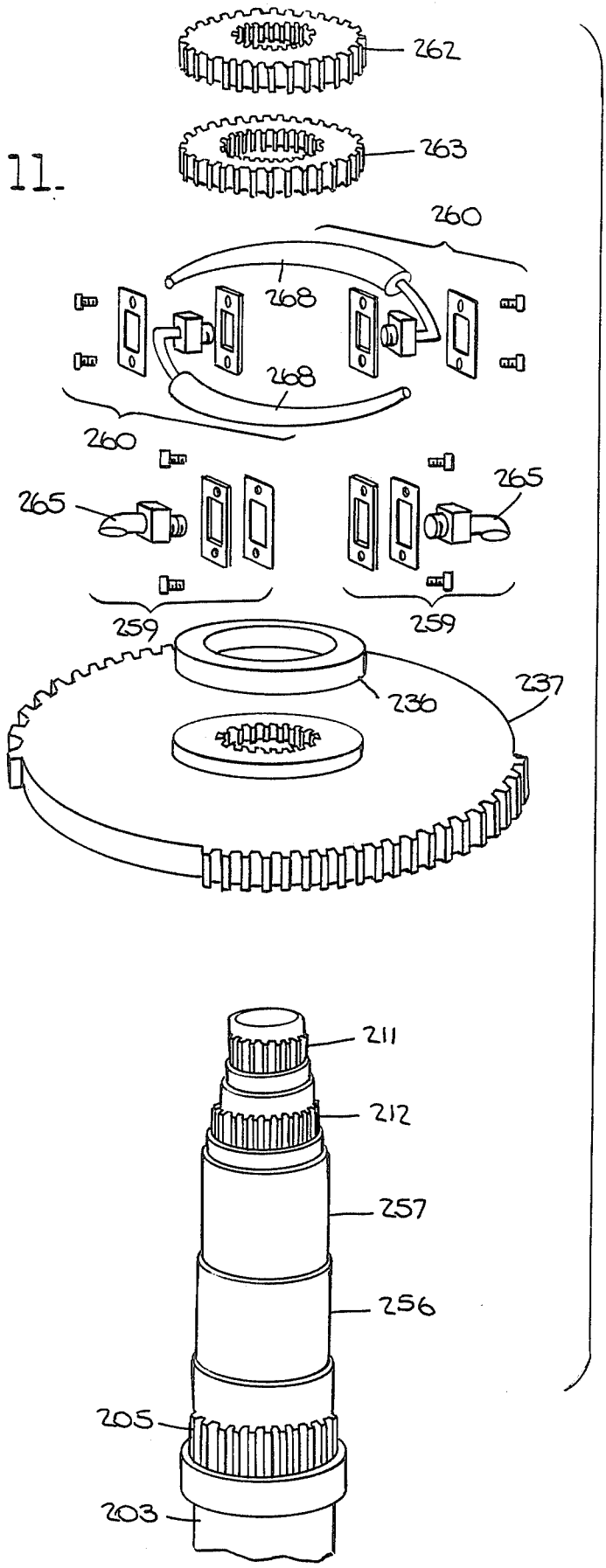
FIG. 11 is an exploded perspective view of the rear end of the outer shaft illustrating the transfer gear, two oiling devices, and two gears.

As mentioned above, the inner shaft 3 carries a power transfer gear 37 on its front end via splined portion 5. The outer shaft 203 also carries a power transfer gear 237. In FIG. 11, the rear end of the outer shaft 203 is illustrated. The outer shaft carries a second main bearing. The power transfer gear 237 is carried by splined portion 205. The outer shaft carries a second main bearing. The relationship of the second main bearing 236 and power transfer gear 237 with respect to the other components of the rotary engine 1 is clearly illustrated in FIG. 5. The power transfer gear 237 is contained within a section of the engine casing 148 as seen in FIGS. 1 and 2.

Figure 8:
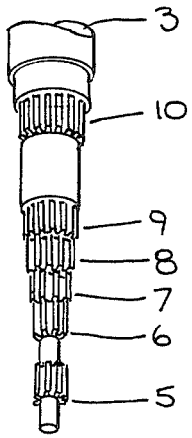
FIG. 8 is an exploded perspective view of the front end of the inner shaft illustrating one of the controller connecting mechanisms, the cams, and the transfer gear.
Figure 8:
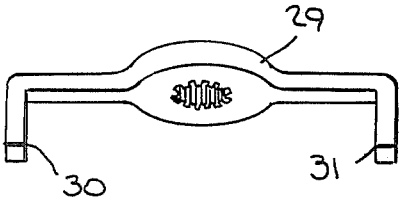
Figure 8:
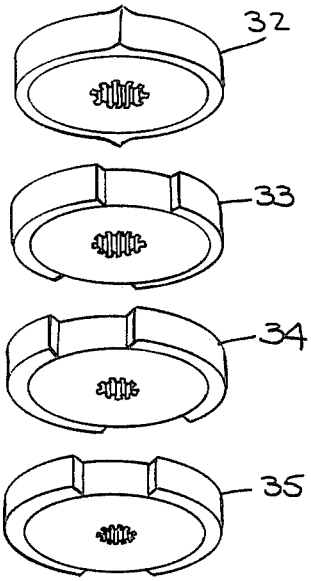
Figure 8:
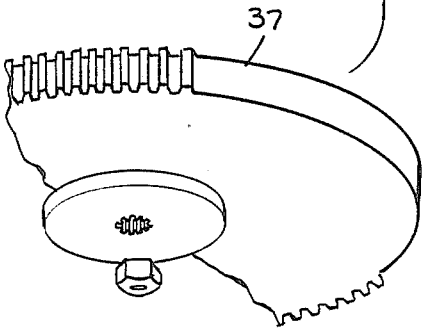
Figure 8A:
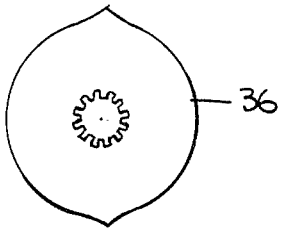
FIGS. 8*a*–8*e* are plan views of the gas intake cam, exhaust air cam, air intake cam, exhaust air after combustion cam, and transfer gear, respectively.
Figure 8B:
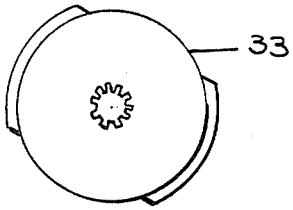
Figure 8C:
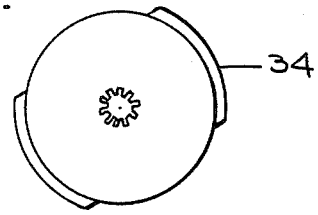
Figure 8D:
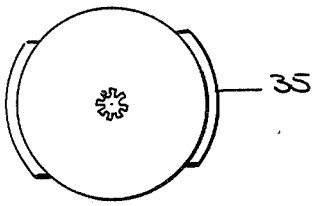
Figure 8E:
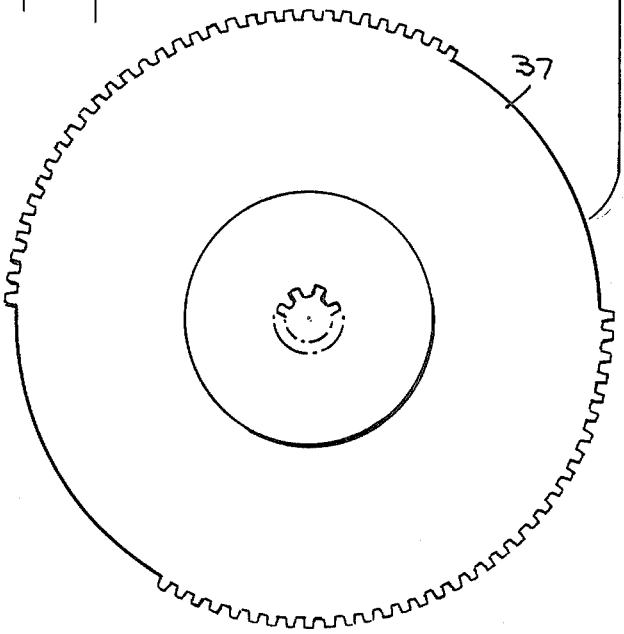

The rotary engine of the present invention also includes a main drive shaft 146 illustrated in FIGS. **4*b* and 5. As mentioned above, the inner shaft 3 and outer shaft 203 are alternately driven by the internal combustions occurring within the rotary engine. The power transfer gears 37 and 237 are constructed such that when the shaft to which the gear is connected is driven by an internal combustion, the developed power is smoothly and effectively transferred to the main drive shaft 146. This is accomplished by providing the transfer gears 27 and 237 with toothed and non-toothed portions as seen in FIGS. 8*e* and 11**.

When the outer shaft 203 is driven by the force of an internal combustion, the teeth of the power transfer gear 237 mesh with a gear 148, shown in FIG. 5, carried by the main drive shaft 146. During this time, the non-toothed portion of the power transfer gear 37 is opposite a gear 150 carried by the main drive shaft 146 as shown in FIG. 5. Thus, while the power transfer gear 237 is delivering power to the main drive shaft 146, the power transfer gear 37, although moving, does not contact the main drive shaft 146.

When the outer shaft is no longer driven by the force of an internal combustion, the inner drive shaft will then be driven by the force of an internal combustion. However, when this occurs, the toothed portion of the power transfer gear 37 meshes with the gear 150, while the non-toothed portion of the power transfer gear 237 is opposite gear 148. In this manner, power transfer gears 37 and 237 alternately couple the power produced by the internal combustions to the drive shaft 146.

When one of the shafts is being driven by the forces of an internal combustion, it is driven at a much faster rate than the non-driven shaft. Therefore, the toothed portions of each of the transfer gears cover a greater portion of the circumference of the transfer gears than the non-toothed portions. In one embodiment, the speed of the driven shaft is twice the speed of the non-driven shaft. Therefore, the toothed portions of the power transfer gears extend over a portion of the circumference which is twice as great as the portion of the circumference of the non-toothed portions of the transfer gears.

In order for the teeth of the transfer gear 37 to precisely mesh with the teeth of gear 150, and for the teeth of the transfer gear 237 to precisely mesh with the teeth of gear 148, a precise relationship between such teeth must be maintained. Considering the transfer gear illustrated in FIG. **8*e*, each toothed portion contains forty teeth and extends over 2/6ths of the circumference of the transfer gear. Each non-toothed portion extends over only 1/6th of the circumference of the transfer gear. However, while the non-toothed portion of the transfer gear 37 is adjacent the gear 150, drive shaft 146 continues moving at twice the speed of transfer gear 37 because the drive shaft 146 is now being driven by the power transfer gear 237. Thus, although each of the non-toothed portions extends over only 1/6th of the circumference of the transfer gear 37, it appears to the main drive shaft 146 to actually extend over 2/6ths of the circumference of the transfer gear 37. Thus, it appears to the main drive shaft 46 as if there are forty teeth in this non-toothed portion of the power transfer gear 37**. These apparent teeth are referred to as imaginary teeth.

Considering the power transfer gear 37 illustrated in FIG. **8*e*, the transfer gear has forty real teeth in each toothed portion and forty imaginary teeth in each non-toothed portion, for a total of 160 teeth. If the gear 150 has sixteen teeth, a ratio of 10:1 is provided. That is, for every one complete revolution of the transfer gear 237, the main drive shaft will make ten revolutions. The other power transfer gear 237 is constructed in exactly the same manner as the power transfer gear 37. Thus, for each revolution of the power transfer gear 237**, the main drive shaft produces ten revolutions.

As will be described in detail hereinbelow in conjunction with the description of the operation of the present invention, for each revolution of the power transfer gears 37 and 237, four combustions take place. Because of the simplicity of the power transfer gears 37 and 237, the number of combustions necessary to maintain a minimum level of rpm's can be simply and easily manipulated. For example, assume that a level of 1,000 rpm's is to be maintained. Using the power transfer gears illustrated in FIGS. **8*e* and 11, together with the gears 150 and 148 illustrated in FIG. 5, we know that for each revolution of the power transfer gears, the main drive shaft 146** makes ten revolutions. We also know that for each revolution of the power transfer gears, four combustions take place. Therefore, 100 revolutions of the power transfer gears and 400 combustions must take place in order to maintain a level of 1,000 rpm's.

However, if the number of teeth on the gears 148 and 150 is changed from sixteen to ten, each revolution of the power transfer gear will result in sixteen revolutions of the main drive shaft 146. Under those circumstances, the power transfer gears need make only 62-½ revolutions, which can be performed as a result of 250 combustions. Therefore, the number of combustions can be reduced while maintaining the same level of output simply by changing the gear ratio. In this manner, any desired output level can be easily manipulated by proper selection of the relationship between the transfer gears 37 and 237 and the gears 150 and 148. This represents a substantial advantage over the prior art wherein such changes cannot be easily and effectively carried out.

The main drive shaft 146 is connected to a flywheel positioned within the engine casing in the area generally designated 152 in FIGS. 1, 2, and 6. The power transfer gears 37 and 237 therefore provide a simple and easy mechanism for smoothly coupling the developed power to the main drive shaft 146 and the flywheel of the automobile. This mechanism is extremely simple, yet effective. Because of its simplicity, the rotary engine of the present invention lends itself to mass production techniques, yet is extremely rugged and reliable.

It is anticipated that mechanisms other than power transfer gears 37 and 237 may be used. For example, a pulley belt configuration may be used wherein the belt responsive to the nondriven shaft is allowed to slip. Such alternative configurations are covered by this specification and the appended claims.

V. Controller

Figure 27:
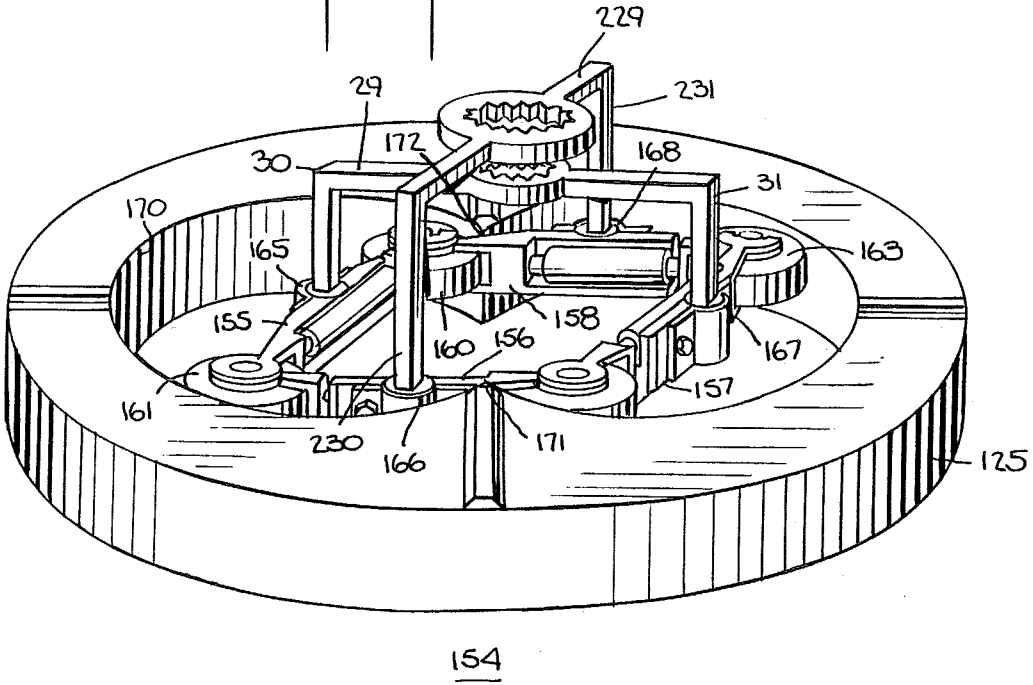
FIG. 27 is a perspective view of the controller.

The positions of the four pistons of the rotary engine 1 are precisely controlled by a controller mechanism 154 contained within the annular casing member 125 and illustrated in FIG. 27. The controller 154 is constructed of four arms 155, 156, 157, and 158 which are used to interconnect four rollers 160, 161, 162, and 163. The arms and rollers are interconnected such that roller 160 is connected to arms 155 and 158, roller 161 is connected to arms 150 and 156, roller 162 is connected to arms 156 and 157, and roller 163 is connected to arms 157 and 158. Thus, the arms 155–158 form a four-sided geometric figure with a roller at each of the corners.

Each of the arms carries a protruding portion for ultimately connecting the arm to either the inner or the outer shaft. Arm 155 carries protruding portion 165, arm 156 carries protruding portion 166, arm 157 carries protruding portion 167, and arm 158 carries protruding portion 168. Each of the protruding portions cooperates with its respective arm to form an opening. The openings formed by the protruding portion 165 and arm 155 and protruding portion 167 and arm 157 receive in a rotational relationship the two forwardly projecting arms 30 and 31, respectively, of the controller connecting mechanism 29. In this manner, the arms 155 and 157 are connected to the inner shaft 3.

The openings formed by the protruding portion 166 and arm 156 and protruding portion 168 and arm 158 receive in a rotational relationship the two forwardly projecting arms 230 and 231, respectively, of the controller connecting mechanism 229. In this manner, the second arm 156 and fourth arm 158 are connected to the outer shaft 203.

Figure 28:
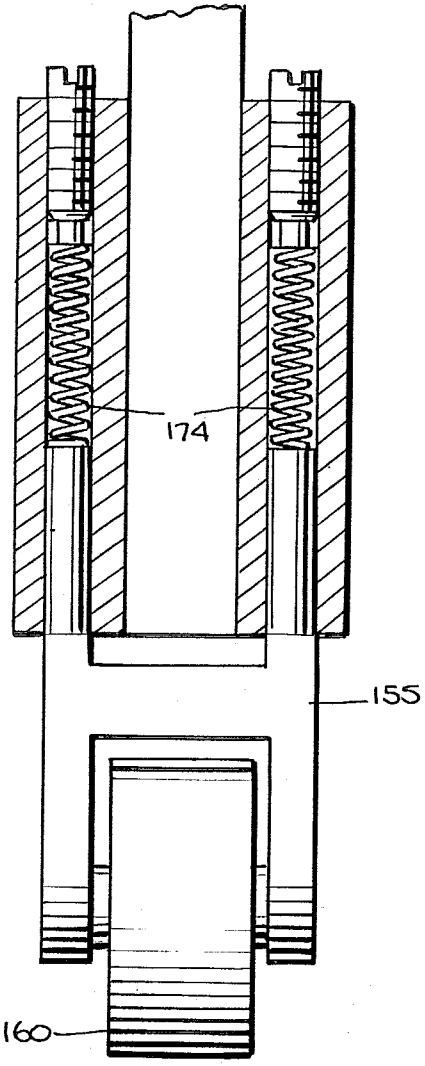
FIGS. 28 and 29 illustrate a controller arm carrying a roller.
Figure 29:
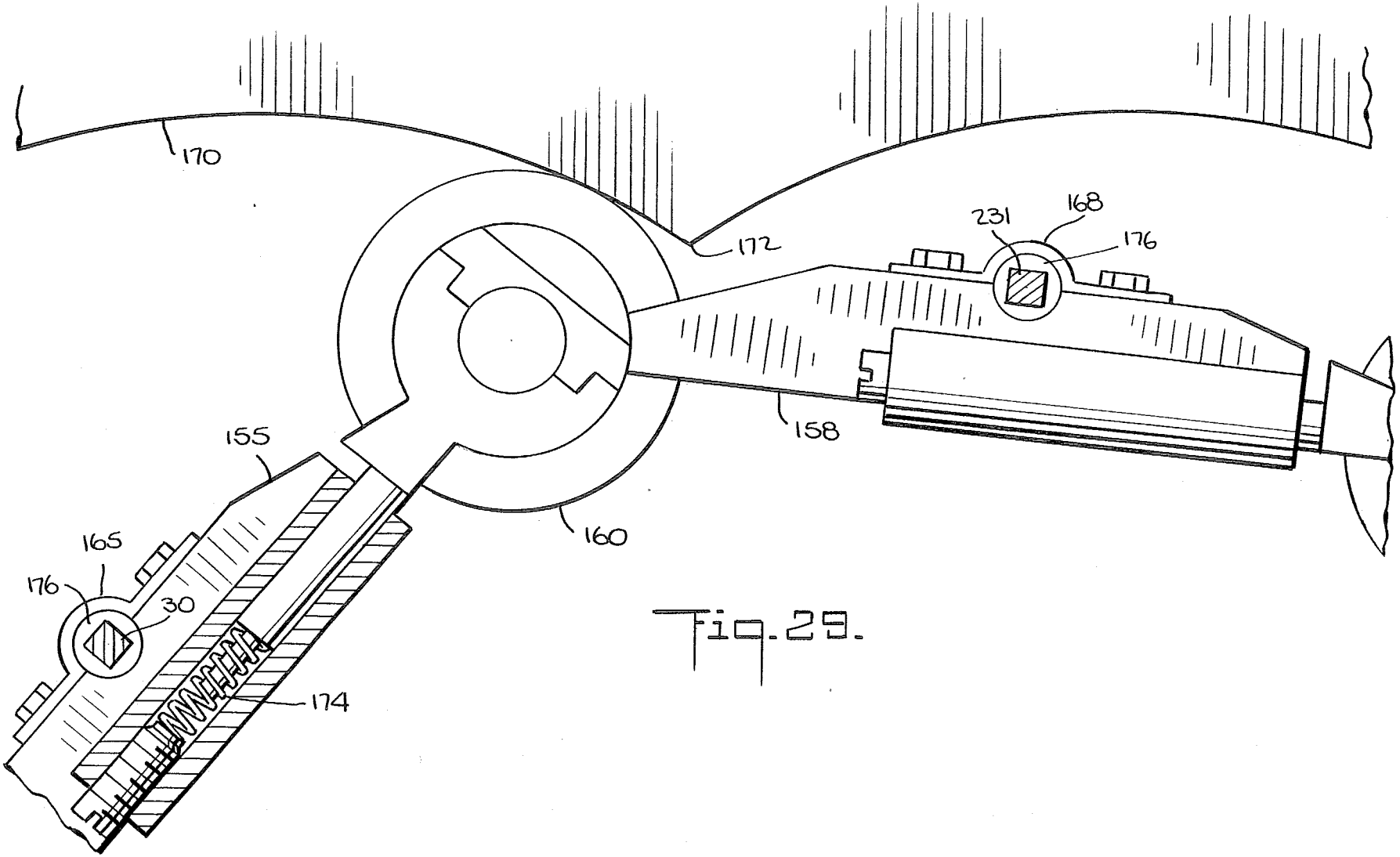

Turning now to FIGS. 28 and 29, additional details of the arms 155 and 158 together with the roller 160 are illustrated. As seen in FIG. 28, the arm 155 carries springs 174 for urging the roller 160 against the cam surface 170. One of the springs 174 is clearly seen in FIG. 29 urging the roller 160 against the cam surface 170. Also clearly seen in FIG. 29 are the protruding members 165 and 168. The opening formed by the protruding member 165 and arm 155 receives arm 30 of the controller connecting member 29 illustrated in FIG. 8, while the opening formed by the protruding member 168 and arm 158 receives arm 231 of the controller connecting member 229 illustrated in FIG. 9. The openings are provided with bushings 176 or the like in order to provide a rotating type of connection between the forwardly projecting arms of the controller connecting members 29 and 229 and the arms 154–158.

It should be understood that the arm 158 carries similar springs 174 (not shown) for urging the roller 163 against the cam surface 170. Similarly, the other arms 156 and 157 are constructed in a like manner.

The purpose of the controller 154 is to precisely regulate the positions of the inner shaft 3 and outer shaft 203 and hence the positions of the first and second pairs of pistons. This is accomplished by providing a cam surface 170 on the inside of the controller 154 which is precisely defined. The cam surface has a configuration defined by two intersecting circles. The degree of intersection and hence the angle at point 171 and point 172 of the cam surface 170 is precisely defined. The degree of intersection of the two circles which define the cam surface 170 is such that a point on the circumference of one circle closest to the center of the other circle is displaced from the center of the other circle by a distance equal to the radius of the rollers 160–163. Constructing a cam surface according to this relationship insures that the controller mechanism 154 comprised of the arms 155–158 and rollers 160–163 will continue to travel in one direction, in our example, counterclockwise. This insures that the pistons will continue to travel in one direction, for example, counterclockwise, thus enabling the smooth production of power.

With the controller illustrated in FIG. 27, it is seen that the roller 160 has just passed the point 172 while the roller 162 has just passed the point 171. At this time, a combustion will occur. Because of the momentum of the engine, coupled with the configuration of the cam surface 170, it is easier for the rollers 160 and 162 to continue to roll in the counterclockwise direction. They will continue to roll in that direction until the roller 161 passes point 171 and the roller 163 passes point 172. When that occurs, another combustion will take place, but again, because of the momentum of the engine and the configuration of the cam surface 170, it is easier for the rollers 161 and 163 to continue in the counterclockwise direction of travel. Thus, in this manner, the controller 154 insures that the pistons will continue to travel in the proper direction.

The construction of the controller is such that when the inner shaft is driven, the controller connecting member 29 is capable of travelling at twice the speed of the controler connecting member 229. Conversely, when the outer shaft 203 is driven, the controller connecting member 229 is capable of travelling at twice the speed of the controller connecting member 29. It is because of this ability to allow one shaft to rotate faster than the other shaft that the controller 154 is able to precisely regulate the position of the pistons to enable compression, combustion, etc. to uniformly occur.

VI. Oiling System

The present invention provides a unique, simple, and effective system for providing oil to and removing oil from the engine. Returning to FIG. 1, the engine casing 101 may define four oil reservoirs 253, 254, 53, and 54. The oil reservoir 253 provides a reservoir of clean, cool oil which is to be pumped to the second pair of pistons 219 and 220 connected to the outer shaft 203. The oil reservoir 254 is for warm, dirty oil which has been removed from the pistons 219 and 220. The oil reservoir 53 is for clean, cool oil which is to be pumped to the first pair of pistons 19 and 20 connected to the inner shaft 3. The oil reservoir 54 is for warm, dirty oil which has been removed from the first pair of pistons 19 and 20.

Figure 12:
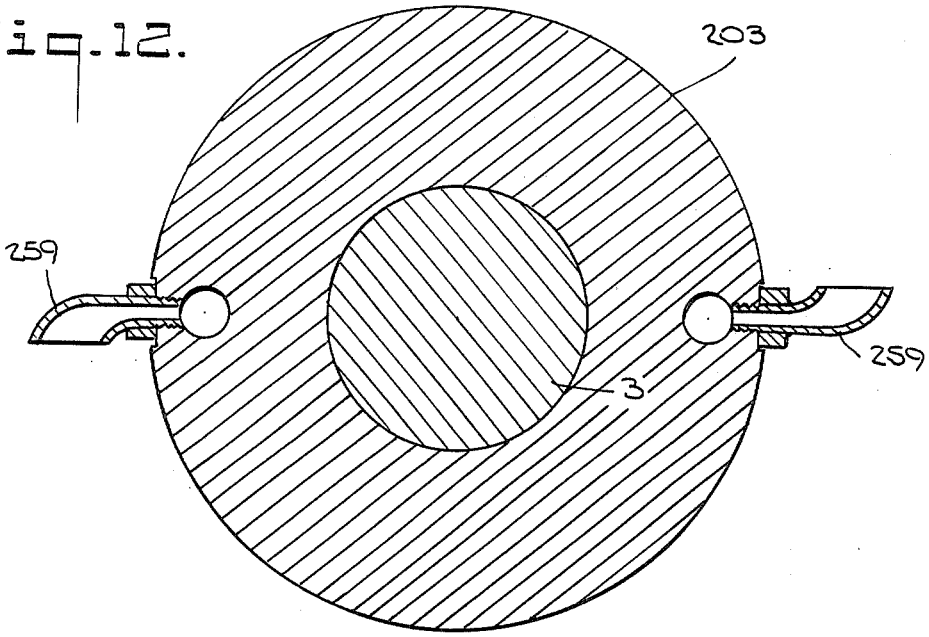
FIG. 12 illustrates a device for withdrawing oil from an oil reservoir.
Figure 13:
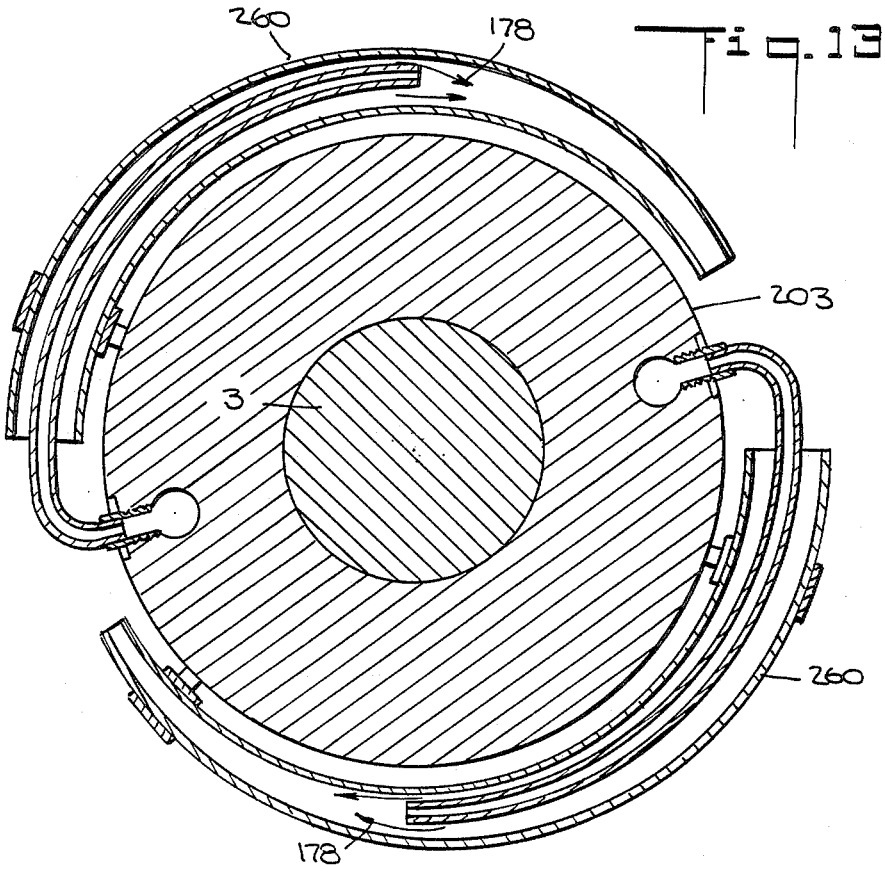
FIG. 13 illustrates a device for forcing oil into an oil reservoir.
Figures 15, 15A, 15B, 15C:
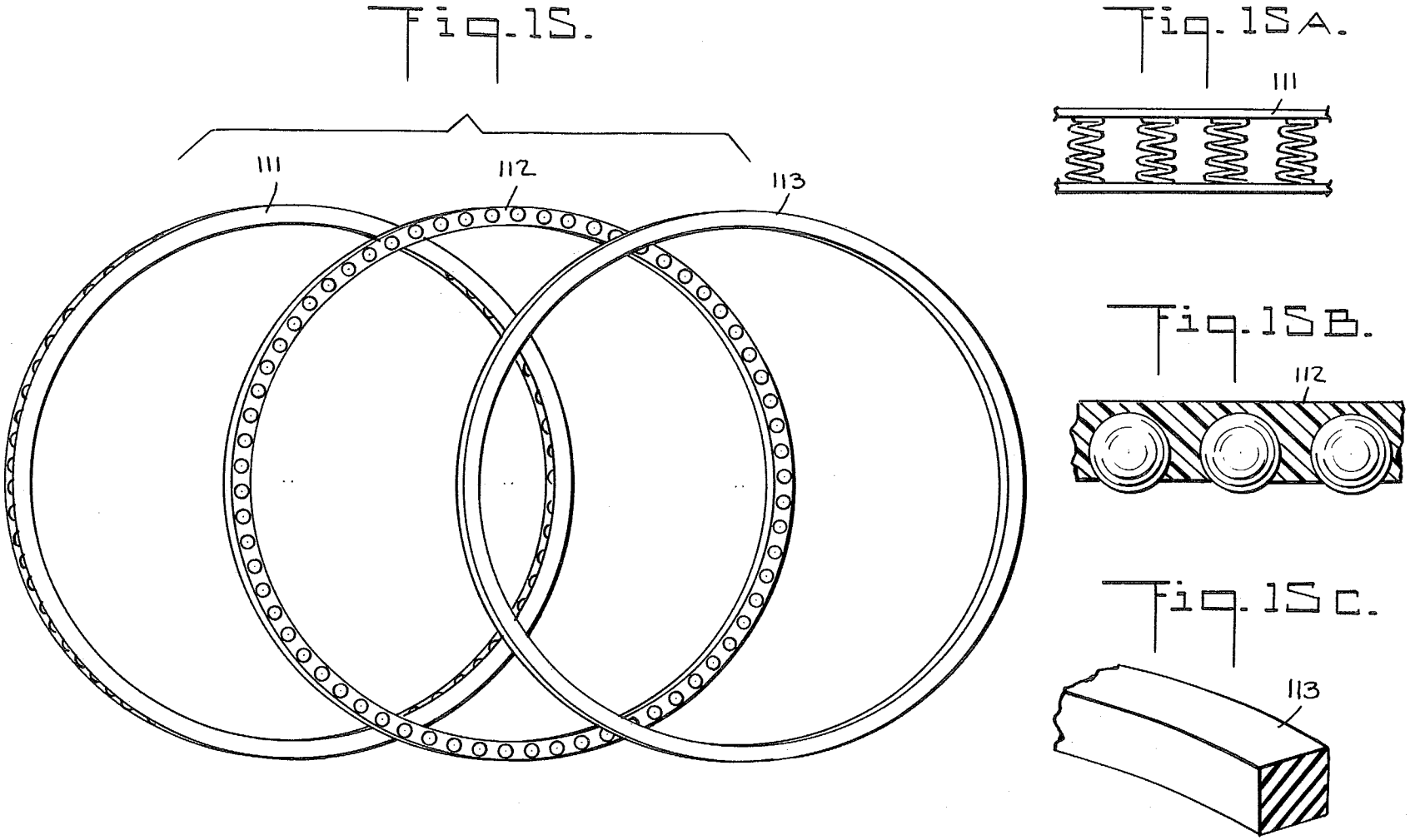
FIG. 15 is an exploded perspective view of one of the seals illustrated in FIG. 14*a;*
FIGS. 15*a*–15*c* are views of the three members comprising the seal illustrated in FIG. 15.

The outer shaft 203 carries two oiling devices 259 illustrated in FIG. 12 in the area generally designated 256 in FIG. 5. The outer shaft 203 also carries two oil withdrawal devices 260 illustrated in FIG. 13 in the area generally designated 257 in FIG. 5. Thus, the oiling devices 259 are positioned within the reservoir 253 while the oil withdrawal devices 260 are positioned within the oil reservoir 254.

The inner shaft also carries two oiling devices 59 on that portion of the inner shaft generally designated 56 illustrated in FIG. 5. The inner shaft 3 also carries two oil withdrawal devices 60 carried in that area of the inner shaft generally designated 57 in FIG. 5. The area 56 of the inner shaft 3 lies within oil reservoir 53 such that the oiling devices 59 are positioned within the reservoir 53. The area 57 of the inner shaft 3 lies within the oil reservoir 54 such that the oil withdrawal devices 60 are positioned within the oil reservoir 54. The general relationship between the oiling devices 259 and 59 and the oil withdrawal devices 260 and 60 and the remainder of the components of the Silvoza rotary engine is clearly illustrated in FIG. 5.

Figure 10:
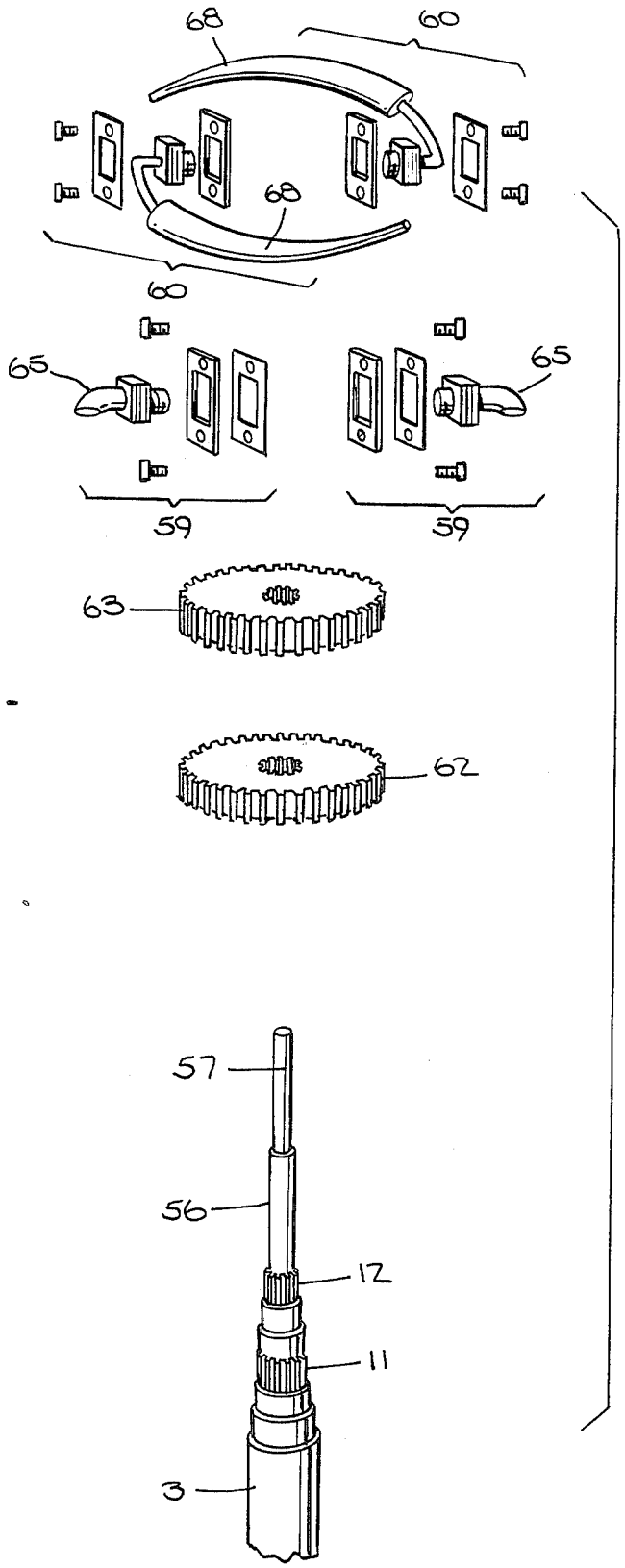
FIG. 10 is an exploded perspective view of the rear end of the inner shaft illustrating two gears and two oiling devices.

Turning now to FIG. 10, the rear end of the inner shaft 3 is illustrated. A splined portion 11 carries a gear 62 used in conjunction with a fuel injection pump described hereinbelow. A splined portion 12 carries a gear 63 used in conjunction with a distributor described hereinbelow. The area 56 of the inner shaft 3 carries the two oiling devices 59. Each of the oiling devices is comprised of an oil input tube 65 which is threaded into the inner shaft 3 to communicate with a first oil duct 66 illustrated in FIG. 4a. Appropriate gaskets and mounting screws may be proivded to effect a proper seal between the oil input tubes 65 and the first oil duct 66.

Figure 4A:
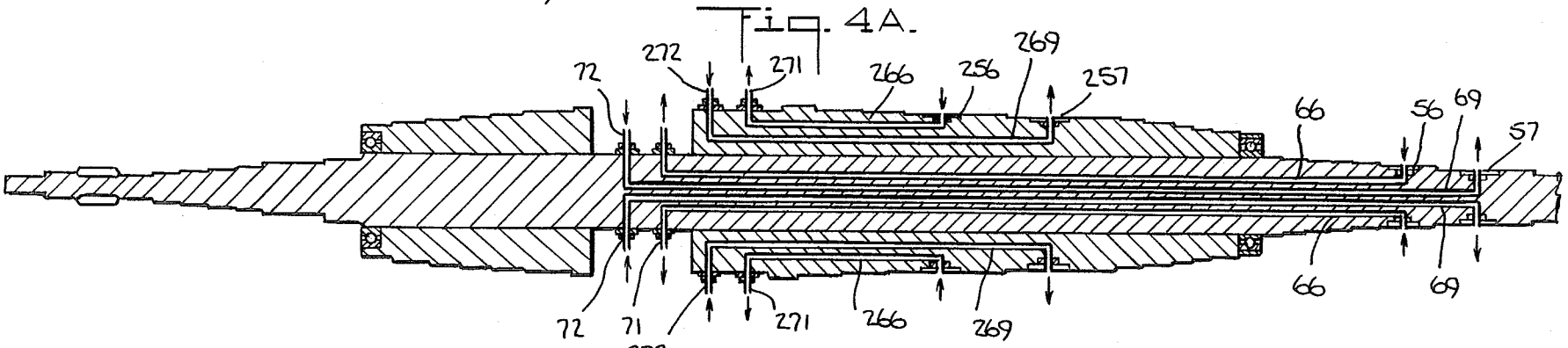
FIG. 4*a* illustrates the oil ducts in the inner and outer shafts.
Figure 4B:
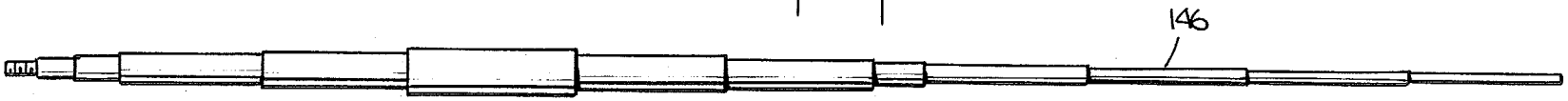
FIG. 4*b* illustrates the main drive shaft.

As seen in FIG. 10, oil withdrawal devices 60 are each constructed of a compound oil withdrawal tube 68 which is threaded into the inner shaft to communicate with a second oil duct 69 seen in FIG. 4a. The first ducts 66 are connected to a pair of input tubes 71, partially shown, which provide oil to the first pair of pistons 19 and 20 connected to the inner shaft 3. The second oil ducts 69 are connected to a pair of output tubes 72, partially shown, for withdrawing oil from the first pair of pistons 19 and 20. The flow of oil is thus from reservoir 53, through ducts 66 and input tubes 71 to the first pair of pistons 19 and 20. The oil then flows from the first pair of pistons 19 and 20 through output tubes 72, ducts 69, and into the reservoir 54.

The rear end of the outer shaft 203 is illustrated in FIG. 11. The splined portion 205 carries a transfer gear 237 as discussed above. The outer shaft 203 carries two oiling devices 259 each including an oil input tube 265. The oil input tubes 265 screws into threaded openings in the outer shaft 203 to communicate with third oil ducts 266 illustrated in FIG. 4a. The oiling devices 259 are similar in construction and operation to oiling devices 59.

The outer shaft 203 carries two oil withdrawal devices 260 each comprised of a compound oil withdrawal tube 268 which is threaded into the outer shaft 203 to communicate with a fourth oil duct 269 as shown in FIG. 4a. The oil withdrawal devices 269 are similar in construction and operation to oil withdrawal devices 69.

The outer shaft 203 has a splined portion 212 carrying a gear 263 used in conjunction with a distributor. The outer shaft 203 also has a splined portion 211 for carrying a gear 262 used in conjunction with a fuel injection pump. The distributor and fuel injection pump are described in detail hereinbelow.

Oil from the reservoir 253 is pumped by the oiling devices 259 through the third ducts 266 and through a pair of input tubes 271, which are partially shown in FIG. 4a, to the second pair of pistons 219 and 220 carried by the outer shaft 203. Oil is withdrawn from the second pair of pistons through a pair of output tubes 272, partially shown in FIG. 4a, through the fourth ducts 269 to the oil reservoir 254.

Figure 20:
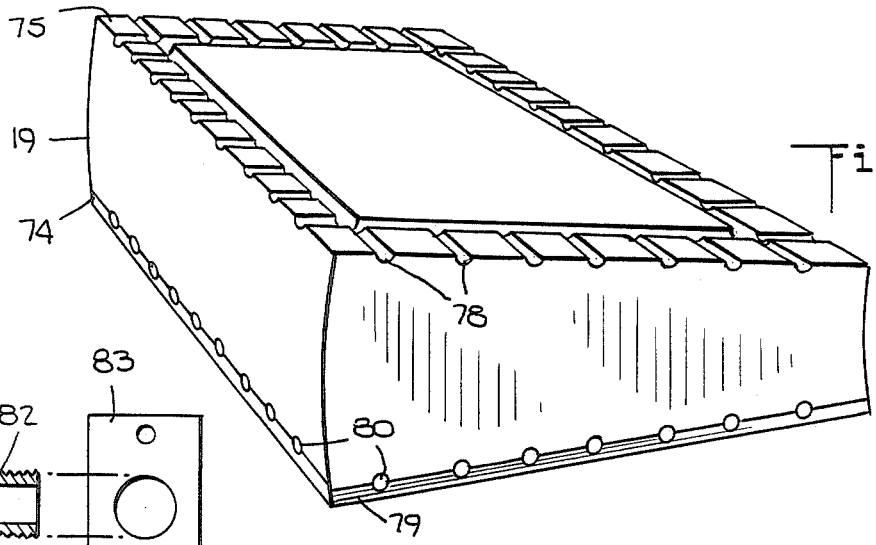
FIG. 20 is a perspective view of oil channels within a piston head

Each of the pistons of the first and second pairs of pistons may be constructed as shown generally in FIG. 20. In FIG. 20, the piston 19, one of the pistons of the first pair of pistons connected to the inner shaft 3, is shown. The reader should understand that each of the other pistons in constructed in a similar manner.

Figure 17:
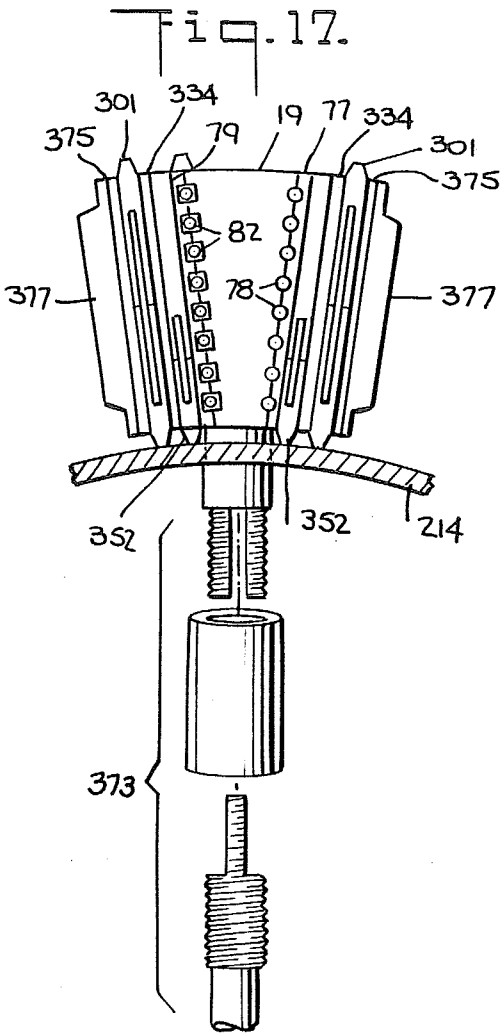
FIG. 17 is a side view of a piston assembly.
Figure 18:
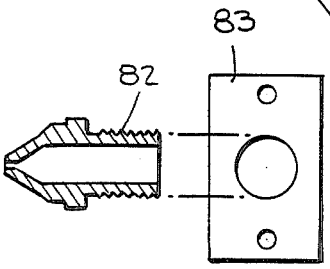
FIG. 18 illustrates an oiling nozzle and gasket.
Figure 19A:
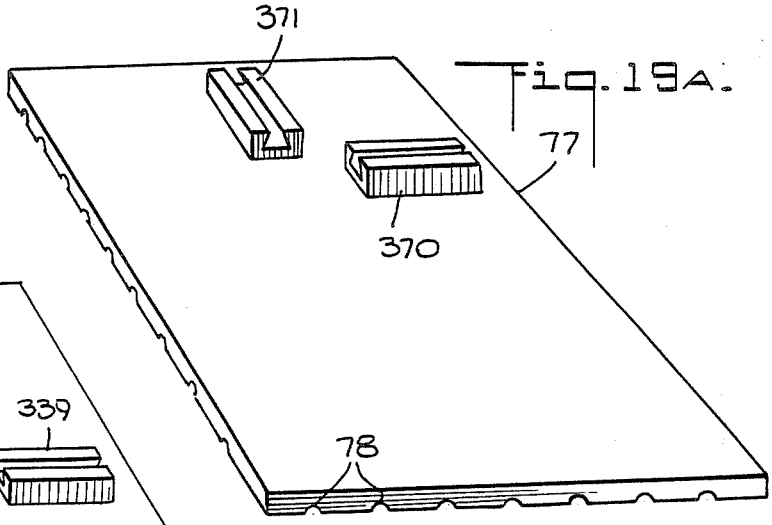

In FIG. 20, piston 19 has a leading face 74 and a trailing face 75. Each of the faces has a plurality of channels formed therein. A trailing face plate 77 shown in FIG. 17 has a plurality of channels formed therein which register with the channels of the trailing face 75 to form oil channels when the trailing face plate 77 is bolted thereto. The trailing face 75 and trailing face plate 77 cooperate to define a plurality of oil drain holes 78. The leading face 74 cooperates with a leading face plate 79 in a similar manner to that described to define a plurality of oiling holes 80. Each of the oiling holes 80 is fitted with a threaded nozzle 82 and a gasket 83 illustrated in FIG. 18. Thus, the piston 19 will have a profile as shown in FIG. 17. A plurality of oil nozzles 82 extend around the periphery of the leading face 74 of the piston, while a plurality of oil drain holes 78 extend around the periphery of the trailing face 75 of the piston 19.

Returning to FIGS. 12 and 13, when the engine is operative, the inner and outer shafts are both rotating. When the outer shaft 203 is rotating in a counterclockwise direction as seen in FIG. 12, oil is forced into oil input tubes 259. This oil travels through ducts 269 and tubes 271 to the second pair of pitons 219 and 220 carried by the outer shaft 203. The oil is then forced out the plurality of nozzles 82 which are located around the periphery of the leading face of the piston. Thus, the oil is available for lubrication and cooling as the body of the piston moves by.

The oil withdrawal device 13 is also rotating in a counterclockwise direction within the oil reservoir 254. The oil within the reservoir 254 flows through the compound tubes 260 in the direction generally indicated by the arrows 178. This flow causes a venturi effect at the opening of the inner tube of the compound tube 260. This venturi effect causes a powerful suction which withdraws oil through the oil drain holes 78 located around the periphery of the trailing face of the piston through the fourth ducts 269 into the oil reservoir 254.

In this manner, the first and second pairs of pistons are each provided with a separate and independent oiling mechanism. Rotation of the shafts causes a pumping action to force oil to the pistons to be sprayed therefrom to provide lubrication. Rotation of the shaft also creates a powerful suction which is capable of withdrawing oil from the pistons and returning it to an oil reservoir. Thus, the lubrication system of the present invention provides a simple method of lubricating the pistons with a minimum of moving parts. The parts which do move rotate in conjunction with either the inner or outer shaft. Thus, no independent moving parts are required. The lubrication of the present invention is extremely simple to construct and easy to maintain.

VII. Dual Cooling System

Returning now to FIG. 1, a lubrication system involving reservoirs 253, 254, 53, and 54 has just been described. The oil in reservoirs 254 and 54 has been removed from the second pair of pistons 219 and 220 and first pair of pistons 19 and 20, respectively. The oil in the reservoirs 254 and 54 is forced by a first pump 180 to a filtering and refrigeration unit 182. In the unit 182, the oil is filtered and cooled. The cool, clean oil is returned to reservoirs 253 and 53 through a second pump 184. In this manner, the oil can be recirculated through the engine. The flow of oil is generally indicated by the arrows 185.

It is anticipated that by cooling the oil, a significant amount of heat can be removed from the engine. It is further anticipated that a synthetic oil having good flow characteristics when cold may be used in conjunction with the Silovoza rotary engine 1.

In addition to the oil cooling system, a more traditional water cooling system may also be provided. The engine casing 103 is provided with a plurality of passages (not shown) for carrying cooling water. The cooling water is pumped from the casing 103 by a third pump 186. The water travels from the third pump 186 into a refrigeration unit 188 which cools the water. The cold water is pumped by a fourth pump 190 from the refrigeration unit back to the engine casing 103. The flow of water is generally indicated by the arrows 191. In this manner, not only is the lubrication system used for cooling the engine, but a more traditional water-cooled jacket is also provided.

Turning to FIG. 2, it is anticipated that the main drive shaft 146 may be provided with a plurality of pulleys 192. These pulleys may be provided with belts 194 for driving the pumps 180, 184, 186, 190, the refrigeration units 182, and 188, as well as any other required pumps or auxiliary equipment, such as an air conditioner.

VIII. Piston Seals

Figure 24:
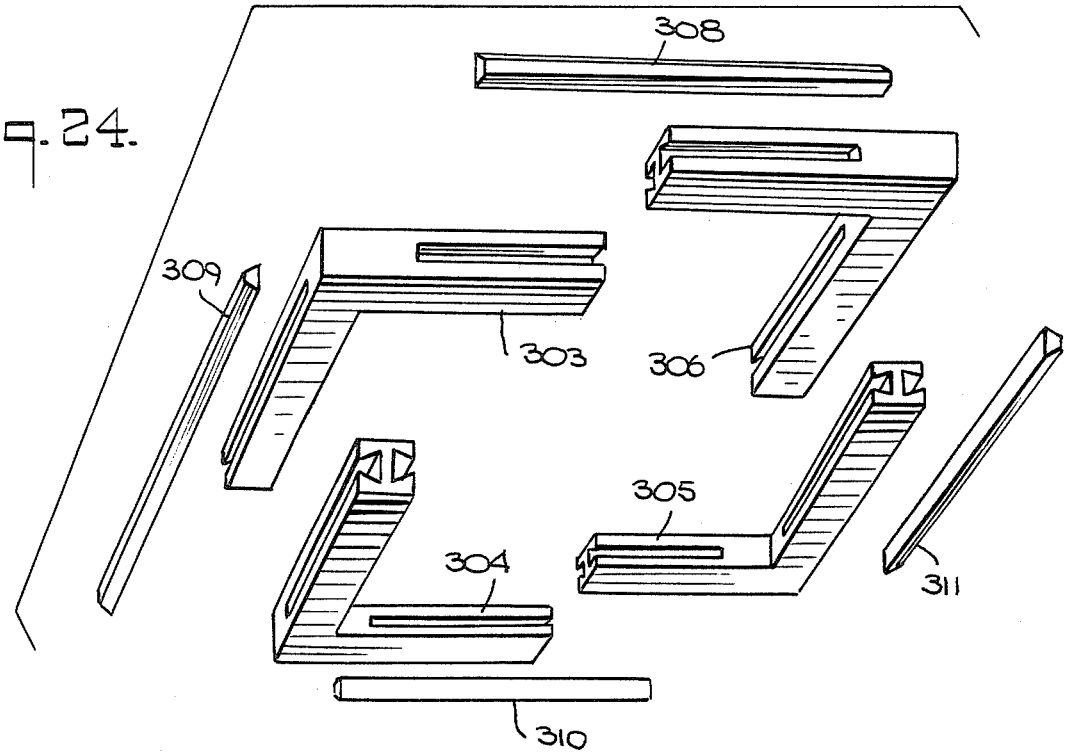
FIG. 24 is an exploded perspective view illustrating the members comprising the rectangular piston seal of FIG. 22.

The present invention includes a novel piston seal 301 seen best in FIG. 22. The piston seal is comprised of four L-shaped members 303, 304, 305, and 306 mortised on both the inside and the outside as shown in FIG. 24. The outside mortise of the members 303 and 306 carries a first bridge member 308. The outside mortise of the members 303 and 304 carries a second bridge member 309. The outside mortise of the members 304 and 305 carries a third bridge member 310. The outside mortise of the members 305 and 306 carries a fourth bridge member 307. The L-shaped members are fitted together to provide a rectangular seal as shown in FIG. 22 with the bridging members extending between adjacent L-shaped members.

The L-shaped members are grouped in pairs to provide a uniform seal face. Thus, members 303 and 306 cooperate to define a top seal face; members 303 and 304 cooperate to define a left seal face; members 304 and 305 cooperate to define a bottom seal face; members 305 and 306 cooperate to define a right seal face. Each of the pairs of members is biased such that each seal face is capable of moving independently of every other seal face. The means for biasing each of the seal faces is illustrated in FIG. 25.

Figure 25:
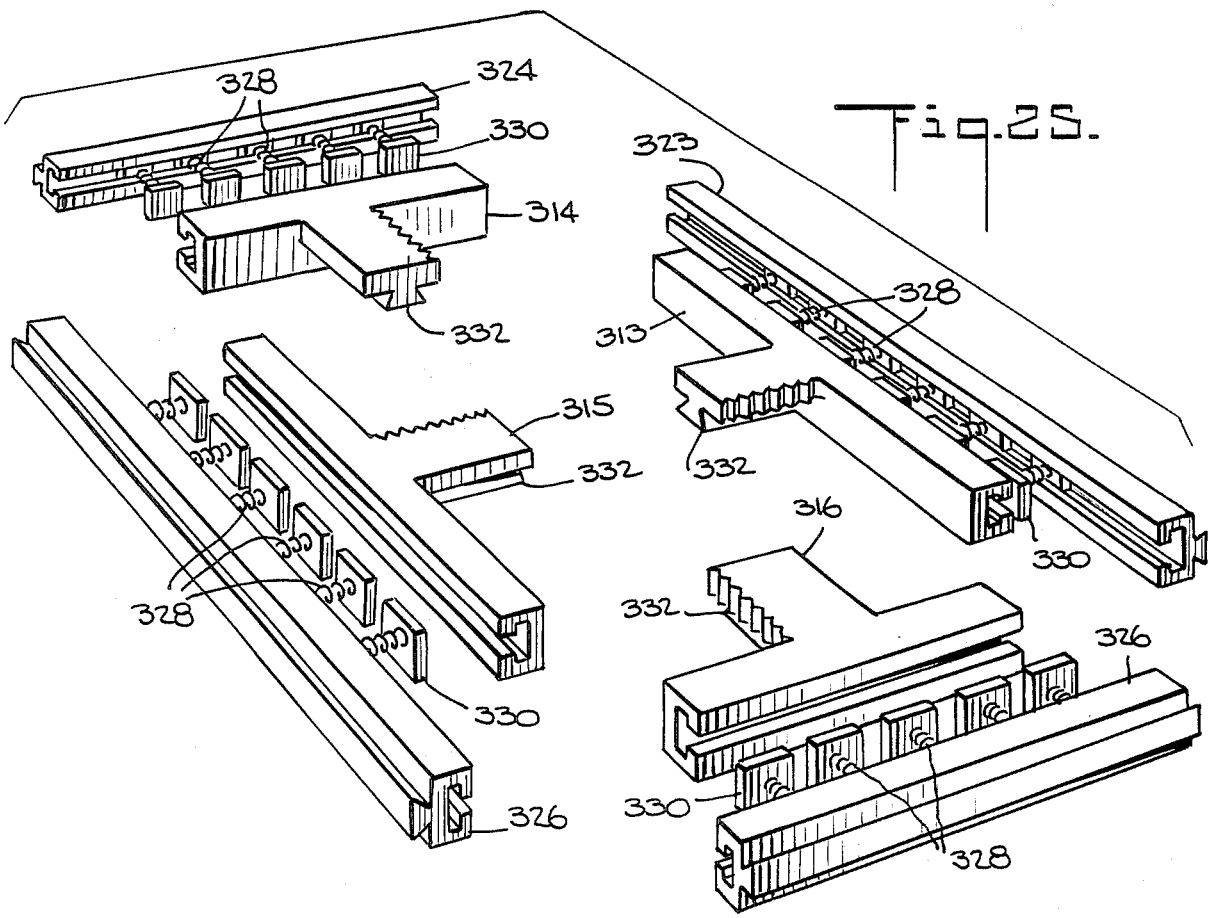
FIG. 25 is a perspective view illustrating the members used to bias the members illustrated in FIG. 24.

In FIG. 25 four tension adjustment members 313, 314, 315, and 316 are illustrated. Also illustrated in FIG. 25 are four connecting members 323, 324, 325, and 326. Each of the connecting members is mortised on one side and has a tenon on the opposite side. The mortised side carries a plurality of springs 328. The springs 328 may be capped on opposite ends with members 330 which may be positioned within the mortise of the tension adjustment members 313–316 as well as the mortise of the connecting members 323–326. In this manner, the tension adjustment members 313–316 are connected to the connecting members 323–326.

The tenon of each of the connecting members 323–326 fits in the inside mortise carried by each of the L-shaped members 303–306 as shown in FIG. 26.

Figure 21:
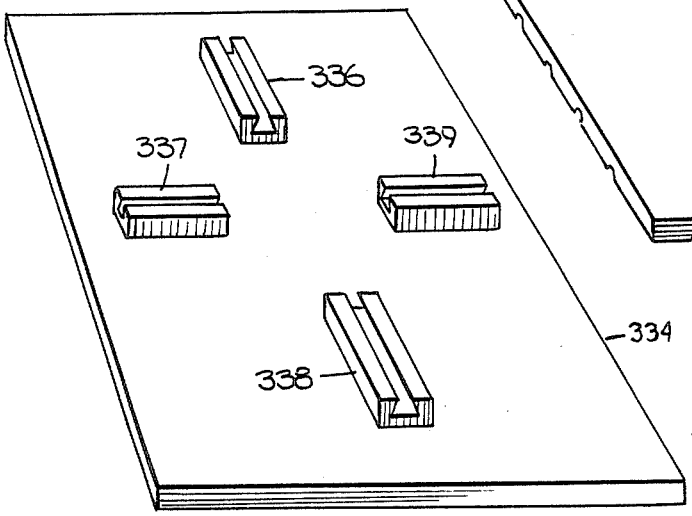
FIG. 21 illustrates a base plate carrying mortised seal supports.

Each of the tension adjustment members 313–316 has a tenon 332 extending therefrom. A base plate 334, illustrated in FIG. 21, carries four mortised support members 336, 337, 338, and 339. Each of the mortised support members 336–339 receives the tenon 332 of one of the tension adjustment members 313–316.

The seal 301 illustrated in FIG. 22 is also provided with four tension adjustment knobs 323, 344, 345, and 346. Each of the tension adjustment knobs 343 is provided with a plurality of teeth 348 which mesh with a plurality of teeth 350 carried by the tension adjustment members 313–316.

The operation of the piston seal 301 illustrated in FIG. 22 will now be described. In order to initially adjust the tension of the seal, knobs 343–346 are turned. By turning knob 343 in a clockwise direction, the tension adjustment member 313 moves upward. This causes the upper seal face comprised of L-shaped members 303 and 306 to be moved upward. This upward movement may cause an opening between L-shaped members 303 and 304 on the left side of the seal 301 and an opening between L-shaped members 305 and 306 on the right side of the seal 301. However, because of bridging members 309 and 311, respectively, the left and right seal faces are maintained despite the movement of the upper seal face. In a similar manner, tension adjustment knob 344 may be rotated clockwise, thereby urging the left seal face comprised of L-shaped member 303 and 304 to move towards the left. This may cause an opening between L-shaped members 303 and 306 on the top seal face and between L-shaped members 304 and 305 on the bottom seal face. However, because of bridging members 308 and 310, respectively, the top and bottom seal faces maintain their integrity despite movement of the left seal face.

It should be apparent to the reader that the construction of the piston seal 301 enables each of the seal faces to move independently of the other seal faces, while the seal provided by each seal face is maintained. It is anticipated that after initial adjustment of the tension adjustment members 313–316, sufficient energy can be stored in the springs 328 such that during actual operation, any wear of the seal face will be compensated for by the force of the springs. In this manner, as each seal face wears, the springs 328 will urge that seal face in the direction of wear independently of the other seal faces. The seal of the present invention represents a substantial advance over the prior art in that as the piston seals of the present invention wear, the seal will not be adversely affected. It is anticipated that various other members may be used which will effect the same functions of the members just discussed. The seal of the present invention is therefore not limited to the specific type, number, or configuration of the members discussed above.

The reader will recall that the pistons 19 and 20 are connected to the first annular floor portion 14 while the pistons 219 and 220 are connected to the second annular floor portion 214. Because of this, the bottom seal face illustrated in FIG. 22 is prevented from expanding in the direction of the floor portions 14 and 214. To compensate for this, auxiliary seals 352, illustrated in FIG. 23, are provided. The auxiliary seal is constructed in substantially the same manenr as the piston seal 301, except that wear in only one direction need be compensated for. The auxiliary piston seal 352 is constructed of a first L-shaped member 354 and two straight members 355 and 356. The L-shaped member 354 has an outer mortise cooperating with an outer mortise of the straight member 355 to carry a first bridge member 357. The outer mortise of the L-shaped member 354 cooperates with an outer mortise of the second straight member 356 to carry a second bridge member 358. The L-shaped member 354 and the straight member 355 cooperate to define a bottom seal face which operates in conjunction with a tension adjustment member 360, connecting member 361, springs 362, and tension adjustment knob 363, all constructed and functioning in the same manner as discussed above in conjunction with the piston seal 301. In a similar manner, the L-shaped member 354 cooperates with the straight member 356 to define a left seal face which operates in conjunction with a tension adjustment member 365, a connecting member 356, springs 367, and a tension adjustment knob 368, all constructed and functioning in the same manner as described above in conjunction with the piston seal 301.

The tension adjustment member 360 is carried by a mortised support member 370 which in turn is carried by the trailing face plate 77. The tension adjustment member 365 is carried by a mortised support member 371 which in turn is carried by the trailing face plate 77. The auxiliary seal is constructed such that the bottom face extends over substantially half the distance of the trailing face plate 77. Thus, even though the piston seal 301 illustrated in FIG. 22 cannot expand downwardly to compensate for wear caused by that annular floor portion which is moving, the auxiliary seal can nonetheless expand in the direction of wear to maintain an effective seal. It is anticipated that various other members may be used which will effect the same functions of the members just discussed. The seal of the present invention is therefore not limited to the specific type, number, and configuration of the members discussed above.

A complete piston assembly, including the seals, is illustrated in FIG. 17. Illustrated in FIG. 17 is a piston 19 carried by the first annular floor portion 14. Therefore, the second annular floor portion 214 moves relative to the piston 19. The piston 19 is connected to the first annular floor portion 14, not seen in FIG. 17, by the illustrated threaded assembly 373. The pistons 20, 219, and 220 are connected to their respective floor portions by similar threaded assemblies. The piston is comprised along its leading face is a leading face plate 79 having oil channels on one side and mortised support members on the other side for carrying the auxiliary seal 352. A second support plate is provided, such as plate 334 shown in FIG. 21, which carries the piston seal 301. A third plate 375 is provided to securely fasten the piston seal 301. The plate 375 may carry a crown 377 which is used to decrease the area within the combustion chamber.

The trailing edge of the piston 19 is constructed in a similar manner. The trailing face plate 77 completes the assembly of the oil drain holes 78 while providing the mortised supports 371 and 370 for the auxiliary seal 352. A second plate 334 is provided for supporting the piston seal 301. A third plate 375 is provided for maintaining the seals in the proper orientation. Again, the plate 375 may be provided with a crown 377 for decreasing the area of the combustion chamber.

IX. Distributors

The present invention utilizes two distributors 85 and 285 illustrated in FIG. 1. The distributor 85, illustrated in FIG. 30, has a distributor gear 87 which may be connected by a chain (not shown) to gear 63 carried by the inner shaft 3. A portion of the casing 89 illustrated in FIG. 1 encloses the chain as well as the distributor gear 87 and the gear 63. In this manner, the internal mechanism of the distributor, to be described later, rotates in unison with the inner shaft.

The distributor 285 has a similar distributor gear (not shown) which is connected by a chain (not shown) to the gear 263 carried by the ore shaft 203. A portion of the casing 289 encloses the distributor gear, chain, and the gear 263.

The distributor 85 will now be described in detail in conjunction with FIGS. 30, 30A, and 30B. The reader should recognize that the distributor 285 is identical in construction and operation except that the distributor 285 operates in conjunction with the outer shaft 203.

Figure 30A:
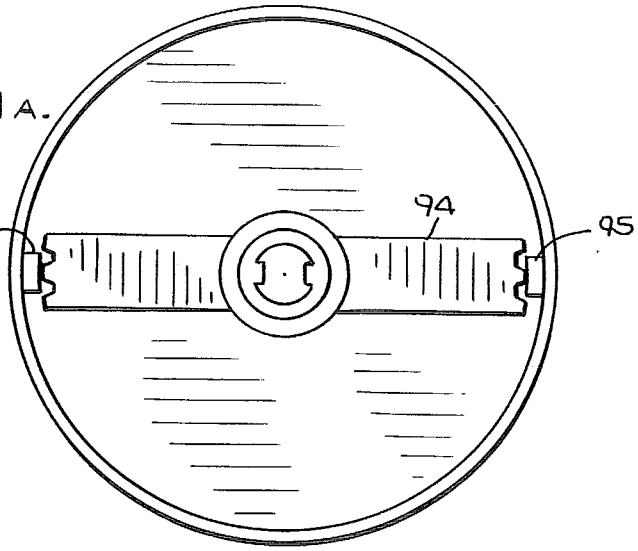
FIGS. 30*a* and 30*b* are top and bottom views, respectively, of the distributor illustrated in FIG. 30.
Figure 30B:
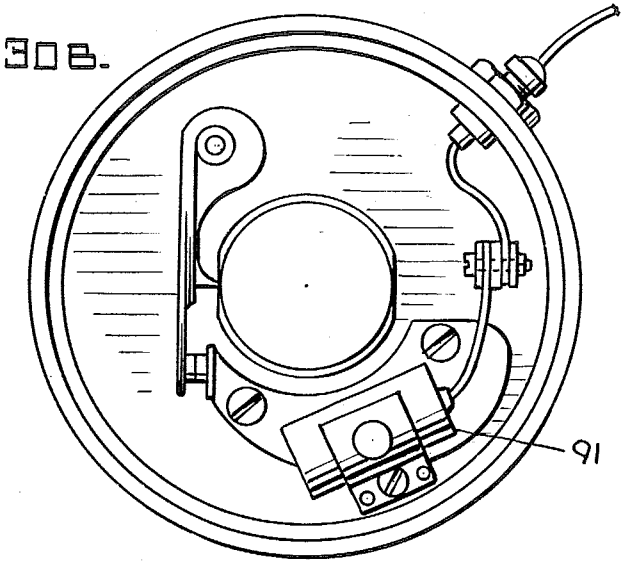
Figure 30:
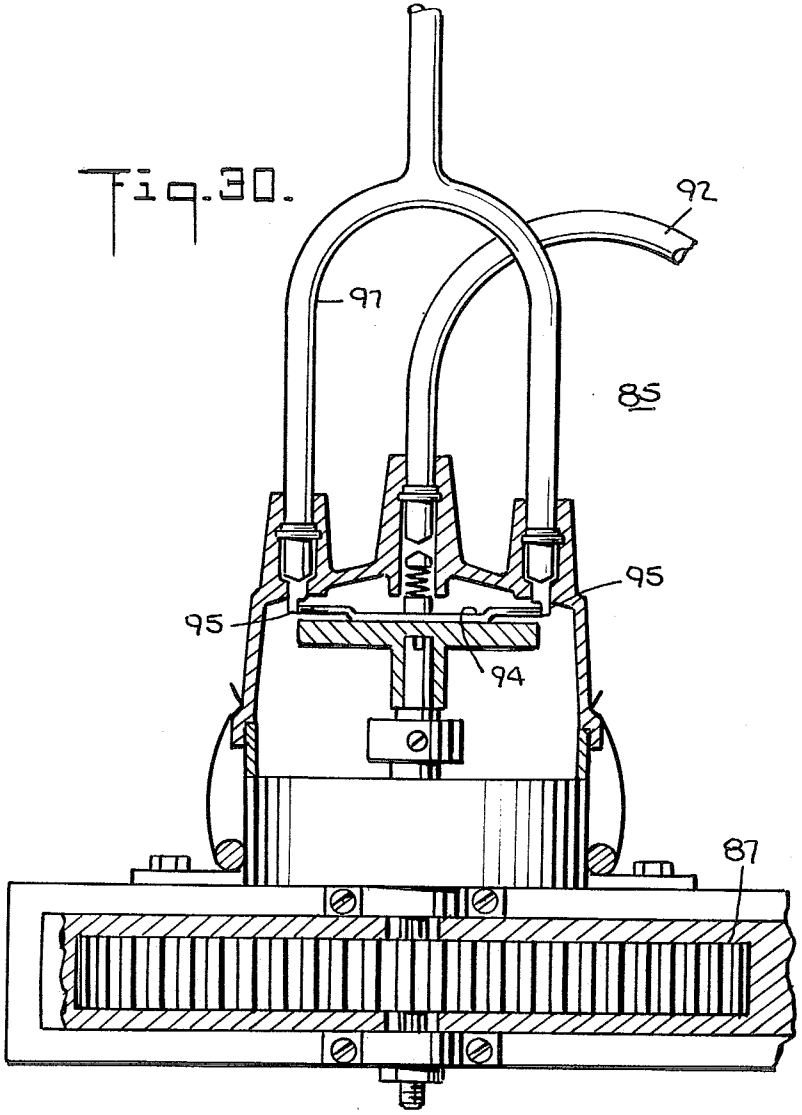
FIG. 30 is a cross-sectional view of a distributor constructed according to the teachings of the present invention.

In FIGS. 30, 30A, and 30B a capacitor 91 is charged by a source of voltage such as a battery or alternator (not shown) through a conductor 91. Periodically, the capacitor 91 is disconnected from the charging source. At this time, the rotating wing-like conductor or blade 94 comes into contact with contacts 95 which causes the capacitor 91 to quickly discharge. This discharge is carried by a conductor 97 to the spark plug 27 for providing the spark necessary for ignition. The distributor 95 operates like a conventional distributor with the exception that it is responsible for firing only one spark plug. Therefore, the distributor 85 may be more properly referred to as an ignitor. Because the wing-like conductor 94, which causes the discharge of the capacitor 91, rotates in unison with the shaft 3, the spark plug 27 is always fired at precisely the correct time. In this manner, complicated timing devices are eliminated.

X. Fuel Injection Pump

Figure 31:
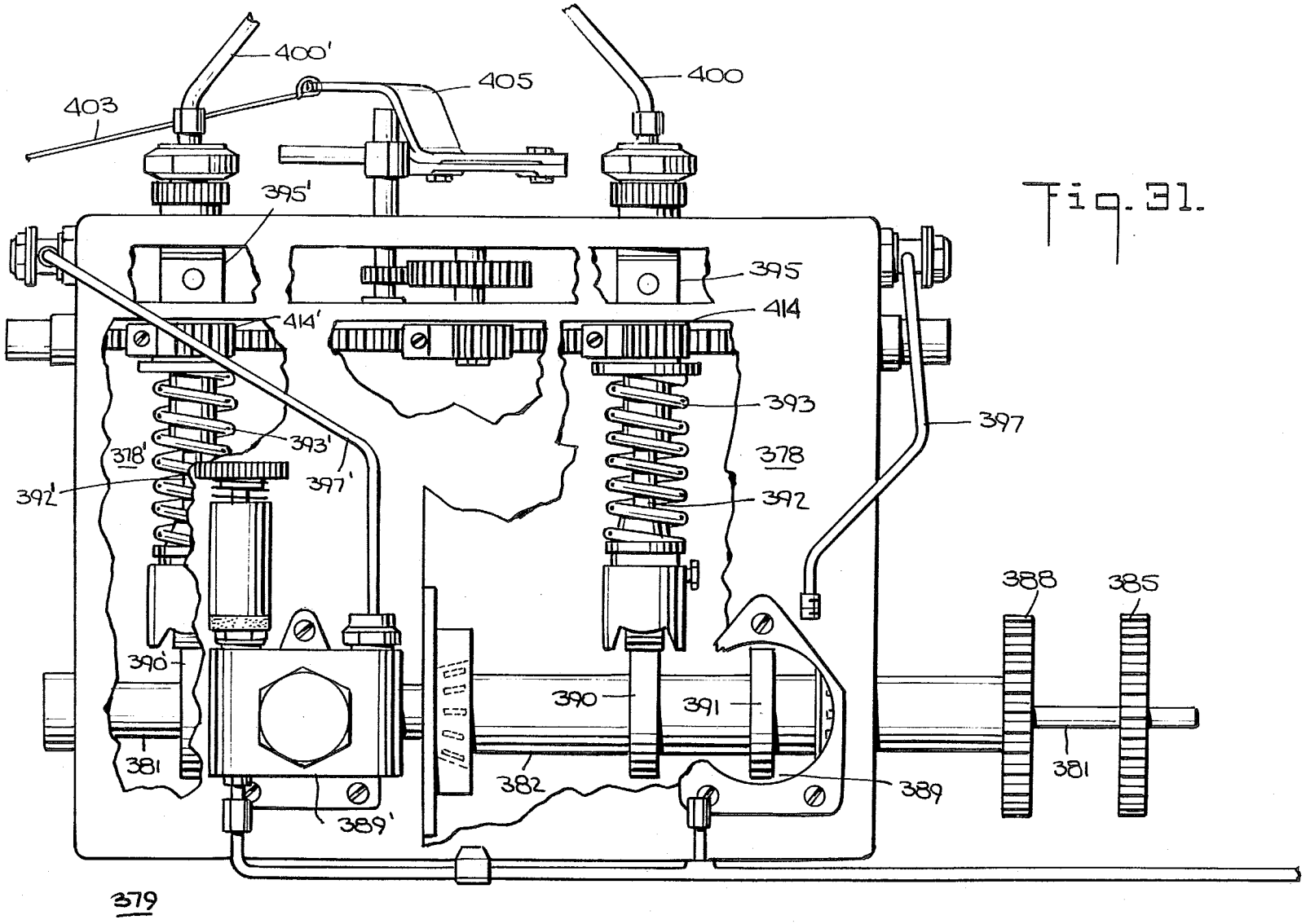
FIG. 31 illustrates a fuel injection pump, with part of the casing broken away, constructed according to the teachings of the present invention.
Figure 32:
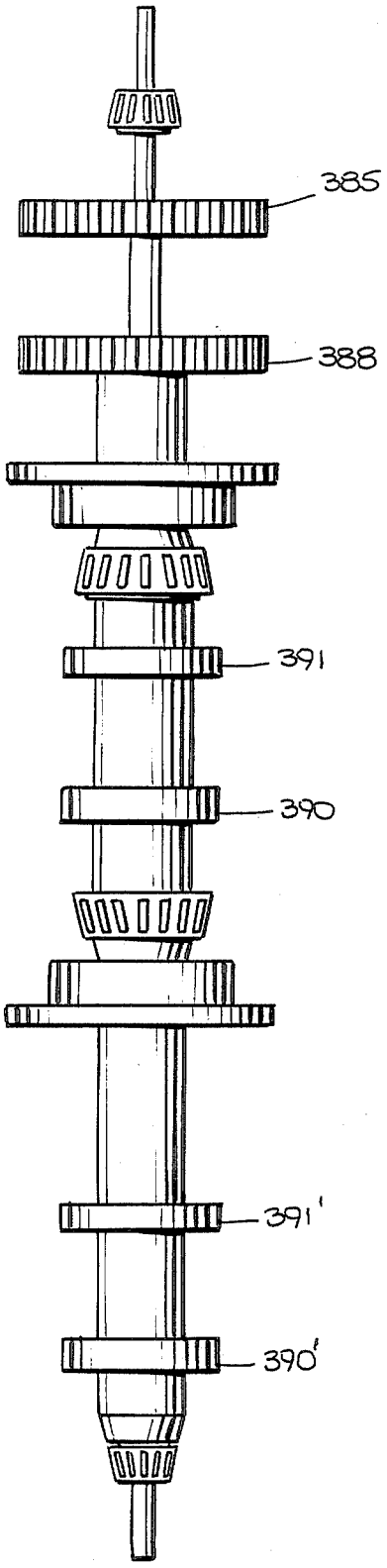
FIG. 32 illustrates the inner and outer shafts of the fuel injection pump illustrated in FIG. 31.

A fuel injection pump 379 constructed according to the teachings of the present invention is illustrated generally in FIGS. 1 and 2, and more specifically in FIG. 31. The fuel injection pump has an inner shaft 381 illustrated in FIG. 32B and an outer shaft 382 illustrated in FIG. 32A. The inner and outer shafts may be combined as shown in FIG. 32. The inner shaft 381 has a splined portion 384 carrying a gear 385. The outer shaft 382 has a splined portion 387 carrying a gear 388. The gear 385 is connected by a chain (not shown) to the gear 62 carried by the inner shaft 3 illustrated in FIG. 5. The gear 388 is connected by a chain (not shown) to the gear 262 carried by the outer shaft 203 as illustrated in FIG. 5. A portion of the engine casing 99, illustrated in FIGS. 1 and 2, is provided to enclose the gears 385 and 62 as well as the connecting chain. A portion of the casing 299 illustrated in FIGS. 1 and 2 is provided to enclose the gears 388 and 262 together with the interconnecting chain. In this manner, the inner shaft 381 of the fuel injection pump 379 rotates at the same speed as the inner shaft 3 while the outer shaft 282 of the fuel injection pump 379 rotates at the same speed as the outer shaft 203.

The fuel injection pump is capable of providing fuel to the combustion chambers through the fuel input valves 22 and 222. A first fuel injection unit 378 located within the fuel injection pump 379 for providing fuel to the outer fuel input valve 222 is the same as a second fuel injection unit 378' located within the fuel injection pump 379 for providing fuel to the inner fuel input valve 22. Because these units are the same, only the first unit 378 will be described in detail. The reader will understand that the second unit 378' is constructed and operates in the same manner as the first unit 378.

Figure 32A:
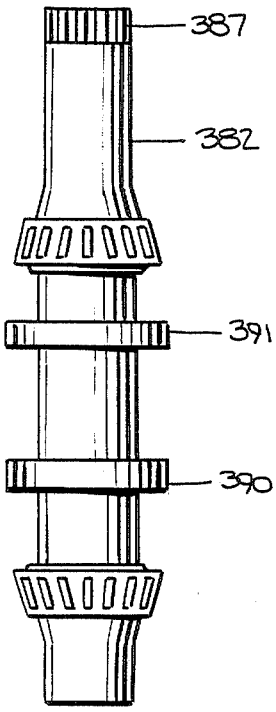
FIGS. 32*a* and 32*b* illustrate the outer shaft and inner shaft, respectively, of the fuel injection pump illustrated in FIG. 31.
Figure 32B:
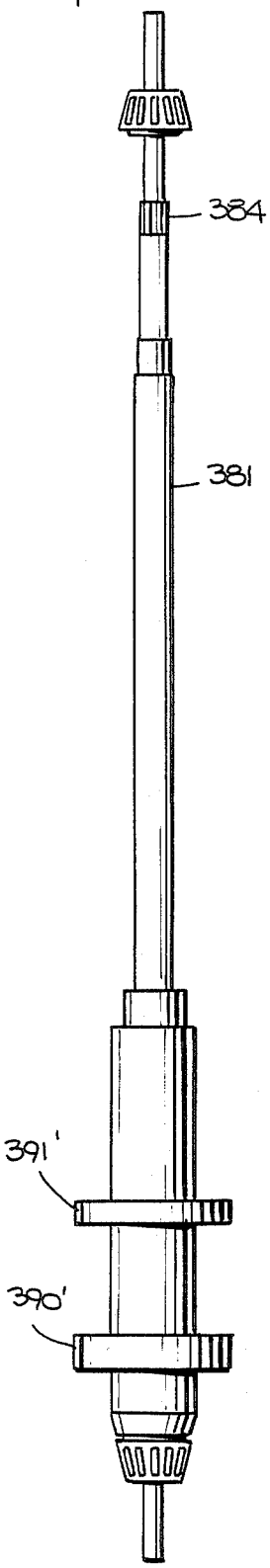
Figure 32C:
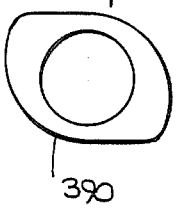
FIG. 32*c* illustrates a cam carried by the inner and outer shafts of the fuel injection pump.
Figure 33:
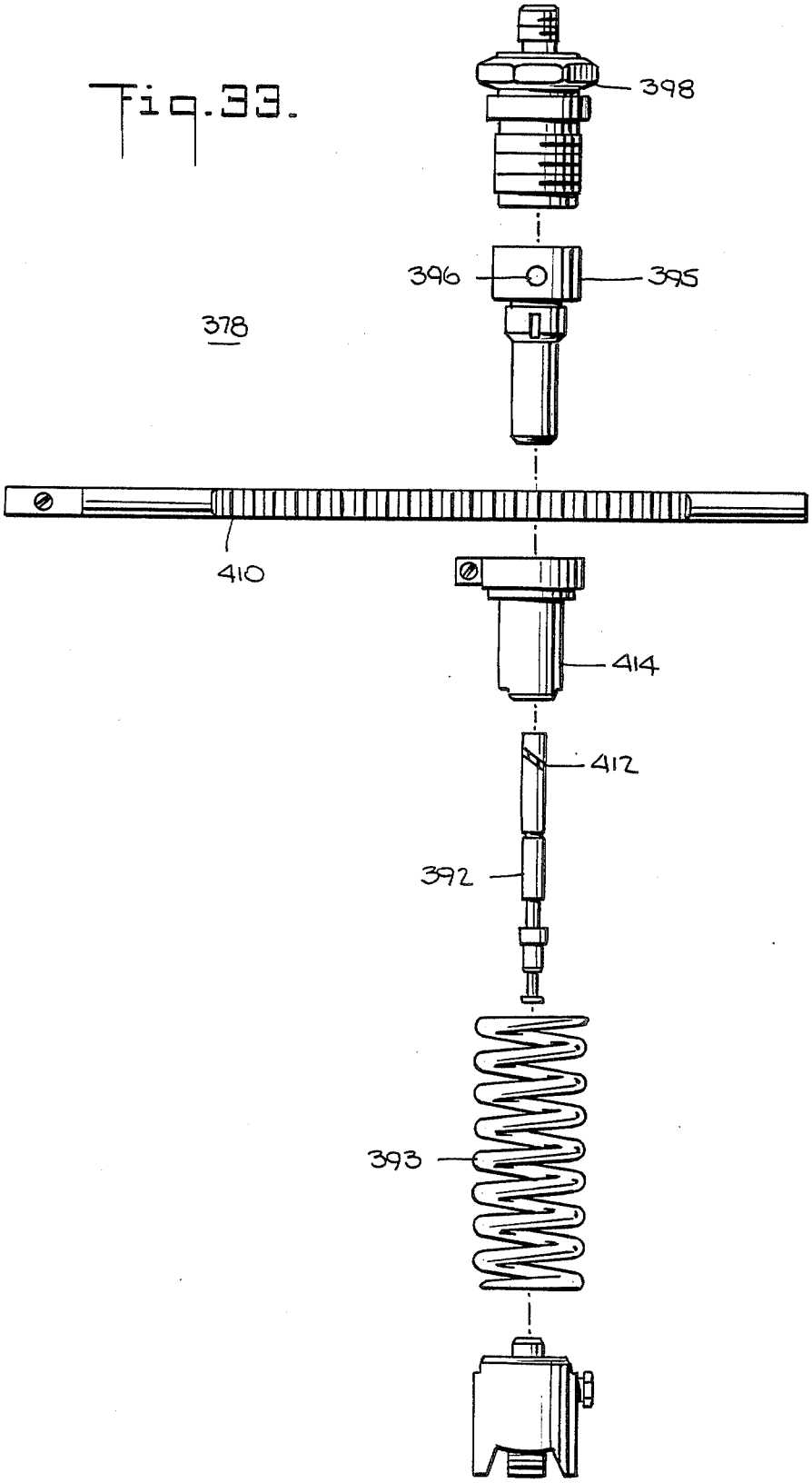
FIG. 33 is an exploded view illustrating one of the injection units of the fuel injection pump illustrated in FIG. 31.

In FIGS. 31 and 32A, the outer shaft 382 is illustrated carrying a fuel injection cam 390. The fuel injection cam 390 is shown in detail in FIG. 32C. When the fuel injection cam 390 rotates, a cam follower in the form of a fuel injection plunger 392 follows the surface of the fuel injection cam 390. When the fuel injection plunger reaches the level portion of the fuel injection cam 390, it is driven downward by a spring 393. This downward motion of the fuel injection plunger 392 creates a vacuum in a fuel holding chamber 395 best seen in FIG. 33. The chamber 395 has an opening 396 in communication with a fuel replenishment line 397. The vacuum in the chamber 395 caused by the dropping fuel injection plunger 92 is timed to correspond to the operation of a fuel replenishment plunger (not shown), which is located within a fuel replenishment chamber 389 and is responsive to a fuel replenishment cam 391. The fuel replenishment plunger is driven upward by the fuel replenishment cam 391 at the same time the vacuum in formed in the chamber 395 such that fuel from the fuel replenishment chamber 389 is forced through the fuel replenishment line 397, through opening 396, and into the chamber 395. When the eccentric portion of the fuel injection cam 390 forces the fuel injection plunger 392 upward, the fuel in the fuel holding chamber 395 is forced upward through a fitting 398 connected to a fuel line 400 which connects the fuel injection pump 379 to the fuel input valve 222. Again, the reader will recognize that a second fuel injection plunger 392', fuel injection cam 390', etc. are provided for the fuel input valve 22.

The fuel injection pump 379 is responsive to a gas pedal 401 illustraed in FIG. 2 through a connector 403. The connector 403 is connected to a mechanism 405 located on the outside of the fuel injection pump 379. The mechanism 405 is responsible for causing a small gear 406 to rotate in response to the amount of depression of the gas pedal 401. The small gear meshes with a large gear 408. The large gear 408 in turn moves a rack gear 410 to the right or left as viewed in FIG. 31. The rack gear 410 is seen most clearly in FIG. 33.

The fuel injection plunger 392 is provided with a window 412. This window cooperates with a fuel drain passage (not shown) on the inside of the chamber 395 thereby allowing fuel to drain from the fuel holding chamber 395 back into the fuel replenishment chamber 389. The angular position of the plunger 392, and therefore the position of the window 412 relative to the fuel drain passage within the chamber 395, is responsive to the rack gear 410 by virtue of a connecting member 414.

When the gas pedal is not depressed, the window 412 of the plunger 392 is lined up with the fuel drain passage within the chamber 395 such that most of the fuel drains from the chamber 395. Thus, on the upward stroke of the plunger 392 only a minimum amount of fuel required to maintain the engine running is injected into the combustion chamber. Conversely, if the gas pedal is fully depressed, the window 412 of the plunger 392 is entirely out of registry with the fuel drain passage within the chamber 395 such that no fuel drains from the chamber 395. On the upward stroke of the plunger 392 all of the fuel is injected into the combustion chamber. Thus, the level of depression of the gas pedal ultimately determines how much fuel will be injected into the combustion chamber. The other fuel injection unit 378' is similarly responsive to the gas pedal.

XI. Adjustable check Valve

Figure 34:
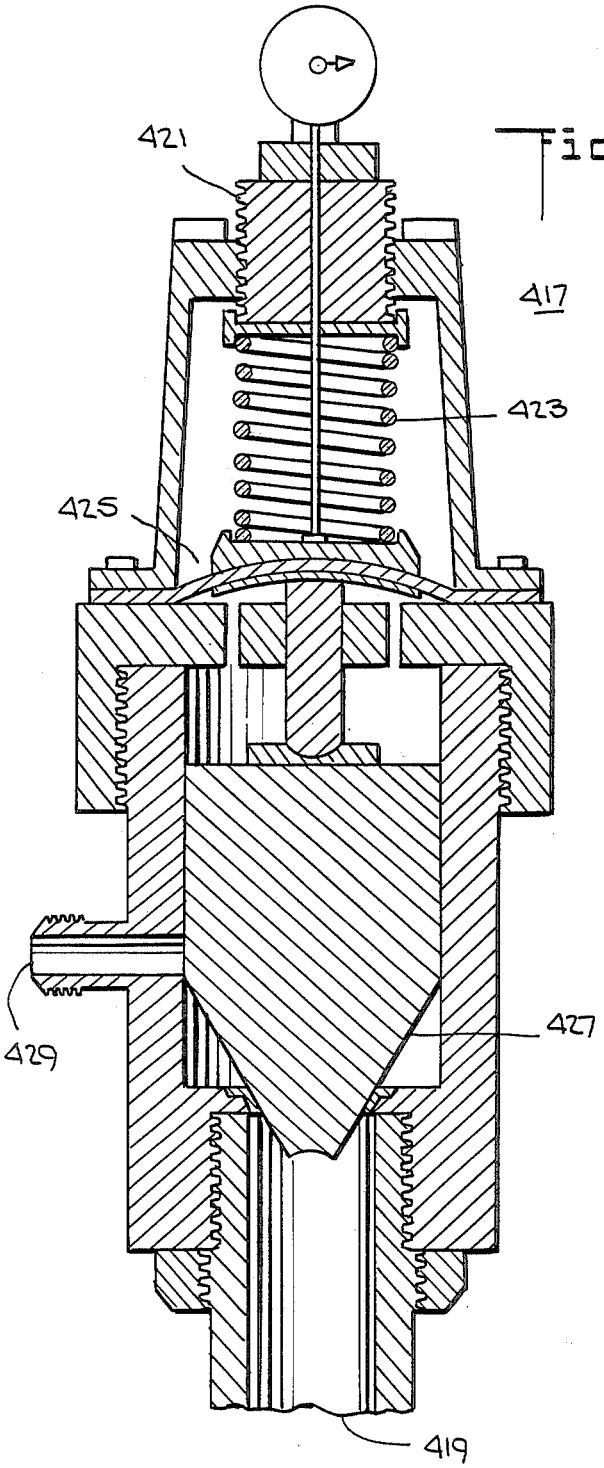
FIG. 34 illustrates a compression control valve.

Illustrated in FIG. 34 is an adjustable check valve 417. The position of the adjustable check valve 417 relative to the remainder of the components of the Silvoza rotary engine is illustrated in FIG. 2. Returning now to FIG. 34, the adjustable check valve 417 is positioned such that a lower chamber 419 is subject to the pressure created during combustion. An adjustable nut 421 cooperates with a spring 423 to determine the amount of pressure exerted on a diaphragm 425. On the opposite side of the diaphragm 425 is a plunger 427 which isolates an output vent line 429 from the combustion pressure experienced in lower chamber 419. In the event that the combustion pressure experienced in lower chamber 419 becomes greater than the force exerted by the spring 423, the plunger 427 and diaphragm 425 will be pushed upwardly thereby allowing the pressure to escape through the output vent line 429.

Figure 34A:
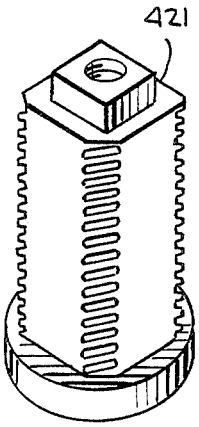
FIG. 34*a* illustrates a compression control valve adjustment nut.

The adjustment nut 421 is illustrated in detail in FIG. 34A. The adjustment nut has the shape illustrated in FIG. 34A such that the area on the side of the diaphragm 425 inn which the spring 423 is located will be at atmospheric pressure. Thus, by screwing adjustment nut 421 downward the amount of combustion pressure needed to operate valve 417 is increased. By screwing adjustment nut 421 upwardly, the amount of pressure needed to operate valve 417 is decreased. Because the valve 417 is in communication with the pressure in the combustion chamber, the pressure in the combustion chamber can be easily regulated by a simple adjustment. This represents a substantial advantage over the prior art.

XII. Overall Engine Operation

The operation of the present invention will now be described in conjunction with FIGS. 36–49 and **42*a*–49*a*. In general, FIGS. 37, 40, 42, 42*a*, 44, 44*a*, 46, 46*a*, 48 and 48*a* illustrate components which rotate in conjunction with the inner shaft 3. FIGS. 38, 41, 43, 43*a*, 45, 45*a*, 47, 47*a*, 49, and 49*a* illustrate components which rotate in conjunction with the outer shaft 203**. Each of the components has been divided into twenty-four segments. In general, the components carried by the driven shaft will move eight of the twenty-four segments, while the components of the non-driven shaft will move four of the twenty-four segments. In the following discussion, we will assume that the inner shaft has just been driven by a combustion, while the outer shaft is preparing to be driven by a combustion. Thus, in the following figures, the components of the inner shaft will first be driven eight segments, while the components of the outer shaft will be driven four segments. Following that movement, the components of the inner shaft will be driven four segments, while the components of the oter shaft will be driven eight segments.

Thereafter, motion continues in the same manner with the driven shaft moving eight segments and the non-driven shaft moving four segments.

Figure 36:
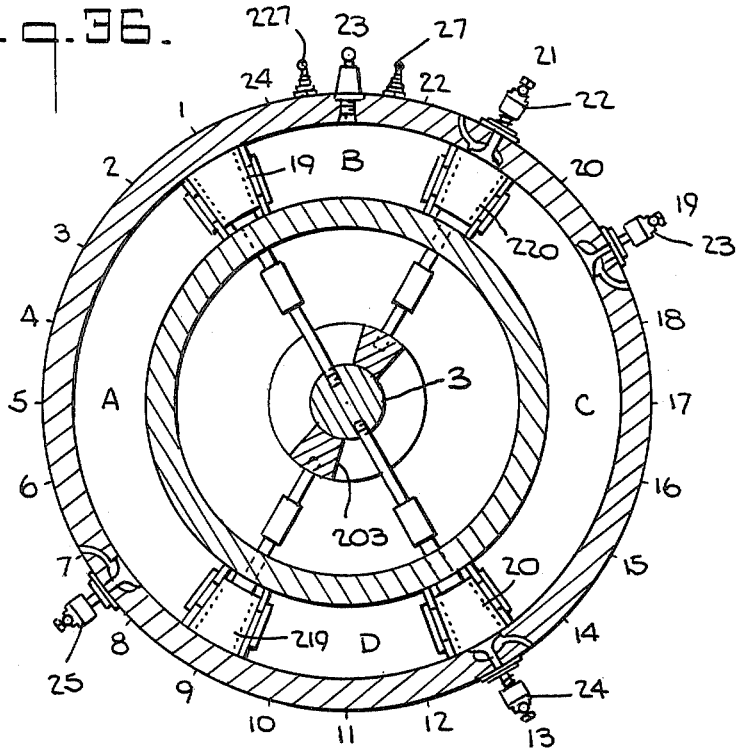
FIG. 36 is used to describe the motion of the pistons during operation of the rotary engine.

In FIG. 36 the pistons 19 and 20 connected to the inner shaft 3 are being driven by a combustion which has just taken place in combustion chamber B. As discussed above, the areas between the pistons 19 and 220, pistons 220 and 20, pistons 20 and 219, and pistons 219 and 19 form combustion chambers B, C, D, and A, respectively. However, each combustion chamber is not ignited until it is positioned under the spark plugs 27 and 227.

Combustion occurs when the rotating wing-like conductor 94 of the distributor 85 comes in contact with the contacts 95 thereby providing a spark through spark plug 27. At this time, the wing-like conductor 94 occupies the position illustrated in FIG. 37 and the wing-like conductor 294 occupies the position illustrated in FIG. 38.

Figure 39:
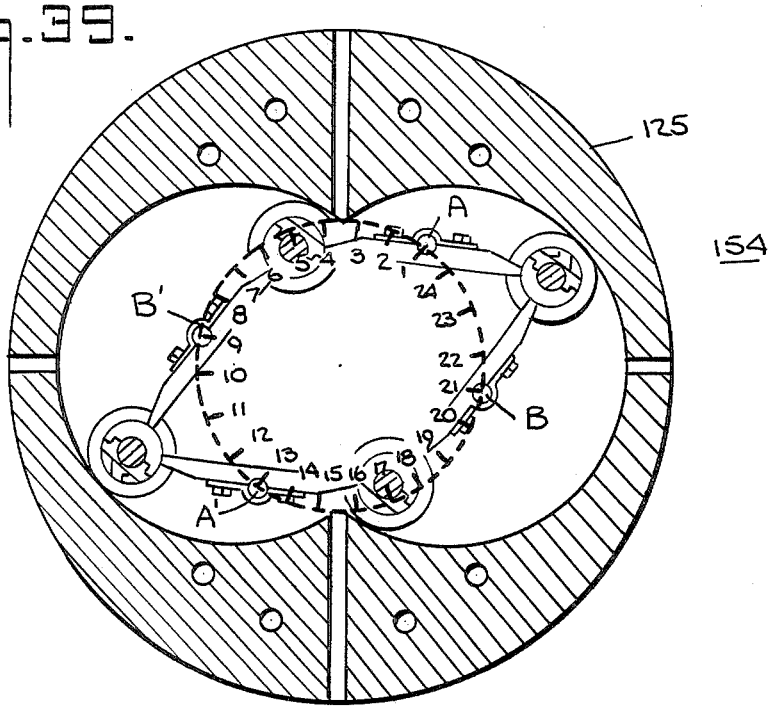
FIG. 39 is used to describe the motion of the control mechansim during operation of the rotary engine.

Turning now to the controller 154 illustrated in FIG. 39, it is easiest to talk about the movement of the controller 154 by describing the movement of the points at which the controller 154 is connected to the first arm 30 and second arm 31 of the controller connecting mechanism 29 and the first arm 230 and second arm 231 of the controller connecting mechanism 229. For convenience, these points are designated A, A′ B, and B′, respectively. Thus, points A and A′ represent the points where the controller is connected to the inner shaft 3, while the points B and B′ represent the points where the controller is connected to the outer shaft 203.

During the combustion and ensuing expansion of the combustion gases, the point A will move to the position occupied by the point B′, while the point A′ will move to the position occupied by the point B. For the point A to move to the position occupied by point B′, it must move through eight segments of an imaginary circle drawn through the points A, A′, B, and B′. During this time, the points B and B′ will move only four segments to occupy the positions occupied by the points A′ and A, respectively. Thus, it is seen that the controller 154 enables the driven shaft to move eight segments, while the non-driven shaft moves four segments.

Figure 40:
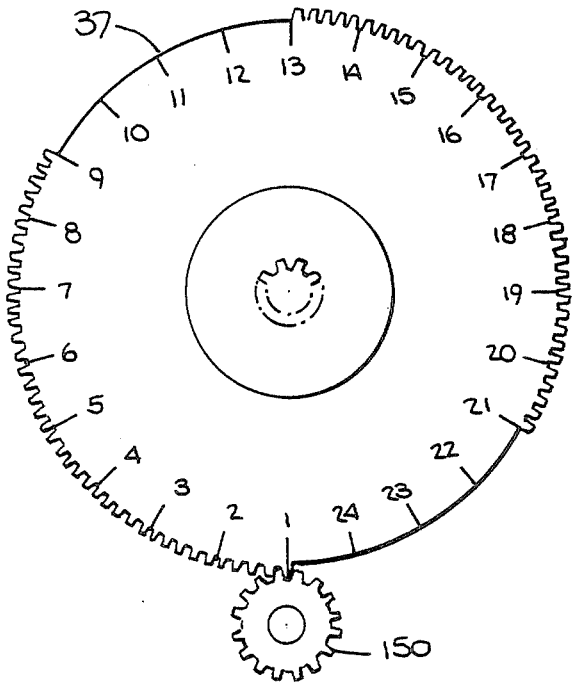
FIGS. 40 and 41 are used to describe the motion of the inner and outer transfer gears, respectively, during operation of the rotary engine.
Figure 41:
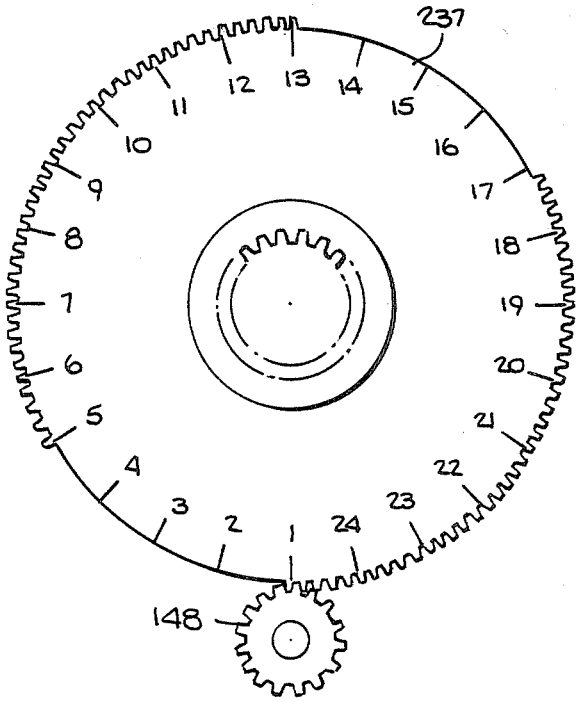

After the combustion which causes the inner shaft 3 to be driven, the transfer gear 37 illustrated in FIG. 40 will begin meshing with the gear 150 of the main driven shaft 146. The transfer gear will travel eight segments thus coupling power from the inner shaft 3 to the main driven shaft 146. During this time, the power transfer gear 237 of the outer shaft 203 illustrated in FIG. 41 moves four segments during which time it does not mesh with the gear 148 of the main driven shaft 146.

Figure 42:
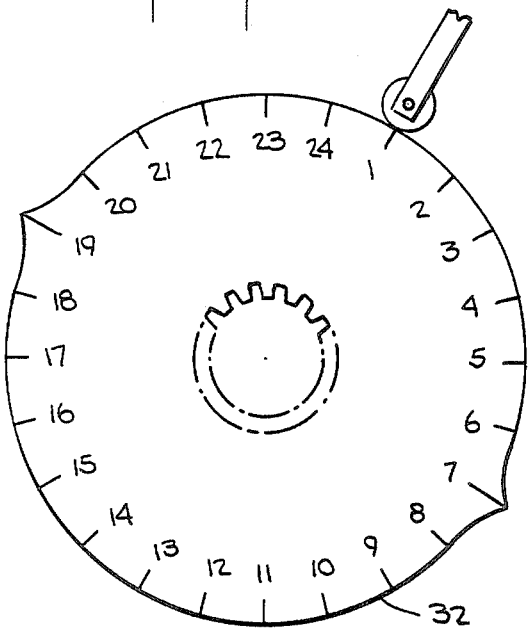
FIGS. 42 and 42*a* are used to describe the motion of the inner gas intake cam during operation of the rotary engine.
Figure 43:
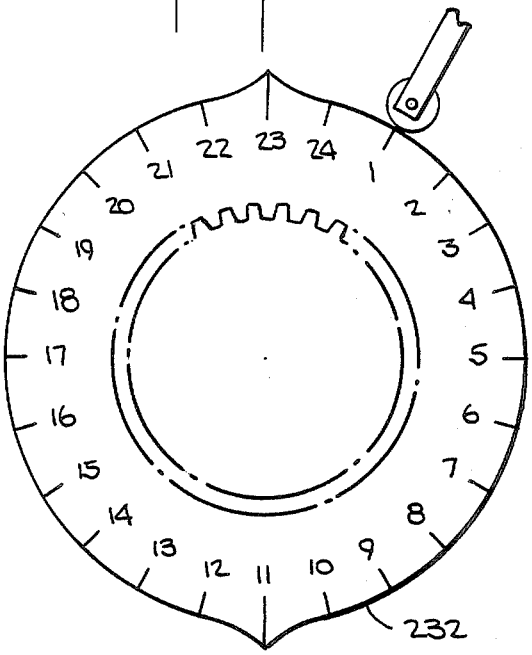
FIGS. 43 and 43*a* are used to described the motion of the outer gas intake cam during operation of the rotary engine.
Figure 42A:
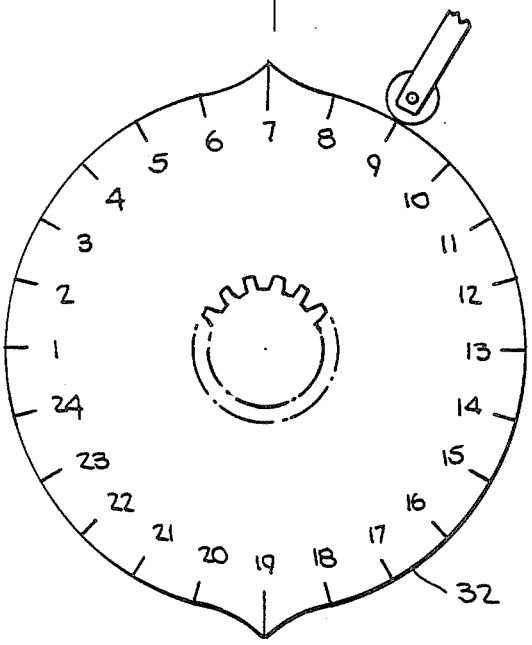
Figure 43A:
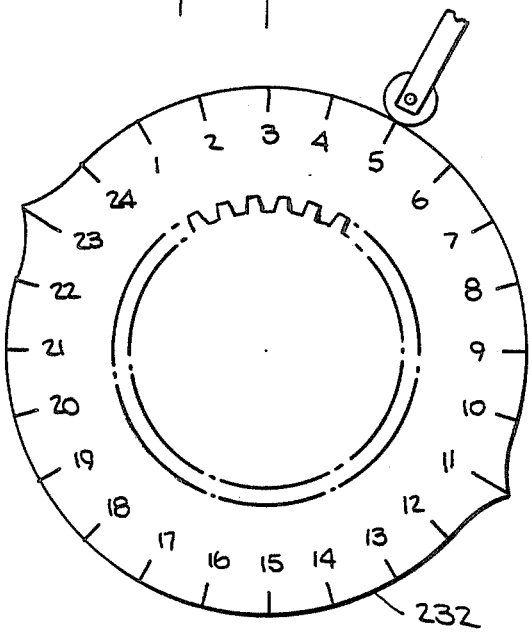

The inner gas intake cam 32 moves counterclockwise eight segments from the position shown in FIG. 42 to the position shown in FIG. **42*a*. When the cam 32 reaches segment 7, the fuel input valve 22 is momentarily opened and the fuel injection pump 379 injects fuel into the combustion chamber. It is noteworthy that the cam connected to the inner shaft 3 is used to provide the fuel which will cause a combustion resulting in the outer shaft 203 being driven. As seen in FIGS. 43 and 43*a*, the outer gas intake cam 232** moves four segments during which time it remains closed.

Figure 44:
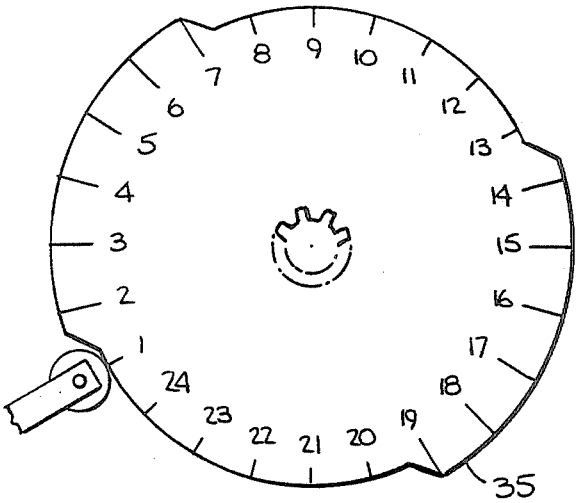
FIGS. 44 and 44*a* are used to describe the motion of the inner air exhaust after combustion cam during operation of the rotary engine.
Figure 45:
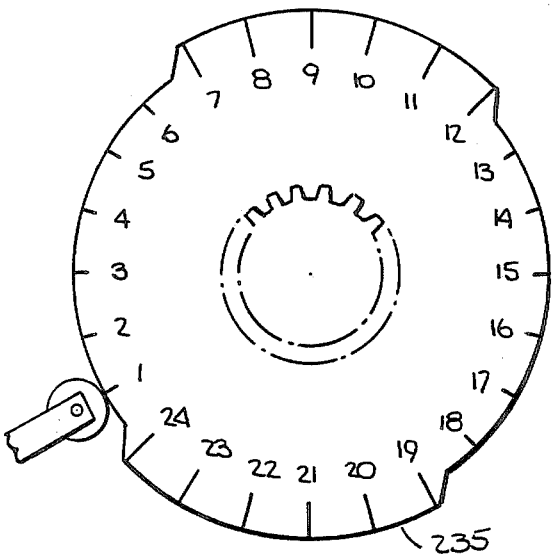
FIGS. 45 and 45*a* are used to describe the motion of the outer air exhaust after combustion cam during operation of the rotary engine.
Figure 44A:
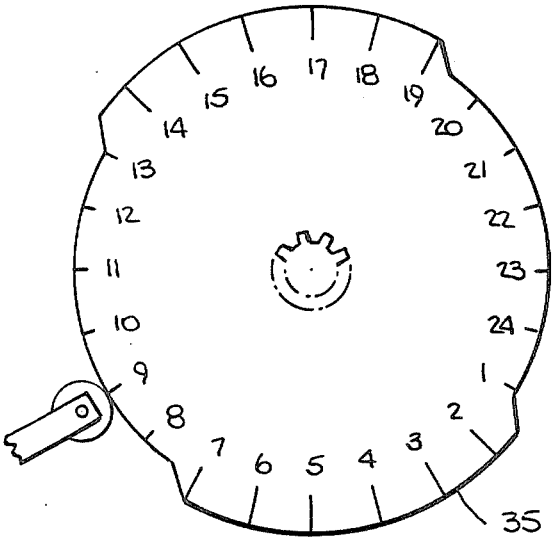
Figure 45A:
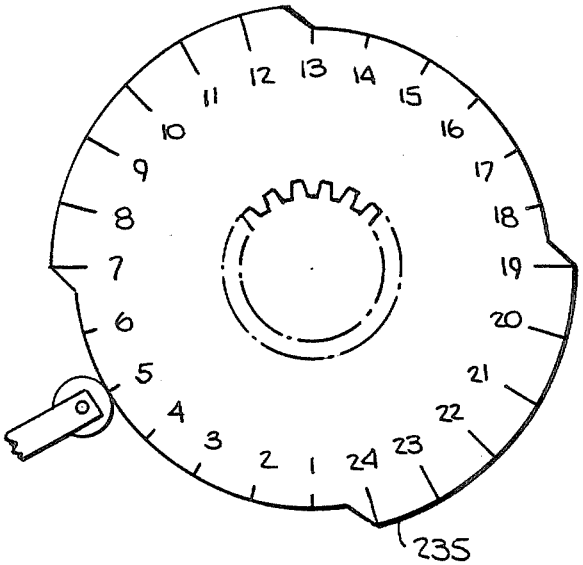

In FIGS. 44 and **44*a*, the inner air exhaust after combustion cam 35 is illustrated. At the very beginning of combustion, the inner air exhaust after combustion valve 25 is closed. Immediately thereafter, as can be seen by the cam surface, the valve is opened and remains open for a substantial period of time to enable the piston 19 to travel toward the air exhaust after combustion valve 25, thereby expelling combustion gases from the previous combustion which took place in chamber A. During this time, the outer air exhaust after combustion valve 235 remains closed as illustrated in FIGS. 45 and 45*a***.

Figure 46:
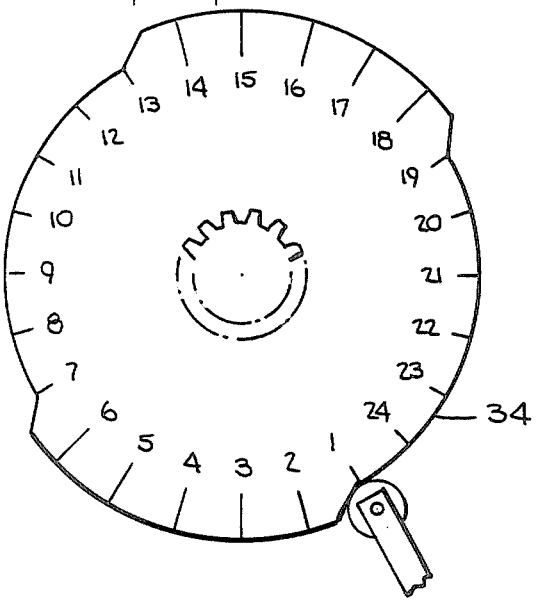
FIGS. 46 and 46*a* are used to described the motion of the inner air intake cam during operation of the rotary engine.
Figure 47:
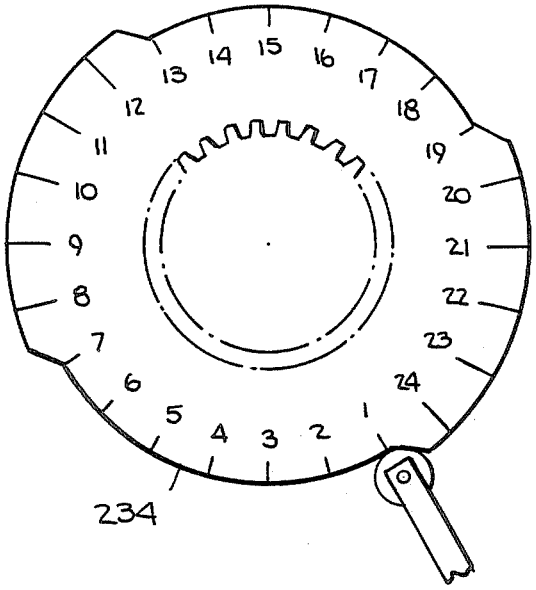
FIG. 47 and 47*a* are used to describe the motion of the outer air intake cam during operation of the rotary engine.
Figure 46A:
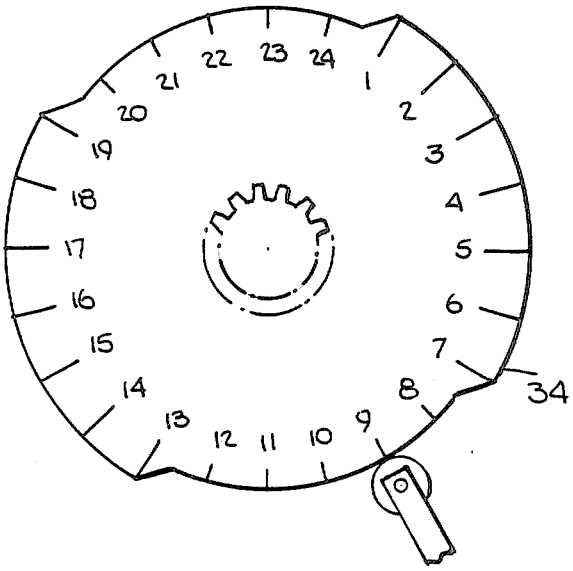
Figure 47A:
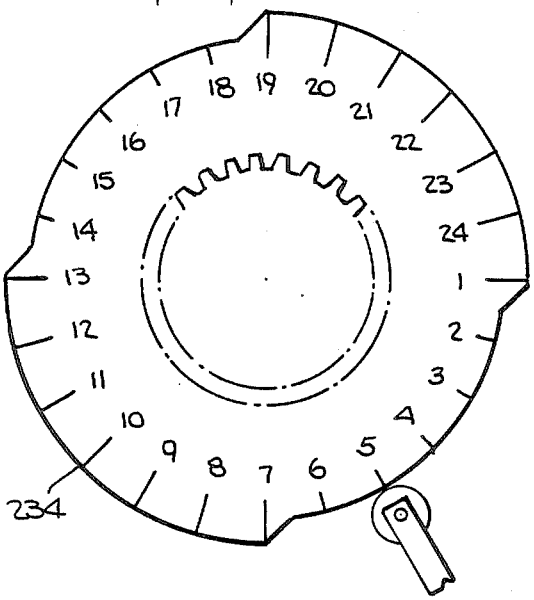

The cams 34 and 234 for the air intake valves 24 and 224, respectively, are illustrated in FIGS. 46, **46*a*, 47 and 47*a*. The inner air intake cam 34 causes the air intake valve 24 to open, thereby enabling air to enter in preparation for the combustion which will take place in chamber D. During this time, the outer air intake valve 224 for the outer shaft 203 remains closed as illustrated by the cam surface shown in FIGS. 47 and 47*a***.

Figure 48:
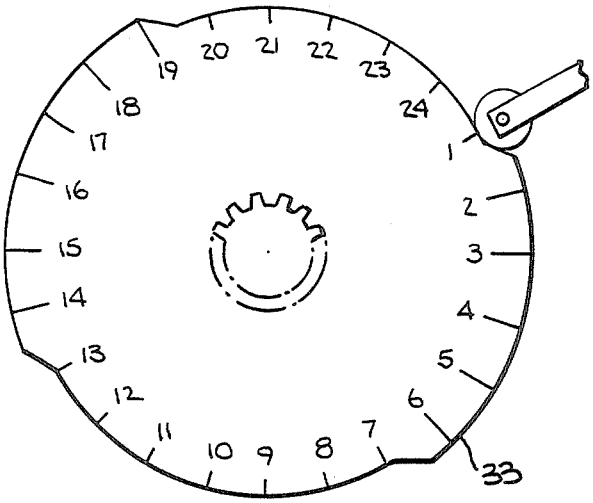
FIGS. 48 and 48*a* are used to describe the motion of the inner air exhaust cam during operation of the rotary engine and FIGS. 49 and 49*a* are used to describe the motion of the outer air exhasut cam during operation of the rotary engine.
Figure 49:
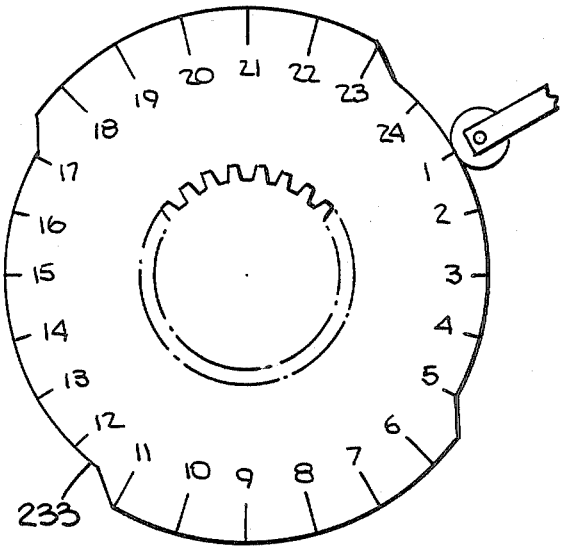
Figure 48A:
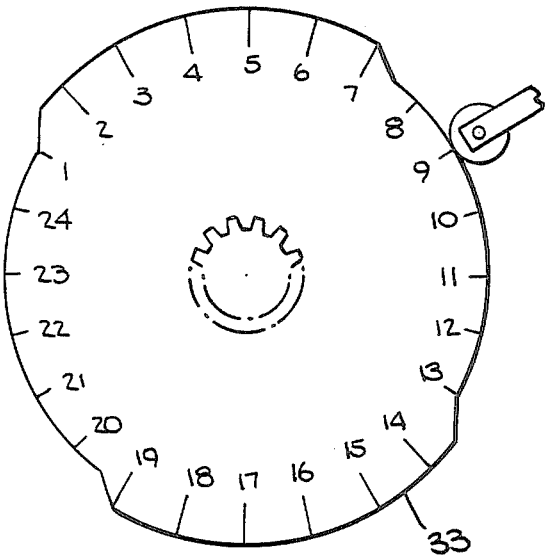
Figure 49A:
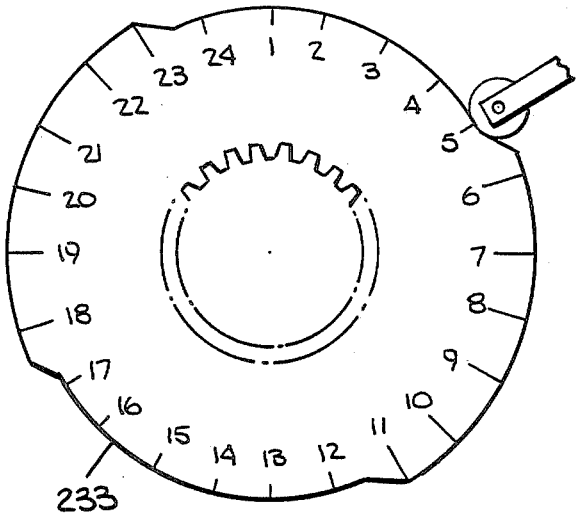

The inner air exhaust cam 33 is illustrated in FIGS. 48 and **48*a*. The inner air exhaust cam is configured such that the air exhaust valve 23 remains open and then closes in preparation for compression just prior to the next combustion which will take place in chamber C. During this time, the outer air exhaust valve 223 remains closed as shown by FIGS. 49 and 49*a***.

Figure 37:
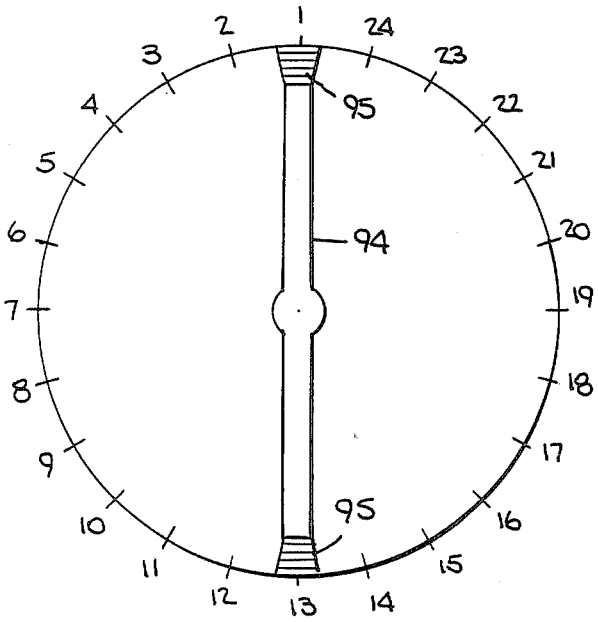
FIGS. 37 and 38 are used to described the motion of the inner distributor arm and outer distributor arm, respectively, during operation of the rotary engine.
Figure 38:
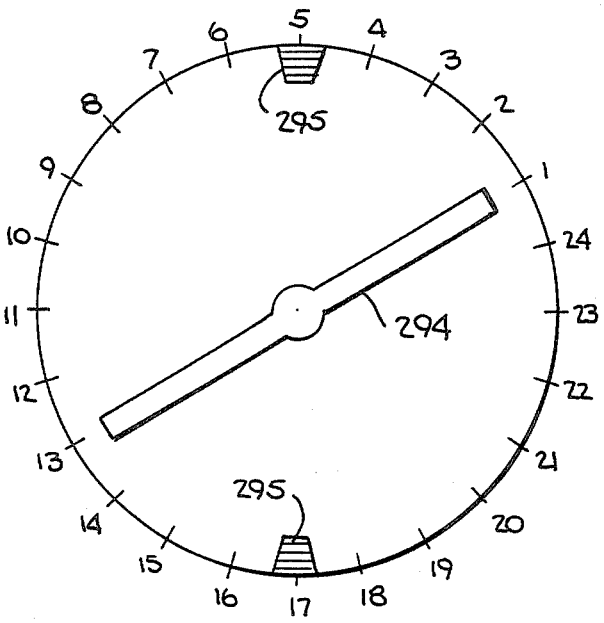

After the inner shaft is driven by the combustion forces, the pistons illustrated in FIG. 37 will have exchanged positions. That is, piston 19 will be in the position of piston 219, while the piston 220 will be in the position of piston 19. At this time, the outer shaft will be driven when the wing-like conductor 94 of the outer distributor 85 comes in contact with the contacts 295. Under these circumstances, the points of the controller again exchange position. The power transfer gear 237 of the outer shaft 203 meshes with gear 148, while the power transfer gear 37 does not mesh with the gear 150. The cams illustrated in FIG. **42*a*, 44*a*, 46*a*, and 48*a* will move four segments, while the cams illustrated in FIGS. 43*a*, 45*a*, 47*a*, and 49*a* will move eight segments. Thus, after each shaft is driven twice (eight segments plus eight segments) and is not driven twice (four segments plus four segments), the components will have returned to their initial positions illustrated in FIGS. 36–49**.

In this manner, the operation of the valves is precisely controlled to effect the input of air and fuel, the compression of the air-fuel mixture, the combustion of the air-fuel mixture, and the exhaust of combustion gases.

As can be seen from FIGS. **46–49*a*, at the point of combustion, both air intake valves 24 and 224 and both air exhaust valves 23 and 223 are momentarily closed. This enables the momentary production of a small vacuum in chamber C, i.e. between the valves 23 and 24**. This small vacuum aids in controlling the pistons so that they travel only in a counterclockwise direction.

XIII. Summary

The present invention is directed to a novel rotary engine having numerous advantages over the prior art. The rotary engine of the present invention efficiently produces high torque from a minimum number of combustions. the power produced by the engine is transferred to an output drive shaft by a simple arrangement of two power transfer gears. By changing the ratio of the power transfer gears to the gears of the output drive shaft, a minimum number of combustions required for maintaining a desired level of rpms can be easily controlled.

The rotary engine of the present invention utilizes a novel control mechanism for precisely controlling the position of the pistons. Because the control mechanism is not used to transfer power, it is not subject to high torque or shocks.

The rotary engine of the present invention further utilizes novel piston seals which are capable of expanding in the direction of wear, while maintaining the seal at each face thereof. Such seals effectively contain the combustion gases, thereby enabling efficient and smooth operation.

The rotary engine of the present invention also employs a novel lubrication system which operates in conjunction with rotation of the inner and outer shafts. The lubrication systems is extremely simple, yet effective. The lubrication system can also be used as a cooling system in conjunction with a more traditional water cooling system.

The rotary engine of the present invention also utilizes a novel fuel injection pump and a novel ignitor, which both operate in response to the inner and outer shafts.

Novel cam configurations are provided in order to reduce the number of independently moving parts and to simply and effectively operate the required valves in a precisely timed relationship. Because the rotary engine of the present invention has fewer independently moving parts than other types of rotary engines, it is easier to produce using mass production techniques, more efficient, and easier to maintain.

Those of ordinary skill in the art will recognize that the rotary engine disclosed herein may use other components which have not been specifically described in this specification. For example, an oil reservoir 435, seen in FIGS. 1 and 2, oil pumps 436 and 437 and oil filters 438 and 439 may be used in order to provide lubrication to the various push rods and cams. An exhaust manifold 441, seen in FIG. 2, may also be provided. An oil reservoir 443, seen in FIG. 1, may be provided in order to provide lubrication to the fuel injection pump 379. A fuel pump 445 and fuel line 446 may also be provided. These, and other elements, have not been described in detail because these elements are not considered to be essential features of the present invention. They are standard components which one of ordinary skill in the art would clearly recognize as being necessary or desirable in order to construct a functional rotary engine. They have not been described in detail as their construction and operation are considered to be well within the skill of one or ordinary skill in the art.

While the present invention has been described in connection with an exemplary embodiment thereof, it will be understood that many modifications and variations will be readily apparent to those of ordinary skill in the art. This application and the following claims are intended to cover those modifications and variations.

What is claimed is:

1. A power transfer mechanism for a rotary engine having first means carrying a first pair of diametrically aligned pistons, second means carrying a second pair of diametrically aligned pistons, said first and second pairs of pistons cooperating to define a plurality of combustion chambers, means for causing combustion in said combustion chambers such that said first and second means are alternately driven, and a drive shaft; said power transfer mechanism comprising:

first power transfer gear means connected to said first means for transferring power to said drive shaft when said first means is driven;

second power transfer gear means connected to said second means for transferring power to said driven shaft when said second means is driven; and controller means connected to said first and second means for regulating the positions of said pairs of pistons, said controller means including a cam surface and a cam follower, said cam follower including first, second, third and fourth rollers interconnected by first, second, third, and fourth members to form a four-sided cam follower with one of said rollers at each of the concerns thereof, said first and third members being connected to said first means and said second and fourth members being connected to said second means.

2. The power transfer mechanism of claim 1 wherein said drive shaft has a toothed portion and wherein each of said power transfer gear means includes a gear having toothed and non-toothed portions such that when said first means is driven, said toothed portion of only the first transfer gear meshes with said toothed portion of said driven shaft and when said second means is driven, said toothed portion of only the second transfer gear meshes with said toothed portion of said drive shaft.

3. The power transfer mechanism of claim 2 further comprising means for causing said transfer gear meshing with said teeth of said driven shaft to travel at a greater speed than said non-meshing transfer gear such that the non-toothed portions of said transfer gears appear to have a number of imaginary teeth equal to the number of teeth in said toothed portions of said transfer gears.

4. The power transfer mechanism of claim 3 wherein the number of teeth plus the number of imaginary teeth of one of said transfer gears divided by the number of teeth of said drive shaft proivdes a gear ratio, and wherein the number of combustions necessary to maintain a desired number of revolutions of said draft shaft per minute is variable by changing said gear ratio.

5. The power transfer mechanism of claim 3 wherein said transfer gear meshing with said teeth of said drive shaft travels at twice the speed of said non-meshing transfer gear, and wherein said non-toothed portions of said transfer gears include diametrically opposed non-toothed portions each of which occupies one-sixth of the circumference of said transfer gears.

6. The power transfer mechanism of claim 5 wherein said toothed portions of said transfer gears each include forty teeth and wherein said non-toothed portions of said transfer gears each include forty imaginary teeth.

7. The power transfer mechanism of claim 1 additionally comprising spring means carried by said first, second, third and fourth members for urging said first, second, third and fourth rollers against said cam surface.

8. The power transfer mechanism of claim 1 wherein said cam surface includes a cam surface defined by the intersection of two circles, the center of each of said circles being displaced from said other circle by a distance equal to the radius of said rollers.

9. The power transfer mechanism of claim 1, wherein said means for causing combustion includes first and second spark plugs, a first ignitor for firing said first spark plug in response to the angular position of said first means, and a second ignitor for firing said second spark plug in response to the angular position of said second means.

10. The power transfer mechanism of claim 9 wherein each of said ignitors includes a capacitor for storing an electric charge and a blade rotating at the same speed as one of said first and second means for periodically discharging said capacitor.

11. The power transfer mechanism of claim 1 wherein said rotary engine additionally comprises an adjustable check valve in communication with one of said combustion chambers for automatically relieving excess pressure.

12. The power transfer mechanism of claim 1 wherein said first and second power transfer gear means includes first and second pulleys.

13. A rotary engine comprising:

an engine casing defining a cylindrical chamber and having a plurality of openings;

inner and outer concentric shafts positioned within said cylindrical chamber;

a first ring-shaped floor portion connected to said inner shaft for rotation therewith and a second ring-shaped floor portion connected to said outer shft for rotation therewith, said first and second floor portios cooperating with said casing to define an annular chamber;

a first pair of diametrically aligned pistons positioned within said annular chamber and connected to said first floor portion;

a second pair of diametrically aligned pistons positioned within said annular chamber and connected to said second floor portion, one piston of said first pair of pistons and one piston of said second pair of pistons cooperating to define a combustion chamber;

means for supplying air and fuel to said combustion chambers;

means for supplying a spark to said combustion chambers for causing combustion such that said inner and outer shafts are alternately driven;

controller means connected to said inner and outer shafts for regulating the positions of said first and second pairs of pistons;

a drive shaft; and a first power transfer gear connected to said inner shaft for transferring power to said driven shaft when said inner shaft is driven, and a second power transfer gear connected to said outer shaft for transferring power to said driven shaft when said outer shaft is driven.

14. The rotary engine of claim 13 wherein the controller means includes a cam follower having first, second, third, and fourth rollers interconnected by first, second, third, and fourth members to form a four-sided cam follower with one of said rollers at each of the corners thereof, and wherein said first and third members are connected to said inner shaft and said second and fourth members are connected to said outer shaft, and wherein the controller means further includes a cam surface defined by the intersection of two circles, the center of each of said circles being displaced from said other circle by a distance equal to the radius of said rollers.

15. The rotary engine of claim 13 additionally comprising a plurality of expandable seals carried by said pistons, said seals having at least first and second independent sealing members, at least said first one of said sealing members being mortised, means for biasing one of said sealing members, and a bridge member carried in said mortise and connected to said second sealing member such that said biased member is capable of moving independently of said other sealing member while said bridge member maintains said seal.

16. The rotary engine of claim 13 additionally comprising first oiling means connected to one of said inner and outer shafts for supplying oil to at least one of said first and second pairs of pistons in response to said rotary motion of said shafts, and first oil withdrawal means connected to one of said inner and outer shafts for withdrawing oil from said at least one of said first and second pairs of pistons in response to said rotary motion of said shaft.

17. The rotary engine of claim 13 additionally comprising a plurality of valves for controlling the input of air and fuel to said combustion chambers and for controlling the removal of exhaust gases from said combustion chambers, a first plurality of cams connected to said inner shaft and having a plurality of camming surfaces, a second plurality of cams connected to said outer shaft and having a plurality of camming surfaces, and means responsive to said first and second pluralities of cams for opening and closing said plurality of valves in a timed relationship determined by said plurality of camming surfaces.

18. The rotary engine of claim 13 additionally comprising a fuel injection pump having a first fuel injection unit for injecting fuel into said combustion chambers in response to the annular position of said inner shaft and a second fuel injection unit for injecting fuel into said combustion chambers in response to the angular position of said outer shaft.

19. A power transfer mechanism for a rotary engine having an annular cylinder, first carrying means rotatable about an axis of rotation for carrying a first pair of diametrically opposed pistons such that said pistons of said first pair of pistons travel in a circular path within said cylinder, second carrying means rotatable about said axis of rotation for carrying a second pair of diametrically opposed pistons such that said pistons of said second pair of pistons travel in a circular path within said cylinder and such that said second pair of pistons cooperates with said first pair of pistons to define a plurality of combustion chambers within said cylinder, combustion causing means for causing combustion within said combustion chambers such that said first and second carrying means are alternately driven, said power transfer mechanism comprising a drive shaft having at least one gear; first transferring means connected to said first carrying means for transferring power to said drive shaft when said first carrying means is driven, said first transferring means including a first partial gear arranged coaxially with respect to said axis of rotation and having at least one toothed portion and at least one non-toothed portion; and second transferring means connected to said second carrying means for transferring power to said drive shaft when said second carrying means is driven, said second transferring means including a second partial gear arranged coaxially with respect to said axis of rotation and having at least one toothed portion and at least one non-toothed portion, said first and second partial gears being arranged relative to each other such that when said first carrying means is driven said at least one toothed portion of said first partial gear is in meshing engagement with said at least one gear of said drive shaft and said at least one toothed portion of said second partial gear is out of meshing engagement with said at least one gear of said drive shaft, whereby power is transferred from said first carrying means to said driven shaft through said first partial gear only, and such that when said second carrying means is driven said at least one toothed portion of said second partial gear is in meshing engagement with said at least one gear of said drive shaft and said at least one toothed portion of said first partial gear is out of meshing engagement with said at least one gear of said drive shaft, whereby power is trnasferred from said second carrying means to said drive shaft through said second partial gear only.

20. The power transfer mechanism of claim 19 wherein said drive shaft includes a first gear, which is engageable with said at least one toothed portion of said first partial gear, and a second gear, which is engageable with said at least one toothed portion of said second partial gear.

21. The power transfer mechanism of claim 20 wherein said first partial gear includes a first toothed portion, a second toothed portion, a first non-toothed portion, which separates said first and second toothed portions of said first partial gear on one side of said first partial gear, and a second non-toothed portion, which separates said first and second toothed portions of said first partial gear on an opposite side of said firat partial gear, and wherein said second partial gear includes a first toothed portion, a second toothed portion, a first non-toothed portion, which separates said first and second toothed portions of said second partial gear on one side of said second partial gear, and a second non-toothed portion, which separates said first and second toothed portions of said second partial gear on an opposite side of said second partial gear.

22. The power transfer mechanism of claim 21 wherein said first toothed portion of said first partial gear covers one third of the circumference of said first partial gear, said second toothed portion of said first partial gear covers one third of the circumference of said first partial gear, said first non-toothed portion of said first partial gear covers one sixth of the circumference of said first partial gear and said second non-toothed portion of said first partial gear covers one sixth of the circumference of said first partial gear; and wherein said first toothed portion of said second partial gear covers one third of the circumference of siad second partial gear, said second toothed portion of said second partial gear covers one third of the circumference of said second partial gear, said first non-toothed portion of said second partial gear covers one sixth of the circumference of said second partial gear and said second non-toothed portion of said second partial gear covers one sixth of the circumference of said second partial gear.

23. The power transfer mechanism of claim 22 wherein said first carrying means and said first partial gear are connected to an inner shaft arranged coaxially with respect to said axis of rotation and said second carrying means and said second partial gear are connected to an outer shaft arranged coaxially with respect to said axis of rotation, whereby said inner and outer shafts are arranged coaxially with respect to each other.

24. The power transfer mechanism of claim 23 further comprising controlling means for controling the rotation of said inner and outer shafts such that said inner shaft and hence said first partial gear rotate twice as fast as said outer shaft and hence said second partial gear when said first partial gear is in meshing engagement with said first gear of said drive shaft and said second partial gear is out of meshing engagement with said second gear of said drive shaft and such that said outer shaft and hence said second partial gear rotate twice as fast as said inner shaft and hence said first partial gear when said second partial gear is in meshing engagement with said second gear of said drive shaft and said first partial gear is out of meshing engagement with said first gear of said driven shaft.

25. The power transfer mechanism of claim 24 wherein said controlling means includes a cam follower having first, second, third and fourth rollers interconnected by first, second, third and fourth members to form a four-sided cam follower with one of said rollers at each of the corners thereof, said first and third members being connected to said inner shaft and said second and fourth members being connected to said ouer shaft.

26. The power transfer mechanism of claim 25 wherein said controlling means further includes a cam surface defined by the inner section of two circles, the center of each of said circles being displaced from said other circle by a distance equal to the radius of said rollers.

* * * * *